US008795935B2

(12) United States Patent
Kami et al.

(10) Patent No.: US 8,795,935 B2
(45) Date of Patent: Aug. 5, 2014

(54) ELECTROPHOTOGRAPHIC PHOTOCONDUCTOR, PRODUCTION METHOD OF THE SAME, IMAGE FORMING APPARATUS, AND PROCESS CARTRIDGE

(75) Inventors: Hidetoshi Kami, Shizuoka (JP); Junichi Yamazaki, Shizuoka (JP); Yukio Fujiwara, Shizuoka (JP); Kazuhiro Egawa, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 106 days.

(21) Appl. No.: 13/256,989

(22) PCT Filed: Mar. 17, 2010

(86) PCT No.: PCT/JP2010/055145

§ 371 (c)(1),
(2), (4) Date: Sep. 16, 2011

(87) PCT Pub. No.: WO2010/107130

PCT Pub. Date: Sep. 23, 2010

(65) Prior Publication Data

US 2012/0008984 A1 Jan. 12, 2012

(30) Foreign Application Priority Data

Mar. 17, 2009 (JP) ..... 2009-063861
Aug. 31, 2009 (JP) ..... 2009-199814

(51) Int. Cl.
*G03G 15/04* (2006.01)

(52) U.S. Cl.
USPC ..... 430/66; 430/58.75

(58) Field of Classification Search
USPC ..... 430/58.7, 58.75, 66
See application file for complete search history.

(56) References Cited

U.S. PATENT DOCUMENTS 5,162,183 A 11/1992 Lindblad et al.
5,187,039 A 2/1993 Meyer (Continued)

FOREIGN PATENT DOCUMENTS

EP 0473292 A2 3/1992
JP 57-78402 5/1982

(Continued)

OTHER PUBLICATIONS

Hyakutake, Nobuo, et al. (2001) "Blade cleaning system for polymerized and small size toner," Japanese Hardcopy Fall Meeting, pp. 24-27 (with partial English translation).

(Continued)

*Primary Examiner* — Stewart Fraser
(74) *Attorney, Agent, or Firm* — Cooper & Dunham LLP

(57) ABSTRACT

An electrophotographic photoconductor having a photosensitive layer and a crosslinked resin surface layer over a support, wherein shapes of concaves and convexes in a surface of the electrophotographic photoconductor are measured by a surface roughness/profile measuring device to obtain one-dimensional data arrays, the arrays are subjected to multiresolution analysis (MRA-1) through wavelet transformation to be separated into six frequency components including HHH, HHL, HMH, HML, HLH and HLL to obtain one-dimensional data arrays, the arrays of the HHL are thinned out to be reduced 1/10 to 1/100, thereby producing one-dimensional data arrays, which are then subjected to multiresolution analysis (MRA-2) through wavelet transformation to be separated into six frequency components including LHH, LHL, LMH, LML, LLH and LLL to thereby obtain 12 frequency components in total; and a center-line average roughness (WRa) of the 12 frequency components satisfies relationship (i) below.

$$1-597\times WRa(HML)+238\times WRa(HLH)-95\times WRa(LHL)+84\times WRa(LMH)-79\times WRa(LML)+55\times WRa(LLH)-17\times WRa(LLL)>0 \quad (i)$$

9 Claims, 26 Drawing Sheets

(56) References Cited

U.S. PATENT DOCUMENTS

| | | | | |
|---|---|---|---|---|
| 6,143,452 | A | 11/2000 | Sakimura et al. | |
| 6,180,303 | B1 | 1/2001 | Uematsu et al. | |
| 6,406,825 | B1 | 6/2002 | Sakimura et al. | |
| 2002/0018947 | A1 | 2/2002 | Kabata et al. | |
| 2002/0037464 | A1 | 3/2002 | Kawada et al. | |
| 2002/0081130 | A1 | 6/2002 | Endo et al. | |
| 2002/0160287 | A1 | 10/2002 | Miyamoto et al. | |
| 2003/0175606 | A1 | 9/2003 | Kabata et al. | |
| 2004/0234294 | A1 | 11/2004 | Nagame et al. | |
| 2005/0255393 | A1 | 11/2005 | Nakata et al. | |
| 2006/0008717 | A1 | 1/2006 | Uematsu et al. | |
| 2006/0019185 | A1 | 1/2006 | Amamiya et al. | |
| 2006/0057479 | A1* | 3/2006 | Niimi et al. | 430/59.4 |
| 2007/0196752 | A1 | 8/2007 | Dinh et al. | |
| 2008/0038649 | A1 | 2/2008 | Hirose et al. | |
| 2008/0085459 | A1* | 4/2008 | Kami et al. | 430/66 |
| 2008/0227008 | A1* | 9/2008 | Kami et al. | 430/66 |
| 2008/0305415 | A1 | 12/2008 | Wu et al. | |
| 2008/0311499 | A1* | 12/2008 | Kami et al. | 430/66 |
| 2009/0029277 | A1 | 1/2009 | Okuda et al. | |
| 2009/0186287 | A1 | 7/2009 | De Jong et al. | |

FOREIGN PATENT DOCUMENTS

| | | |
|---|---|---|
| JP | 63-28552 | 2/1988 |
| JP | 5-88392 | 4/1993 |
| JP | 7-104497 | 4/1995 |
| JP | 7-292095 | 11/1995 |
| JP | 8-248663 | 9/1996 |
| JP | 3040540 | 3/2000 |
| JP | 2000-162881 | 6/2000 |
| JP | 2000-171990 | 6/2000 |
| JP | 2001-265014 | 9/2001 |
| JP | 2001-289630 | 10/2001 |
| JP | 2001-343771 | 12/2001 |
| JP | 2002-82468 | 3/2002 |
| JP | 2002-196645 | 7/2002 |
| JP | 2002-251029 | 9/2002 |
| JP | 2002-258705 | 9/2002 |
| JP | 2002-296994 | 10/2002 |
| JP | 2002-299406 | 10/2002 |
| JP | 2002-311613 | 10/2002 |
| JP | 2002-341572 | 11/2002 |
| JP | 2003-131537 | 5/2003 |
| JP | 2003-241408 | 8/2003 |
| JP | 2003-270840 | 9/2003 |
| JP | 2004-54001 | 2/2004 |
| JP | 2004-61359 | 2/2004 |
| JP | 2004-101710 | 4/2004 |
| JP | 2004-258588 | 9/2004 |
| JP | 2005-208112 | 8/2005 |
| JP | 2005-227742 | 8/2005 |
| JP | 2005-315995 | 11/2005 |
| JP | 2006-53576 | 2/2006 |
| JP | 2006-53577 | 2/2006 |
| JP | 2006-078614 | 3/2006 |
| JP | 2006-79102 | 3/2006 |
| JP | 3782680 | 3/2006 |
| JP | 3789081 | 4/2006 |
| JP | 2006-163302 | 6/2006 |
| JP | 2006-308743 | 11/2006 |
| JP | 3878425 | 11/2006 |
| JP | 3878427 | 11/2006 |
| JP | 3878428 | 11/2006 |
| JP | 2007-79230 | 3/2007 |
| JP | 2007-79244 | 3/2007 |
| JP | 2007-86319 | 4/2007 |
| JP | 2007-086320 | 4/2007 |
| JP | 3938209 | 4/2007 |
| JP | 3938210 | 4/2007 |
| JP | 3943476 | 4/2007 |
| JP | 2007-163683 | 6/2007 |
| JP | 4003914 | 8/2007 |
| JP | 2007-233358 | 9/2007 |
| JP | 4011790 | 9/2007 |
| JP | 2007-292772 | 11/2007 |
| JP | 4110116 | 4/2008 |
| JP | 2008-122869 | 5/2008 |
| JP | 4136567 | 6/2008 |
| JP | 2008-164948 | 7/2008 |
| JP | 2008-257228 | 10/2008 |
| JP | 2008-261971 | 10/2008 |
| JP | 4194973 | 10/2008 |
| JP | 2009-025710 | 2/2009 |

OTHER PUBLICATIONS

Canadian official action dated Aug. 21, 2012 in corresponding Canadian patent application No. 2,755,752.

Japanese official action dated May 16, 2013 in corresponding Japanese patent application No. 2009-199814.

European Search Report dated Aug. 5, 2013 in corresponding European patent application No. 10 75 3620.3.

* cited by examiner

Indicated by arrow: conventional product

B: inflection point

C: local maximum

ELECTROPHOTOGRAPHIC PHOTOCONDUCTOR, PRODUCTION METHOD OF THE SAME, IMAGE FORMING APPARATUS, AND PROCESS CARTRIDGE

TECHNICAL FIELD

The present invention relates to an electrophotographic photoconductor which is applied to copiers, facsimiles, laser printers, direct digital platemakers, and the like, a production method of the same, an image forming apparatus, and a process cartridge.

BACKGROUND ART

As electrophotographic photoconductors applied to copiers, laser printers and the like, hitherto, inorganic photoconductors composed of selenium, zinc oxide, cadmium sulfide and the like, which had been most commonly used, but in present day, organic photoconductors (OPCs) have become most commonly used which are more advantageous in reducing burden on global environment, low cost performance and high degree of design freedom, than the inorganic photoconductors. Recently, organic photoconductors are utilized at levels approaching 100% of the total amount of production of electrophotographic photoconductors. The organic photoconductors are required to be converted from supply products (disposable products) to machine parts, in response to the recent growing awareness of environmental protection.

So far, various attempts have been made to impart high durability to organic photoconductors. In present days, forming a crosslinked resin film on a surface of a photoconductor (e.g. PTL 1) and forming a sol-gel cured film on a surface of a photoconductor (e.g. PTL 2) are, in particular, highly expected for next-generation electrophotographic photoconductors.

The former has an advantage in that flaws and cracks hardly occur even when a charge transporting component is blended therein, thereby reducing yield loss. Especially, radical polymerizable acrylic resins are excellent in toughness, and thus use of them is advantageous in easily obtaining a photoconductor excellent in photosensitivity. In these two methods of using a resin having a crosslinked structure, a coated film is formed from plural chemical bonds, and thus even when the coated film is subjected to stress and part of the chemical bonds is broken, this will not immediately lead to abrasion of the photoconductor.

In the meanwhile, developing toners for use in electrophotography are advantageous in ecological property in production and achieving higher image quality, and therefore, polymerized toners (spherically shaped toners) are becoming more commonly used.

The polymerizable toners (spherically shaped toners) are spherical-shaped toners having no angular portion and produced by a chemical method such as a suspension polymerization method, emulsion-aggregation polymerization method, ester elongation method, or dissolution-suspension method. Polymerized toners differ in shape depending upon the production method employed, and polymerized toners for use in image forming apparatuses are made to have slightly more irregular shape than spherical-shape toners in consideration of easy cleanability and the like. A typical average spherical degree of toners is from 0.95 to 0.99, and typical shape coefficients, i.e., SF-1, and SF-2 are from 110 to 140. Note that when the average spherical degree is 1.0 and the shape coefficients SF-1 and SF-2 are 100, it indicates that the toner has a complete sphere shape.

Since polymerized toner particles are uniform in shape, the amount of electric charge to be retained by the toner tends to be relatively uniform. In addition, a wax and the like (in an amount of 5% to 10%) are easily internally added. Therefore, polymerized toners hardly run over the edge of a latent electrostatic image and are excellent in developing property, image sharpness, resolution, gray-scale tone and in transfer efficiency. Besides, polymerized toners have many advantages. For example, it is unnecessary to use oil in transfer process of image. On the other hand, this type of toner has drawbacks in that it is difficult to clean smear of toner and it is necessary to increase the amount of external additives with tendencies of employing oil-less process. As a result, inconveniences take place, such as toner filming easily occurs on a surface of the photoconductor. There have been many studies made to solve the drawbacks, and lots of proposals have been made so far.

In order to establish the cleanability of a polymerized toner, generally, it is desired for a photoconductor to have a low coefficient of friction at its surface and be capable of sustaining the coefficient of friction even in repetitive use thereof. For example, it has been known that the cleanability of a polymerized toner can be improved by applying a solid lubricant, such as zinc stearate, to the surface of a photoconductor (see NPL 1).

When a solid lubricant such as zinc stearate is externally supplied onto a highly durable electrophotographic photoconductor on which surface the above-mentioned radical polymerizable crosslinked acrylic resin film is laminated, inconveniently, the solid lubricant may not be readily accepted by the photoconductor surface. Most of this type photoconductors have a smooth surface. Therefore, the problem with the acceptability is believed attributable to the smoothness of the photoconductor. To solve this problem, PTL 3 discloses a technique of stably supplying a lubricant material onto a photoconductor by forming the photoconductor surface to have a rough surface. Specifically, PTL 3 discussed that it is advantageous to set a surface roughness (Rz-JIS-1994) of a photoconductor to 0.4 μm to 1.0 μm and, as a measure, to add a filler into a surface layer of the photoconductor. It is also described that the advantageous point is to maintain a specific surface roughness of the photoconductor.

However, even if photoconductor surfaces have a same Rz value, a variety of rough surface configurations are present. For instance, surfaces of photoconductors sometimes have a same Rz value despite a profound difference in a distance of a concave portion from a convex portion (one concave-convex cycle length). For this reason, in some cases, there are ranks of acceptability of zinc stearate among photoconductors having a same Rz. In order to improve the acceptability of zinc stearate on the surface of a photoconductor, it is necessary to set special requirements other than Rz. The surface roughness of electrophotographic photoconductors is an important item of properties, and in most cases, the surface roughness has been determined so far by a method defined in JIS B0601 etc., as in the case just disclosed in PTL 3.

As methods for measuring the surface roughness widely used, there are an arithmetic average roughness (Ra), a maximum height (Rmax) and a 10-point average roughness (Rz), and the like. However, these evaluation methods have a drawback that measured values vary when exceedingly concave and/or convex portions are present in the area of a photoconductor surface measured.

There have been no methods for accurately evaluating the degree of surface roughness, and then studies are made on parameters indicating the degree of surface roughness. The following describes the study on the parameters.

In PTL 4, over a cross-section curve (1) which is obtained by measuring a surface configuration with a surface roughens measurement device, a divided width (X) which is set in a center of an average line (2) is defined, and a surface roughness is evaluated by the number of peak units (4) formed of a pair of a top and a bottom adjacent to one another positioned beyond the divided width (X) per unit length (L). An organic photoconductor is produced using a base material in which the number of peak units (4), when the divided width (X) is set to 20 μm and the unit length (L) is set to 1 cam, is 100 or less.

In PTL 5, in order to solve a problem that cleaning defects tends to occur when a toner having a smaller diameter is used in view to forming high quality images, a cleaning roller to which a bias voltage is applied so as to separate charged toner from a photoconductor used, is provided upstream a cleaning blade and the photoconductor is designed to have a 10-point average surface roughness Rz of 0.1 μm to 2.5 μm.

Meanwhile, PTL 6 proposes a method for satisfying relationships of $\Delta T>Rz$ and $0\ nm<\Delta T+Rz<5\ nm$, where a depletion amount of film thickness per K-Cycle is defined as $\Delta T$ and a surface roughness is defined as Rz.

Further, PTL 7 discloses a system including a blade, a toner composition and a unused image forming member, in which the unused image forming member includes a surface on which a latent image is formed using the toner composition, and the surface of the unused image forming member has a surface roughness defined by the following relationships.

$$R/ann4>KB(1-\sigma2)/32\pi Et2af$$

and $$R/ann2<\sqrt{3/8}\pi2\cdot(1+\mu2)/\mu\cdot KB/\lceil\cdot t/af\cdot\theta \quad (A)$$

In the relationships (A), R denotes an average height of convex portions in the surface, "ann" denotes a half (½) of the closest distance between adjacent convex portions on the surface, KB denotes a modulus of volume elasticity of the blade, σ denotes a Poisson's ratio of the toner composition, E denotes a Young's modulus of the toner composition, t denotes an average thickness of flat particles in the toner composition, "af" denotes an average radius of the flat particles, u denotes an average value between a toner-blade frictional coefficient and a toner-surface frictional coefficient, Γ denotes a Dupre work of adhesion between the surface and the flat particles, and A denotes a blade tip angle.

Further, PTL 8 proposes a cylindrically shaped electrophotographic photoconductor including a cylindrically shaped support and an organic photosensitive layer provided on the cylindrically shaped support, in which a circumferential surface of the electrophotographic photoconductor has a plurality of dimple concave portions; the circumferential surface has a 10-point average roughness Rzjis (A) of 0.3 μm to 2.5 μm when measured along a circumferential direction of the circumferential surface and has a 10-point average roughness Rzjis (B) of 0.3 μm to 2.5 μm when measured along a bus line direction of the circumferential surface; an average interval RSm (C) between concave portions and convex portions is 5 μm to 120 μm when measured along a circumferential direction of the circumferential surface of the electrophotographic photoconductor; an average interval RSm(D) between concave portions and convex portions is 5 μm to 120 μm when measured along a bus line direction of the circumferential surface; a ratio (D/C) of the average interval RSm (D) to the average interval RSm (C) is 0.5 to 1.5; the longest diameter of the dimple concave portions is ranging from 1 μm to 50 μm; and the number of dimple concave portions having a depth of 0.1 μm to 2.5 μm is 5 to 50 per 10,000 $\mu m^2$ of the circumferential surface of the electrophotographic photoconductor.

It is also specified that the 10-point average roughness Rzjis (A) is preferably 0.4 μm to 2.0 μm, the 10-point average roughness Rzjis (B) is preferably 0.4 μm to 2.0 μm, the average interval RSm (C) between concave portions and convex portions is preferably 10 μm to 100 μm, the average interval RSm (D) between concave portions and convex portions is preferably 10 μm to 100 μm and the ratio (D/C) of the average interval RSm (D) to the average interval RSm (C) is preferably 0.8 to 1.2.

Furthermore, it is specified that a maximum height Rp (F) of the circumferential surface of the electrophotographic photoconductor is preferably 0.6 μm or lower, and a ratio (E/F) of a maximum depth Rv (E) of the circumferential surface to the maximum height Rp(F) is preferably 1.2 or greater.

PTL 9 discloses an electrophotographic photoconductor including a support and an organic photosensitive layer provided on the support, in which a plurality of dimple concave portions are formed on a surface of a surface layer of the electrophotographic photoconductor, the longest diameter of the dimple concave portions is ranging from 1 μm to 50 μm, the number of dimple concave portions having a depth of 0.1 μm or more and a volume of 1 $\mu m^3$ or more is 5 to 50 per 100 μm square of the surface of the surface layer of the electrophotographic photoconductor, and a plurality of concave portions corresponding to the dimple concave portions formed on the surface of the surface layer are provided at a boundary surface between the surface layer and a layer provided immediately under the surface layer.

PTL 10 proposes an image forming apparatus including a plurality of image bearing members each having a conductive support and a photosensitive layer on the conductive support and each configured that a surface thereof is exposed to light so as to form a latent electrostatic image, a plurality of developing devices each provided corresponding to the plurality of image bearing members and each configured to develop the latent electrostatic image using a developer, and a plurality of cleaning units each provided corresponding to the plurality of image bearing members and each configured to rub against a surface of each of the image bearing members so as to remove the developer, wherein at least a pair of developer devices among the plurality of developing devices house developers which are same in color but different in brightness, and wherein a 10-point average roughness Rz of the surface of each of the image bearing members at an initial stage is controlled according to the brightness of the developers housed in the developing devices corresponding the each of the image bearing members.

PTL 11 proposes an image forming apparatus configured to form an image using an electrophotographic photoconductor which has such a surface roughness that a 10-point average surface roughness Rz is 0.1 μm to 1.5 μm or a maximum height Rz is 2.5 μm or lower and which has such a surface property that a friction resistance Rf, which is a tensile load measured when a polyurethane-made flat belt having a JIS-A hardness of 70 degrees to 80 degrees, a width of 5 mm, a length of 325 mm, a thickness of 2 mm and a self weight of 4.58 g is applied under a load of 100 g, a contact length in a circumferential direction is set to 3 mm and a contact area is set to 15 $mm^2$, satisfies a relationship of $45\ gf<Rf<200\ gf$.

PTL 12 proposes an image forming method which includes developing a latent image formed on an electrophotographic photoconductor using a developer; primarily transferring a toner image, which has been formed in a visible image by the developer, onto an intermediate transfer member; secondarily transferring the toner image, which has been transferred onto the intermediate transfer member, onto a recording material; and removing a residual toner remaining on the electrophotographic photoconductor after transfer of the toner image onto the recording material, wherein a surface roughness Ra of the electrophotographic photoconductor is 0.02 μm to 0.1 μm, a surface roughness Rz of the intermediate transfer member is 0.4 μm to 2.0 μm, and an energy reducing agent is supplied to a surface of the electrophotographic photoconductor, so that an image is formed.

PTL 13 proposes an image forming apparatus including an organic photoconductor, wherein in the organic photoconductor, an average value of concave-convex cycles of concaves and convexes provided in its surface is 10 times or more the volume average particle diameter of a toner used.

PTL 14 proposes an electrophotographic apparatus including an electrophotographic photoconductor which rotates at a circumferential speed of 200 mm/sec and a cleaning unit, wherein the electrophotographic photoconductor has a conductive support, a photosensitive layer and a surface protective layer, the photosensitive layer and surface protective layer being provided over the conductive support, wherein the surface protective layer contains a fluorine-containing resin particle in an amount of 35.0% by mass to 45.0% by mass relative to the total mass of the surface protective layer, wherein the electrophotographic photoconductor has a 10-point average roughness of 0.1 μm to 5.0 μm, a surface hardness of 0.1 to 10.0 when measured by Taber abrasion resistance test and a surface frictional coefficient of 0.1 to 0.7; wherein the cleaning unit is a rubber elastic blade, a linear pressure of the cleaning blade against the electrophotographic photoconductor is 0.294N to 0.441N/cm, a glass transition temperature (Tg) of a toner used is 40° C. to 55° C., a tensile elastic modulus (Young's modulus) of the cleaning blade is 784N to 980N/cm$^2$, a rebound resilience of the cleaning blade is 35% to 55%, and a base surface of the cleaning blade contains a fluororesin fine particle.

PTL 15 proposes an image forming method using an image forming member which satisfies a relationship of $d/t \times 0.01 \leq Ra \leq 0.5$ when a relationship between a flatness (d/t) of a toner (d: volume average diameter, t: thickness of toner particle) and a surface roughness of the image forming member is represented by a center line average roughness Ra (μm).

Also, PTL 16, PTL 17, and PTL 18 each propose an image forming apparatus, in which concave and convex portions are provided in an image forming member, the concave and convex portions having a size smaller than the volume average particle diameter of a spherical-shaped toner used therein.

PTL 19 discloses an electrophotographic photoconductor including an electrophotographic photoconductor which rotates at a circumferential speed of 200 mm/sec and a cleaning unit, wherein the electrophotographic photoconductor has a conductive support, a photosensitive layer and a surface protective layer, the photosensitive layer and surface protective layer being provided over the conductive support, wherein the surface protective layer contains a fluorine-containing resin particle in an amount of 15.0% by mass to 40.0% by mass relative to the total mass of the surface protective layer, wherein the electrophotographic photoconductor has a 10-point average roughness of 0.1 μm to 5.0 μm, a surface hardness of 0.1 to 20.0 when measured by Taber abrasion resistance test and a surface frictional coefficient of 0.001 to 1.2.

Meanwhile, as methods for evaluating a surface configuration of a photoconductor, many evaluation methods using Fourier transform have been proposed (see PTL 20, PTL 21, PTL 22, PTL 23, PTL 24, PTL 25, PTL 26, PTL 27, PTL 28, and PTL 29). In the Fourier transform of these proposals, changes that frequently occur in signals can be grasped as a distribution of frequency components thereof, however, these evaluation methods are not advantageous in examining changes of signals that do not often occur. Also, from the result of the Fourier transform, inconveniently, where that change occurs cannot be detected because positional (time) information of a horizontal axis is completely lost after transformation.

Also, PTL 30 propose a method of evaluating a surface roughness of a base material, in which a cross-section curve of the surface of the base material is determined with a length of 100 μm from an arbitrarily selected position thereof in an axial direction of the base material by a method defined in JIS B0601, a position of the cross-section curve in a vertical direction thereof at the position spaced at regular intervals in the horizontal axis direction is measured, a distribution defined in JIS Z8101 at this point is found, a measurement value selected from surface roughness values of Ra, Rz and Ry which are defined in JIS B0601 is determined, and the surface roughness is evaluated using the distribution and the measurement value.

PTL 31 proposes a method of evaluating a surface state of an image forming apparatus component, in which a cross-section curve defined in JIS B0601 is determined, data arrays on positions spaced at regular intervals on the cross-section curve in a surface roughness direction is subjected to a multiresolution analysis, and the surface roughness is evaluated based on at least the result of the multiresolution analysis.

Furthermore, PTL 32 discusses a base material for electrophotographic photoconductor, which is evaluated for a state of a surface of an image forming apparatus component, by a method where a cross-section curve defined in JIS B0601 is determined, data arrays on positions spaced at regular intervals on the cross-section curve in a surface roughness direction is subjected to a multiresolution analysis, the surface roughness of the image forming apparatus component is evaluated based on at least the result of the multiresolution analysis.

Even with any of the above methods for evaluating a surface roughness, there is a problem that the cleanability of electrophotographic apparatuses using a small-diameter toner or polymerized toner cannot be accurately evaluated. That is, with an evaluation method using surface roughness values Ra, Rmax, Rz and the like, a surface roughness cannot be accurately grasped. For this reason, a method has been employed so far in which in measurement of a surface roughness, first, a recording chart obtained by a surface roughness/profile measuring device is preliminarily saves, and then a surface roughness is examined from a cut wave form recorded in the recording chart, but there is a need to read the tendency of the recording chart, which requires a specific skill and some experience.

As having been described above, conventional methods for evaluation a surface roughness (a center-line surface roughness Ra, Rmax, Rz) have a drawback that the cleanability of a photoconductor in an electrophotographic apparatus using a small diameter toner or polymerized toner cannot be accurately evaluated.

Also, PTL 3 has the following drawbacks. In an Example thereof, an alumina fine particle is used. Alumina fine particles are unstable in terms of dispersibility of filler in a coating liquid, and thus some contrivance is necessary to determine film forming requirements. In another Example using a polymethylsilsesquioxane fine particle, it cannot be said that the acceptability of lubricant on a surface of a photoconductor is not sufficient. It is conceivable that the photoconductor cannot satisfactorily bear a solid lubricant on its surface due to large size concaves and convexes on the surface of the photoconductor.

A crosslinked-resin-surface-layer coating liquid has a low viscosity because it is mainly formed of a monomer component. By contrast, a silicon-containing fine particle such as a silica fine particle, and a silicone resin fine particle, has usually high dispersion stability in a crosslinked-resin-surface-layer coating liquid, and thus the use thereof is especially advantageous in terms of production, among a variety of fillers. However, inconveniently, conventional techniques have the following difficulties.

In PTL 33, in Example 2 described in paragraph [0162] and subsequent part, a silicon-containing fine particle is used. It is however cannot be said that the acceptability of solid lubricant on the surface of a photoconductor is sufficient. It is conceivable that the photoconductor cannot satisfactorily bear the solid lubricant on its surface due to exceedingly large concaves and convexes provided therein. There is a need to add a new different technique thereto.

PTL 34 discussed that an inorganic fine particle (hydrophobized silica) having an average particle diameter of 0.05 μm to 0.5 μm is dispersed in a thickness of 0.05 μm to 15 μm on a photosensitive layer having a surface roughness of 0.1 μm to 0.5 μm, which has been formed on a conductive support having a surface roughness of 0.01 μm to 2 μm. It is described that this method can achieve high durability of a photoconductor and prevent a reduction in resolution due to adhesion of contamination such as corona products on a photoconductor surface by subjecting the silica particle to a hydrophobization treatment. By effect of the hydrophobization of the inorganic fine particle, repellency of water-droplet (due to a wide contact angle) can be exhibited, however, it is impossible to prevent adhesion of corona products, and so image flow cannot be prevented. To solve the problem, for example, as can be seen in PTL 35, occurrence of image flow is avoided by using alumina as a filler. However, as described above, in a case of a crosslinked resin surface layer, it is difficult to directly use alumina in the coating liquid because of the problems described above.

Further, PTL 36 discusses that a lubricant removing unit to electrostatically remove a powder-form lubricant remaining on an image bearing member is provided in non-contact with the image bearing member.

In an image forming apparatus in which a solid lubricant is externally added to a surface of a photoconductor, the acceptability of solid lubricant on the photoconductor affects the abrasion rate of the photoconductor surface and the cleanability of toner and influence the quality of print images. In present, a technique for satisfactorily improving the acceptability of solid lubricant on a photoconductor surface in which a highly durable crosslinked resin surface layer is laminated has not yet been obtained.

As having been described, on providing of high durability to electrophotographic photoconductors, drastic improvements can be expected by forming a crosslinked resin film on the photoconductors surfaces. The cleanability of polymerized toners, which can be said as most frequently used for developers, is an important subject of technique. To solve the subject, application of solid lubricant to a surface of a photoconductor is advantageous. However, electrophotographic photoconductors with a crosslinked resin film being provided at the uppermost surface thereof are poor in coatability of solid lubricant, and therefore it has been unable to fully use their excellent durability.

CITATION LIST

Patent Literature

[PTL 1] Japanese Patent Application Laid-Open (JP-A) No. 2000-66424
[PTL 2] Japanese Patent Application Laid-Open (JP-A) No. 2000-171990
[PTL 3] Japanese Patent Application Laid-Open (JP-A) No. 2007-79244
[PTL 4] Japanese Patent Application Laid-Open (JP-A) No. 07-104497
[PTL 5] Japanese Patent Application Laid-Open (JP-A) No. 2002-196645
[PTL 6] Japanese Patent Application Laid-Open (JP-A) No. 2006-163302
[PTL 7] Japanese Patent (JP-B) No. 3040540
[PTL 8] Japanese Patent (JP-B) No. 3938209
[PTL 9] Japanese Patent (JP-B) No. 3938210
[PTL 10] Japanese Patent Application Laid-Open (JP-A) No. 2005-345788
[PTL 11] Japanese Patent Application Laid-Open (JP-A) No. 2004-258588
[PTL 12] Japanese Patent Application Laid-Open (JP-A) No. 2004-54001
[PTL 13] Japanese Patent Application Laid-Open (JP-A) No. 2003-270840
[PTL 14] Japanese Patent Application Laid-Open (JP-A) No. 2003-241408
[PTL 15] Japanese Patent Application Laid-Open (JP-A) No. 2003-131537
[PTL 16] Japanese Patent Application Laid-Open (JP-A) No. 2002-296994
[PTL 17] Japanese Patent Application Laid-Open (JP-A) No. 2002-258705
[PTL 18] Japanese Patent Application Laid-Open (JP-A) No. 2002-299406
[PTL 19] Japanese Patent Application Laid-Open (JP-A) No. 2002-82468
[PTL 20] Japanese Patent Application Laid-Open (JP-A) No. 2001-265014
[PTL 21] Japanese Patent Application Laid-Open (JP-A) No. 2001-289630
[PTL 22] Japanese Patent Application Laid-Open (JP-A) No. 2002-251029
[PTL 23] Japanese Patent Application Laid-Open (JP-A) No. 2002-296822
[PTL 24] Japanese Patent Application Laid-Open (JP-A) No. 2002-296823
[PTL 25] Japanese Patent Application Laid-Open (JP-A) No. 2002-296824
[PTL 26] Japanese Patent Application Laid-Open (JP-A) No. 2002-341572
[PTL 27] Japanese Patent Application Laid-Open (JP-A) No. 2006-53576
[PTL 28] Japanese Patent Application Laid-Open (JP-A) No. 2006-53577
[PTL 29] Japanese Patent Application Laid-Open (JP-A) No. 2006-79102
[PTL 30] Japanese Patent Application Laid-Open (JP-A) No. 2004-117454
[PTL 31] Japanese Patent Application Laid-Open (JP-A) No. 2004-61359
[PTL 32] Japanese Patent Application Laid-Open (JP-A) No. 2007-292772
[PTL 33] Japanese Patent Application Laid-Open (JP-A) No. 2005-99688

[PTL 34] Japanese Patent Application Laid-Open (JP-A) No. 08-248663

[PTL 35] Japanese Patent Application Laid-Open (JP-A) No. 2004-138643

[PTL 36] Japanese Patent Application Laid-Open (JP-A) No. 2008-122869

Non Patent Literature

[NPL1] Japan Hardcopy Fall Meeting, 24-27, 2001 (Nobuo Hyakutake, Akihisa Maruyama, Satoshi Shigezaki, Hiroe Okuyama)

SUMMARY OF INVENTION

The present invention aims to improve the lubricant acceptability of highly durable electrophotographic photoconductors having a crosslinked resin surface layer, thereby achieving life extension of electrophotographic photoconductors and image forming apparatuses and further aims to provide an electrophotographic photoconductor capable of reducing printing costs, a method of producing the same, an image forming apparatus and a process cartridge.

Means for solving the above problems are as follows:

<1> An electrophotographic photoconductor including:

a support, a photosensitive layer, and a crosslinked resin surface layer, the photosensitive layer and crosslinked resin surface layer being provided over the support, wherein shapes of concaves and convexes in a surface of the electrophotographic photoconductor are measured by a surface roughness/profile measuring device to obtain one-dimensional data arrays, the one-dimensional data arrays are subjected to a multiresolution analysis (MRA-1) through wavelet transformation so as to be separated into six frequency components including a highest frequency component (HHH), a second highest frequency component (HHL), a third highest frequency component (HMH), a fourth highest frequency component (HML), a fifth highest frequency component (HLH) and a lowest frequency component (HLL), the one-dimensional data arrays of the lowest frequency component (HHL) thus obtained are thinned out so that the number of data arrays is reduced to 1/10 to 1/100 thereof to thereby produce one-dimensional data arrays, the one-dimensional data arrays thus produced are subjected to a multiresolution analysis (MRA-2) through wavelet transformation so as to be separated into six frequency components including a highest frequency component (LHH), a second highest frequency component (LHL), a third highest frequency component (LMH), a fourth highest frequency component (LML), a fifth highest frequency component (LLH) and a lowest frequency component (LLL) to thereby obtain 12 frequency components in total; and a center-line average roughness (WRa) of each of the 12 frequency components satisfies a relationship (i) below, $$1-597\times WRa(HML)+238\times WRa(HLH)-95\times WRa(LHL)+84\times WRa(LMH)-79\times WRa(LML)+55\times WRa(LLH)-17\times WRa(LLL)>0 \quad (i)$$

where a center-line average roughness (WRa) of each of the frequency components is a center-line average roughness based on one-dimensional data arrays, which is obtained by a procedure in which shapes of concaves and convexes in a surface of the electrophotographic photoconductor are measured by a surface roughness/profile measuring device to obtain one-dimensional data arrays, and the one-dimensional data arrays are subjected to the multiresolution analyses (MRA-1) and (MRA-2) so as to be separated into different frequency components ranging from a highest frequency component to a lowest frequency component; and HML, HLH, LHL, LMH, LML, LLH, and LLL each represent an individual frequency band obtained when the one-dimensional data arrays are separated into frequency components having one concave-convex cycle length of from 4 μm to 25 μm, from 10 μm to 50 μm, from 53 μm to 183 μm, from 106 μm to 318 μm, from 214 μm to 551 μm, from 431 μm to 954 μm, and from 867 μm to 1,654 μm, in this order.

<2> The electrophotographic photoconductor according to <1>, wherein the crosslinked resin surface layer contains at least a crosslinked product of a curable charge transporting material represented by the following General Formula (1) in an amount equal to or more than 5% by mass and less than 60% by mass, General Formula (1)

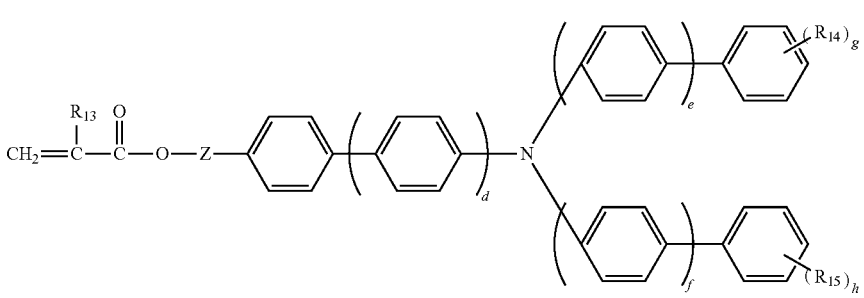

where d, e and f each represent an integer of zero or 1, $R_{13}$ represents a hydrogen atom or a methyl group; $R_{14}$ and $R_{15}$ each represent an alkyl group having 1 to 6 carbon atoms, which is a substituent other than hydrogen atom, and in the case where $R_{14}$ and $R_{15}$ are present in plural number, each may be different; g and h each represent an integer of zero to 3; and Z represents any one of a single bond, a methylene group, an ethylene group and a divalent group represented by one of the following formulae:

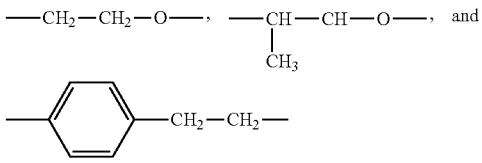

<3> The electrophotographic photoconductor according to one of <1> and <2>, wherein the crosslinked resin surface layer contains a crosslinked product of trimethylolpropane triacrylate in an amount equal to or more than 10% by mass and less than 50% by mass.

<4> The electrophotographic photoconductor according to any one of <1> to <3>, wherein the crosslinked resin surface layer is a layer which is cured after an uncured wet film immediately after coating with a crosslinked-resin-surface-layer coating liquid is sprayed with water.

<5> The electrophotographic photoconductor according to any one of <1> to <3>, wherein the crosslinked resin surface layer is formed with a crosslinked-resin-surface-layer coating liquid containing water in an amount of 5% by mass to 15% by mass with respect to the mass of the crosslinked-resin-surface-layer coating liquid.

<6> A method for producing an electrophotographic photoconductor having a photosensitive layer and a crosslinked resin surface layer over a support, wherein shapes of concaves and convexes in a surface of the electrophotographic photoconductor are measured by a surface roughness/profile measuring device to obtain one-dimensional data arrays, the one-dimensional data arrays are subjected to a multiresolution analysis (MRA-1) through wavelet transformation so as to be separated into six frequency components including a highest frequency component (HHH), a second highest frequency component (HHL), a third highest frequency component (HMH), a fourth highest frequency component (HML), a fifth highest frequency component (HLH) and a lowest frequency component (HLL), the one-dimensional data arrays of the lowest frequency component (HHL) thus obtained are thinned out so that the number of data arrays is reduced to 1/10 to 1/100 thereof to thereby produce one-dimensional data arrays, the one-dimensional data arrays thus produced are subjected to a multiresolution analysis (MRA-2) through wavelet transformation so as to be separated into six frequency components including a highest frequency component (LHH), a second highest frequency component (LHL), a third highest frequency component (LMH), a fourth highest frequency component (LML), a fifth highest frequency component (LLH) and a lowest frequency component (LLL) to thereby obtain 12 frequency components in total; and a center-line average roughness (WRa) of each of the 12 frequency components satisfies a relationship (i) below, $$1-597\times WRa(HML)+238\times WRa(HLH)-95\times WRa(LHL)+84\times WRa(LMH)-79\times WRa(LML)+55\times WRa(LLH)-17\times WRa(LLL)>0 \quad (i)$$

where a center-line average roughness (WRa) of each of the frequency components is a center-line average roughness based on one-dimensional data arrays, which is obtained by a procedure in which shapes of concaves and convexes in a surface of the electrophotographic photoconductor are measured by a surface roughness/profile measuring device to obtain one-dimensional data arrays, and the one-dimensional data arrays are subjected to the multiresolution analyses (MRA-1) and (MRA-2) so as to be separated into different frequency components ranging from a highest frequency component to a lowest frequency component; and HML, HLH, LHL, LMH, LML, LLH, and LLL each represent an individual frequency band obtained when the one-dimensional data arrays are separated into frequency components having one concave-convex cycle length of from 4 μm to 25 μm, from 10 μm to 50 μm, from 53 μm to 183 μm, from 106 μm to 318 μm, from 214 μm to 551 μm, from 431 μm to 954 μm, and from 867 μm to 1,654 μm, in this order.

<7> An image forming apparatus including:

the electrophotographic photoconductor according to any one of <1> to <5>, a solid-lubricant applying unit which scrapes a solid lubricant with a brush roller and applies the scraped solid lubricant onto the electrophotographic photoconductor, and a coating blade for spreading the solid lubricant over a surface of the electrophotographic photoconductor.

<8> The image forming apparatus according to <7>, wherein in the electrophotographic photoconductor, at least frequency components other than HLL have a WRa of 0.06 μm or greater, and a frequency band of each of the frequency components is higher than that of LLL, and when the frequency band of the frequency components in the electrophotographic photoconductor is plotted against a logarithmic value of each of the WRa values on a two-dimensional graph to obtain a relationship therebetween, an inflection point or a local maximum point is present in the frequency band of any one of LLH, LMH, and LML, and wherein the electrophotographic photoconductor satisfies a linear velocity requirement that 250 to 1,000 concaves and convexes in the surface of the photoconductor pass the coating blade per second.

<9> The image forming apparatus according to one of <7> and <8>, wherein a polymerized toner is used to develop an image.

<10> The image forming apparatus according to one of <7> and <8>, further including at least two developing units, wherein the image forming apparatus employs a tandem system, and a polymerized toner is used to develop an image.

<11> A process cartridge including:

the electrophotographic photoconductor according to any one of <1> to <5>, a solid-lubricant applying unit which scrapes a solid lubricant with a brush roller and applies the scraped solid lubricant onto the electrophotographic photoconductor, and a coating blade for spreading the solid lubricant over a surface of the electrophotographic photoconductor.

<12> The process cartridge according to <11>, wherein in the electrophotographic photoconductor, at least frequency components other than HLL have a WRa of 0.06 μm or greater, and a frequency band of each of the frequency components is higher than that of LLL, and when the frequency band of the frequency components in the electrophotographic photoconductor is plotted against a logarithmic value of each of the WRa values on a two-dimensional graph to obtain a relationship therebetween, an inflection point or a local maximum point is present in the frequency band of any one of LLH, LMH, and LML, and wherein the electrophotographic photoconductor satisfies a linear velocity requirement that 250 to 1,000 concaves and convexes in the surface of the photoconductor pass the coating blade per second.

An electrophotographic photoconductor according to the present invention is excellent in the acceptability of solid lubricant on the surface thereof and can be coated with solid lubricant with excellent sensitivity, and thus an image forming apparatus using the electrophotographic photoconductor of the present invention has high practical use value, because high abrasion resistance and excellent cleanability to polymerized toner can be exhibited.

DESCRIPTION OF EMBODIMENTS (Electrophotographic Photoconductor)

An electrophotographic photoconductor according to the present invention includes a support, a photosensitive layer and a crosslinked resin surface layer over the support and further includes other layers as required.

In order to solve the above problems, the present inventors examined a coating mechanism for coating a surface of a photoconductor with a solid lubricant in an electrophotographic process, worked out requirements for an electrophotographic photoconductor meeting the coating process, and further designed units necessary for the achievement. The following describes the above mentioned matters in this order.

Firstly, the coating mechanism for coating a surface of a photoconductor with a solid lubricant in an electrophotographic process will be described.

A lubricant is supplied, in the form of a powder, onto a photoconductor in small amounts. As a specific method thereof, there is a coating method as disclosed in Japanese Patent Application Laid-Open (JP-A) No. 2000-162881, in which a solid lubricant is scraped in block by an applying unit such as a brush and the scraped lubricant is supplied onto a photoconductor. The method is considered to be advantageous in that the structure of a coating device is simple and a lubricant is easily supplied to the entire surface of photoconductor.

Figure 11:
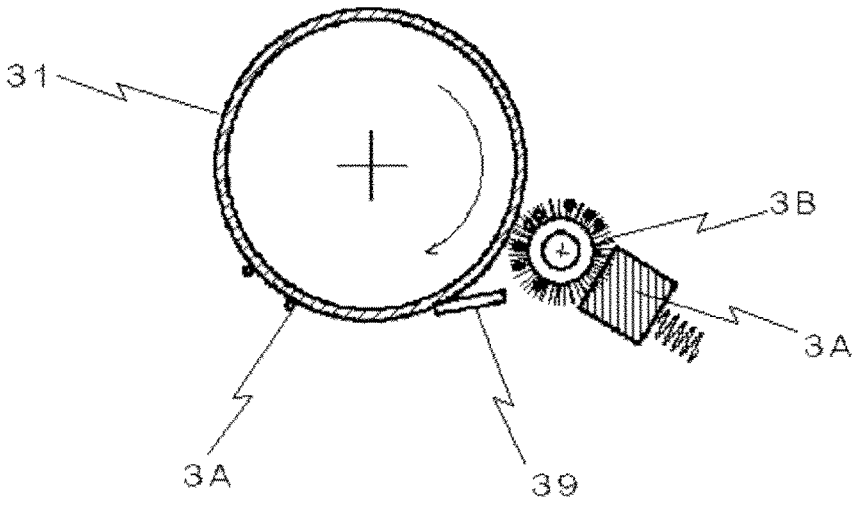
FIG. 11 is another cross-sectional diagram schematically illustrating a unit for supplying a photoconductor with a solid lubricant.

FIG. 11 is an example of the construction of a lubricant supplying device. The lubricant supplying device is adapted to apply a solid lubricant 3A onto a photoconductor 31 via a coating brush 3B such as a rotatable fur brush. The coating brush 3B rotates in contact with the solid lubricant 3A to scrape a part of the solid lubricant 3A. The scraped solid lubricant 3A is attached to a coating blade 39 and applied onto the photoconductor 31 while being rotated. The solid lubricant 3A applied to the photoconductor 31 is spread over a surface of the photoconductor 31 by the coating blade 39. When the solid lubricant is applied to a surface of a photoconductor via a brush or the like, the photoconductor surface is coated with the lubricant in the form of a powder. If the applied lubricant remains as it is, the lubricating property is not sufficiently exhibited. Here, it is important to spread the applied lubricant over a surface of the photoconductor. Through this step, the solid lubricant is film-formed on the photoconductor surface, whereby the lubricating property is exhibited.

The solid lubricant 3A is typically composed of a higher fatty acid metal salt such as zinc stearate. Zinc stearate is a lamella crystal powder A high fatty acid metal such as zinc stearate, which is a typical example, can be used as the solid lubricant 3A. Zinc stearate is a typical example of a lamella-crystal powder and such a material is suitable to be used as a lubricant. Lamella crystals have a layered structure in which amphipathic molecules are self-organized and when shearing force is applied, the crystals break along a boundary between the layers and become slippery. This behavior is effective for lowering the coefficient of friction. Thus, it is a peculiarity of the lamella crystals to cover uniformly the surface of the photoconductor when the shearing force is applied. This peculiarity enables the surface of the photoconductor to be covered effectively by a small amount of the lubricant.

When a lubricant is applied onto a photoconductor surface by such a method, there are a variety of methods for controlling the coated state of the lubricant. There are considered, for example, a method of increasing a contact pressure between a solid lubricant and a coating brush, and a method of controlling the rotational speed of a coating brush. There is also an attempt to control the number of revolutions of a coating brush according to image forming information.

Next, the preset inventors examined the requirements for an electrophotographic photoconductor meeting the coating process of a solid lubricant.

In such a coating mechanism for coating a surface of a photoconductor with a solid lubricant, the electrophotographic photoconductor is required to be highly sensitively coated with the solid lubricant when the solid lubricant is attached thereto. It is considered that at least the adhesion between the photoconductor 31 and the solid lubricant and the easiness of film formation of the solid lubricant 3A by the coating blade 39 affect the sensitivity of attachment or adhesion of the solid lubricant.

The adhesion between two objects is described, for example, in "KONICA MINOLTA TECHNOLOGY REPORT Vol. 1, pp. 19-22, 2004 edited by Yukiko Mizuguchi and Kento Miyamoto". The adhesion is considered to be influenced by non-electrostatic attraction force, electrostatic attraction force and a contact area between two objects. The electrostatic attraction force is considered to be effected by contact-potential difference. The non-electrostatic attraction force is considered to be effected depending on a surface energy such as easy wettability.

Intrinsically, a solid lubricant is weak in adhesion, and even when various surface modifiers are incorporated into a photoconductor surface, the adhesion therebetween was unable to change greatly. Then, the present inventors examined, as another factor p, the effect of providing a rough surface on a photoconductor, which is conceived from a contact area therebetween.

Figure 12:
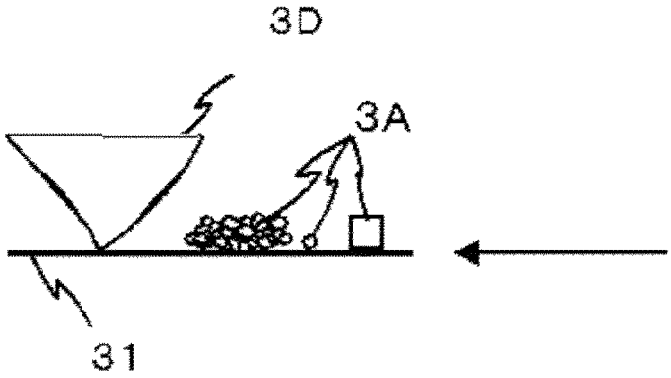
FIG. 12 is a schematic diagram illustrating a state where a solid lubricant is attached onto a photoconductor.
Figure 13:
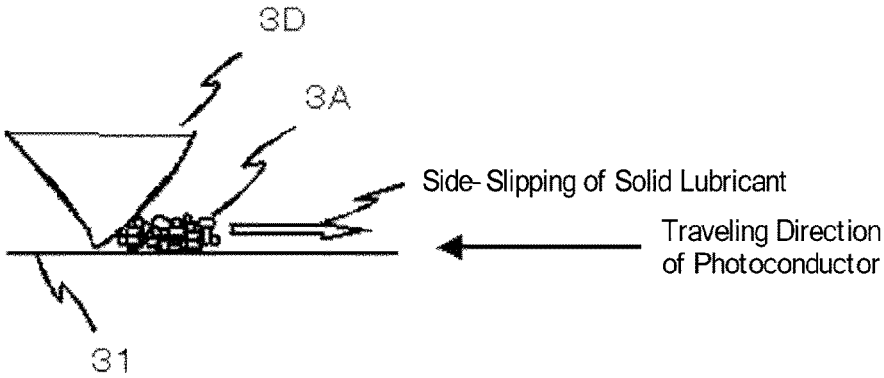
FIG. 13 is an exemplary diagram illustrating a state where the coatability of solid lubricant on the surface of a photoconductor is poor.
Figure 14:
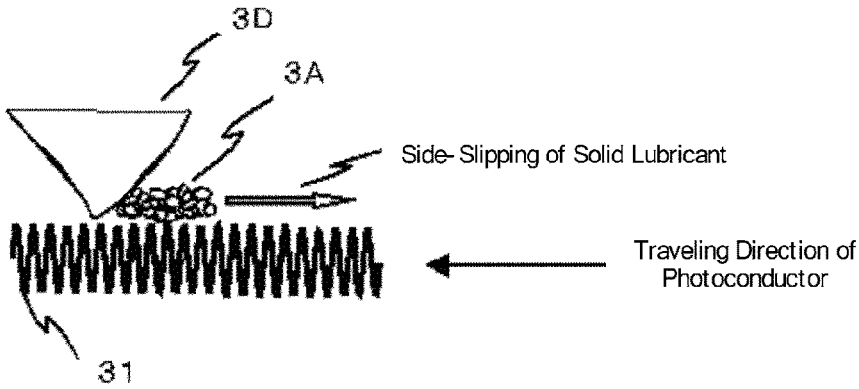
FIG. 14 is another exemplary diagram illustrating a state where the coatability of solid lubricant on the surface of a photoconductor is poor.

FIG. 12 is an example of influence of a surface configuration of a photoconductor contrived by the present inventors. FIG. 12 illustrates a state where a solid lubricant 3A in the form of a powder, which is scraped by a coating brush, adheres to a surface of a photoconductor 31 as an aggregate or one solid substance. When the surface of the photoconductor is smooth as illustrated in FIG. 13, it is anticipated that the solid lubricant 3A is unable to pass the edge of coating blade 3D, slips sideways on the surface of the photoconductor 31, and then detaches from the surface of the photoconductor 31. By contrast, when rugged concaves and convexes are present in the surface of a photoconductor 31 as illustrated in FIG. 14, a solid lubricant 3A is point-contacted with the photoconductor 31. The solid lubricant 3A in this case is also anticipated to easily detach from the surface of the photoconductor 31.

Figure 15:
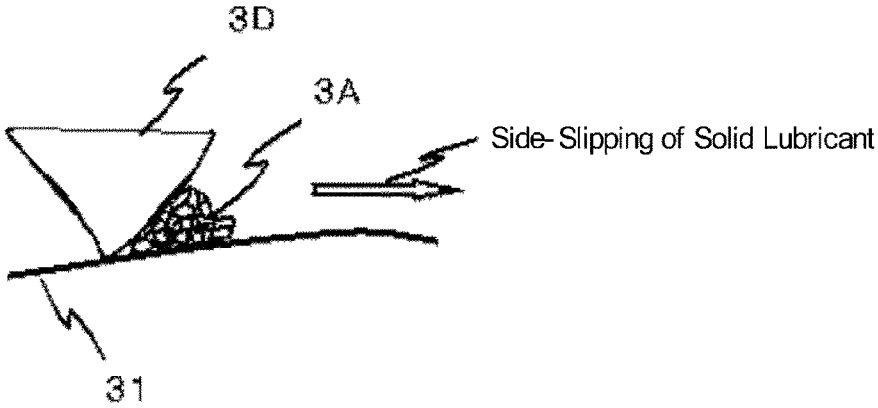
FIG. 15 is still another exemplary diagram illustrating a state where the coatability of solid lubricant on the surface of a photoconductor is poor.
Figure 16:
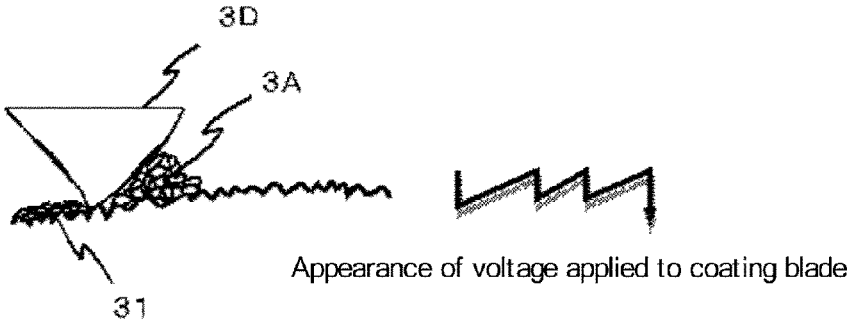
FIG. 16 is a schematic diagram illustrating a state where concaves and convexes formed of low frequency components in the surface of a photoconductor make the linear pressure of a coating blade fluctuate.

It is anticipated that an aggregate of a solid lubricant 3A is point-contacted with a photoconductor 31 at the edges of concaves and convexes as illustrated in FIG. 15, and consequently, the solid lubricant 3A easily detaches from the photoconductor surface, unless the concaves and convexes in the surface of the photoconductor 31 are provided at a regular cycle, although it is possible to prevent the solid lubricant from slipping sideways. Then, the present inventors contemplated that the adhesion of a solid lubricant can be increased by allowing a coating blade 3A to slip through and press the solid lubricant 3A while properly increasing and decreasing its linear pressure so as to spread the solid lubricant 3A over the surface of the photoconductor 31 and provide moderate concaves and convexes in the surface of the photoconductor 31 as illustrated in FIG. 16, and by further making the concaves and convexes to have moderately high frequency so as to prevent the solid lubricant 3A from slipping sideways on the photoconductor surface.

Even when an evaluation on a rough-surface configuration provided on a photoconductor is made by measuring a center line surface roughness (arithmetic average roughness) Ra and a roughness curve average length RSm using a conventional surface roughness/profile measuring device, the measured results are only broadly classified, as mentioned above. Then, the present inventors verified that formation of a rough surface on a photoconductor can be controlled by producing a photoconductor which can meet the requirements in multi-resolution analysis where a one-dimensional data array of a cross-sectional curve of the photoconductor surface is analyzed through wavelet transformation.

The following describes the multiresolution analysis on the cross-sectional curve of the photoconductor surface.

In the present invention, as to the state of a surface of an electrophotographic apparatus component, a cross-sectional curve specified in JIS B0601 is determined, and then a one-dimensional data array of the cross-sectional curve is obtained.

The one-dimensional data array of the cross-sectional curve may be obtained as a digital signal through the use of a surface roughness/profile measuring device or by A/D conversion from an analogue output signal obtained.

In the present invention, the measurement length is preferably a measurement length that is determined by the method specified in Japanese Industrial Standards (JIS), ranging from 8 mm to 25 mm.

The sampling spacing is preferably 1 μm or smaller, more preferably 0.2 μm to 0.5 μm. For example, when a rough surface is measured with a measurement length of 12 mm and 30,720 sampling points, the sampling spacing is 0.390625 μm, which is suitable for examining the effects of the present invention.

As described above, the one-dimensional data array is subjected to a multiresolution analysis (MRA-1) through wavelet transformation so as to be separated into a plurality of different frequency components ranging from a highest frequency component (HHH) to a lowest frequency component (HLL) (e.g. six frequency components of (HHH), (HHL), (HMH), (HML), (HLH) and (HLL)), the lowest frequency component (HLL) obtained here is thinned out to produce a one-dimensional data array, the one-dimensional data array is further subjected to a multiresolution analysis (MRA-2) through wavelet transformation so as to be separated into a plurality of different frequency components ranging from a highest frequency component to a lowest frequency component (e.g. six frequency components of (LHH), (LHL)(LMH)(LML)(LLH) and (LLL)). Each of the frequency components obtained is subjected to measurement of a center-line average roughness (WRa). In the present invention, the center-line average roughness is called "WRa" in order to be distinguished from a common Ra. In the present invention, it is contrived that the center-line average roughness (WRa) satisfies the following relationship (i).

$$1-597\times WRa(HML)+238\times WRa(HLH)-95\times WRa(LHL)+84\times WRa(LMH)-79\times WRa(LML)+55\times WRa(LLH)-17\times WRa(LLL)>0 \quad (i)$$

Here, the center-line average roughness (WRa) is a center line average roughness based on one-dimensional data arrays, which is obtained by a procedure in which shapes of concaves and convexes in a surface of the electrophotographic photoconductor are measured by a surface roughness/profile measuring device to obtain one-dimensional data arrays, and the one-dimensional data arrays are subjected to the multiresolution analyses (MRA-1) and (MRA-2) so as to be separated into different frequency components ranging from a highest frequency component to a lowest frequency component. HML, HLH, LHL, LMH, LML, LLH, and LLL each represent an individual frequency band when the one-dimensional data array is separated into frequency components when one cycle length of a concave-convex shape (one concave-convex cycle length) is, in this order, from 4 μm to 25 μm, from 10 μm to 50 μm, from 53 μm to 183 μm, from 106 μm to 318 μm, from 214 μm to 551 μm, from 431 μm to 954 μm, and from 867 μm to 1,654 μm.

In the relationship (i), the "plus" symbol (+) provided to odd-numbered high frequency items of LLH, LMH and HLH and the "minus" symbol (−) provided to even-numbered high frequency items of LL, LML and HML do not mean much, and only mean coefficients obtained in a multivariate data analysis. In the present invention, from a multivariate data analysis on the Ra in the individual frequency band and the data of adhesion of the solid lubricant to the photoconductor, a rate of contribution of Ra to the adhesion is determined.

(1) Definition of Frequency Band

Here, data array of arithmetic average roughness (Ra) values of an electrophotographic photoconductor defined by JIS-B0601:2001 are separated into a plurality of different frequency components based on one concave-convex cycle length, through wavelet transformation, and arithmetic average roughness values in individual bands of the separated frequency components are designated as follows:

WRa (HHH): Ra in a frequency band at the time of one concave-convex cycle length ranging from 0 μm to 3 μm WRa (HHL): Ra in a frequency band at the time of one concave-convex cycle length ranging from 6 μm to 1 μm WRa (HMH): Ra in a frequency band at the time of one concave-convex cycle length ranging from 2 μm to 13 μm WRa (HML): Ra in a frequency band at the time of one concave-convex cycle length ranging from 4 μm to 25 μm WRa (HLH): Ra in a frequency band at the time of one concave-convex cycle length ranging from 10 μm to 50 μm WRa (HLL): Ra in a frequency band at the time of one concave-convex cycle length ranging from 24 μm to 99 μm WRa (LHH): Ra in a frequency band at the time of one concave-convex cycle length ranging from 26 μm 106 μm WRa (LHL): Ra in a frequency band at the time of one concave-convex cycle length ranging from 53 μm to 183 μm WRa (LMH): Ra in a frequency band at the time of one concave-convex cycle length ranging from 106 μm to 318 μm WRa (LML): Ra in a frequency band at the time of one concave-convex cycle length ranging from 214 μm to 551 μm WRa (LLH): Ra in a frequency band at the time of one concave-convex cycle length ranging from 431 μm to 954 μm WRa (LLL): Ra in a frequency band at the time of one concave-convex cycle length ranging from 867 μm to 1654 μm Each of the frequency bands is multiplied by a numerical value of 17, 55, 79, 84, 95, 238, or 597. The numerical value, i.e., coefficient for each of the frequency bands of "17, 55, 79, 84, 95, 238, and 597" are obtained as an optimum value in experimental tests in the present invention. Thus, if the coefficients are changed, the correlation between the adhesion of the solid lubricant and the surface roughness of the photoconductor is decreased. In the relationship (i), HML, HLH, LHL, LMH, LML, LLH, and LLL each represent an individual frequency band obtained when the one-dimensional data arrays are separated into frequency components having one concave-convex cycle length of from 4 μm to 25 μm, from 10 μm to 50 μm, from 53 μm to 183 μm, from 106 μm to 318 μm, from 214 μm to 551 μm, from 431 μm to 954 μm, and from 867 μm to 1,654 μm, in this order. In the present invention, in the actual wavelet transformation analyses, numerical analysis software called MATLAB was used. As to the definition of band width, the range defined in the restriction imposed by the software does not mean much. For this reason, a coefficient varies according to change in band width. In the present invention, when a multivariate data analysis is performed using the (Harr) function as a mother wavelet function so as to separate data from high frequency components to low frequency components, the number of separated frequency components is 6. Also, in the present invention, data arrays are thinned out or reduced to 1/40.

The frequency bands between the HML component and HLH component, between the LHL component and LMH component, between the LMH component and LML component, between LML component and LLH component, and between the LLH component and LLL component are overlapped to each other. The reason of the overlapping is as follows. In wavelet transformation, an original signal is decomposed into (Low-pass Components) and H (High-pass Components) at a first time wavelet transformation (Level 1), and further the L (Low-pass Components) are subjected to wavelet transformation so as to be decomposed into LL and HL.

Here, when a frequency component f contained in the original signal is in good agreement with a frequency F separated, the frequency component f is present just at the boundary of separation, and thus separated into both of the L and H after separation. This phenomenon is inevitable in multiresolution analyses. Then, it is important to set frequencies contained in the original signal so as to avoid the frequency bands intended to be observed be separated in the course of wavelet transformation process. It is also helpful to perform reverse wavelet transformation at an arbitral level, after performing wavelet transformation at several levels, so that signals separated into a plurality of frequency bands are decoded (restored).

<Symbol of Each Frequency Wave in Wavelet Transformation (Multiresolution Analysis)>

In the present invention, wavelet transformations were performed two times, the initial wavelet transformation is called the first time wavelet transformation (otherwise abbreviated to MRA-1 for convenience), and the subsequent wavelet transformation is called the second time wavelet transformation (otherwise abbreviated to MRA-2 for convenience). To distinguish the first transformation from the second transformation, H (first transformation) and L (second transformation) are provided as a prefix to respective frequency bands.

Here, as a mother wavelet function for use in the first and the second time wavelet transformations, various functions can be used, for example, it is possible to use (Dubecies) function, (Haar) function, (Meyer) function, (Symlet) function, and (Coiflet) function and the like.

When a multiresolution analysis is carried out for separation data into a plurality of frequency components of high frequency components to low frequency components, the number of frequency components is 4 or more, preferably 8 or lower, and more preferably 6.

In the present invention, the first time wavelet transformation is performed to separate data into a plurality of frequency components, the low frequency component obtained in the separation is thinned out for sampling, so that one-dimensional data arrays to which data of the lowest frequency component is reflected is produced. The one-dimensional data array is subjected to a multiresolution analysis through the second time wavelet transformation in which data is separated into a plurality of frequency components including high frequency components to low frequency components.

Here, is characterized in that when the lowest frequency component (HLL) obtained in the result of the first time wavelet transformation (MRA-1) is thinned out, the number of data arrays is reduced to 1/10 to 1/100 of the number of the initial data arrays.

Thinning out the data arrays is effective to increase the frequency of data (scale width of logarithmic value in the horizontal axis is broadened). For example, when the number of one-dimensional data arrays obtained in the first time wavelet transformation is 30,000, the number of data arrays is reduced to 3,000 by thinning out the data arrays at 1/10.

In this case, when the number of the data arrays thinned out or reduced is smaller than 1/10, for example, 1/5, the effect of increasing the frequency is small, and even if the data arrays are subjected to a multiresolution analysis through the second time wavelet transformation, the data arrays are not satisfactorily separated.

When the number of the data arrays thinned out or reduced is greater than 1/100, for example, 1/200, the frequency of the data is exceedingly increased, and even if the data arrays are subjected to a multiresolution analysis through the second time wavelet transformation, the data concentrates to high frequency components and are not satisfactorily separated.

Figure 17:
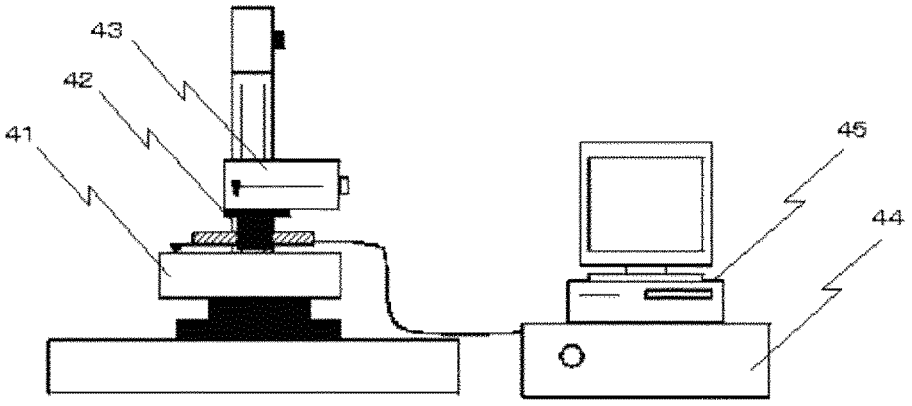
FIG. 17 is a configuration diagram of a surface roughness/profile measurement system.

FIG. 17 is a diagram schematically illustrating a configuration example of an evaluation system which is applied to the present invention for evaluating the surface roughness of an electrophotographic photoconductor. In FIG. 17, reference numeral 41 denotes an electrophotographic photoconductor, reference numeral 42 denotes a jig to which a probe for measuring surface roughness is attached, reference numeral 43 denotes a mechanism for moving the jig 42 along a measurement object, reference numeral 44 denotes a surface roughness/profile measuring device, reference numeral 45 は denotes a personal computer for analyzing signal. In FIG. 17, the calculation of the above-mentioned multiresolution analyses is performed by the personal computer 45. When an electrophotographic photoconductor has a cylindrical shape, the surface roughness of the electrophotographic photoconductor can be measured in a suitable direction, i.e., in a circumferential direction, and in a longitudinal direction.

FIG. 17 is provided to illustrate one example, and the evaluation system may take other configurations. For instance, the multiresolution analyses may be carried out by a numerical calculation processor for exclusive use, without using a personal computer. Also, the processing may be carried out using a surface roughness/profile measuring device. There are many methods used for displaying evaluation results. The results may be displayed on a CRT, a liquid crystal display, or print output. In addition, the results may be transmitted as an electric signal to another device, or may be stored in a USB memory or MO disk.

In the measurement, the present inventors used SURFCOM 1400D manufactured by Tokyo Seimitsu Co., Ltd. as a surface roughness/profile measuring device, as a personal computer manufactured by IBM. Then, SURFCOM 1400D was connected to the IBM personal computer via RS-232-C cable. Data processing of surface roughness transmitted from SURFCOM 1400D to the personal computer and calculation of multiresolution analyses were carried out using software programmed in C language by the present inventors.

Next, the procedure of multiresolution analysis on the surface configuration of photoconductor will be described with reference to specific examples.

First, the surface configuration of an electrophotographic photoconductor was measured using SURFCOM 1400D manufactured by Tokyo Seimitsu Co., Ltd.

Here, the measurement length for surface roughness in the first time was 12 mm, and the number of total sampling points was 30,720.

In the one-time measurement, the surface of an electrophotographic photoconductor was measured at four spots. The measured results were entered into the personal computer, followed by the first time wavelet transformation, thinning-out process for reducing low frequency components obtained in the first time wavelet transformation to 1/40, and the second time wavelet transformation.

With respect to the results of the first time and the second time multiresolution analyses thus obtained, a center-line average roughness Ra, a maximum height Rmax and a 10-point-average roughness Rz were calculated. Some examples of the calculation results are shown in 18A to 18D.

Figure 18A:
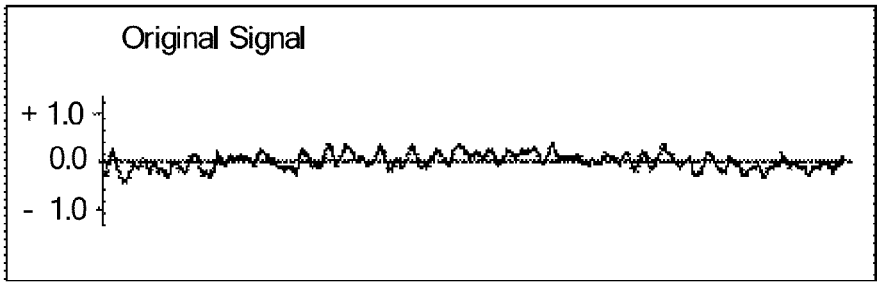
FIG. 18A is a diagram exemplarily showing a result of multiresolution analysis using wavelet transformation.

In FIGS. 18A to 18D, the graph illustrated in FIG. 18A is original data obtained by measurement with SURFCOM 1400D, this may be referred to as "roughness curve" or "cross-sectional curve".

There are 14 graphs in FIGS. 18A to 18D, where the vertical axis represents displacement of a surface configuration (unit: μm); the horizontal axis represents a length, and the measurement length is 12 mm, although no scale is provided. In conventional measurements of surface roughness, a center-line average roughness Ra, a maximum height Rmax and a 10-point-average roughness Rz have been found from only the data.

Figure 18B:
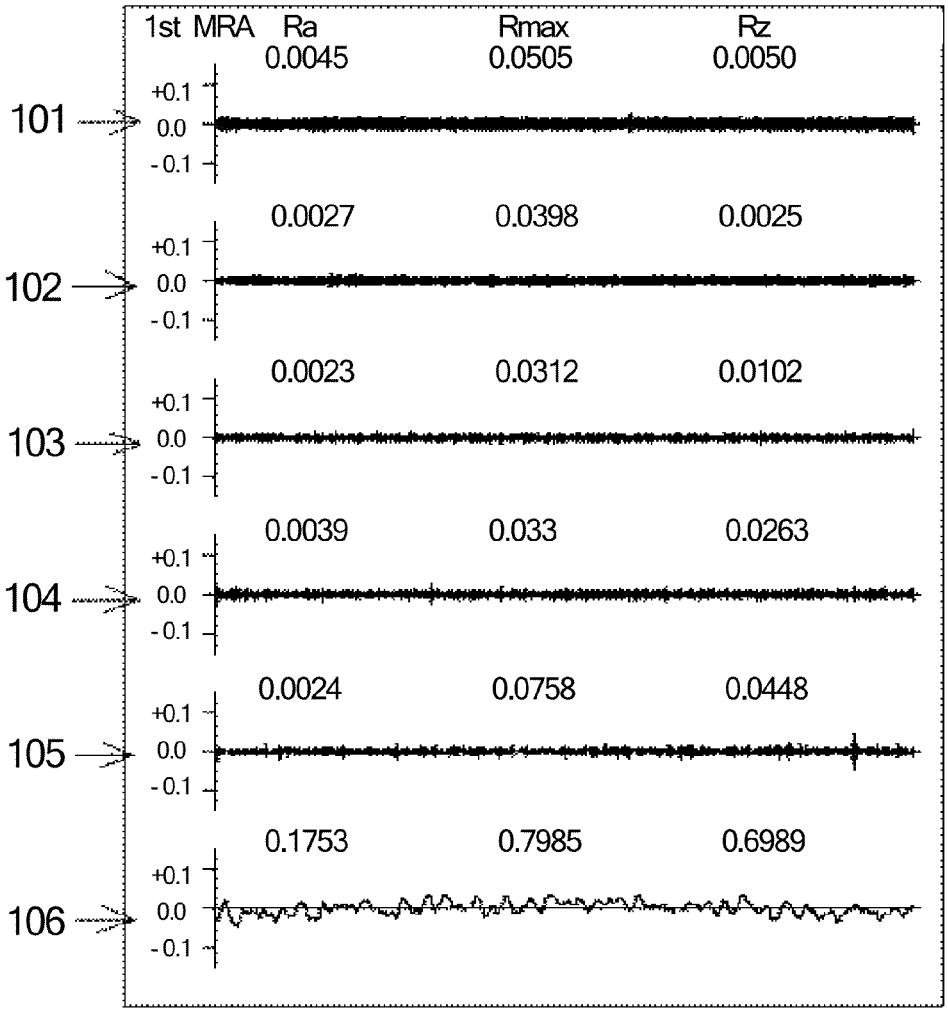
FIG. 18B is another diagram exemplarily showing a result of multiresolution analysis using wavelet transformation.

Also, six graphs illustrated in FIG. 18B are results of the first time multiresolution analysis (MRA-1), in which the graph positioned uppermost is a graph for a highest frequency component (HHH), and the graph positioned lowermost is a graph for a lowest frequency component (HLL).

Here, in FIG. 18B, Graph (101) placed uppermost is the highest frequency component in the first time multiresolution analysis result, which is called "HHH" in the present invention.

Graph (102) is a frequency component whose level being one-level lower than that of the highest frequency component in the first time multiresolution analysis result, which is called "HHL" in the present invention.

Graph (103) is a frequency component whose level being two-level lower than that of the highest frequency component in the first time multiresolution analysis result, which is called "HMH" in the present invention.

Graph (104) is a frequency component whose level being three-level lower than that of the highest frequency component in the first time multiresolution analysis result, which is called "HML" in the present invention.

Graph (105) is a frequency component whose level being four-level lower than that of the highest frequency component in the first time multiresolution analysis result, which is called "HLH" in the present invention.

Graph (106) is the lowest frequency component in the first time multiresolution analysis result, which is called "HLL" in the present invention.

Figure 19:
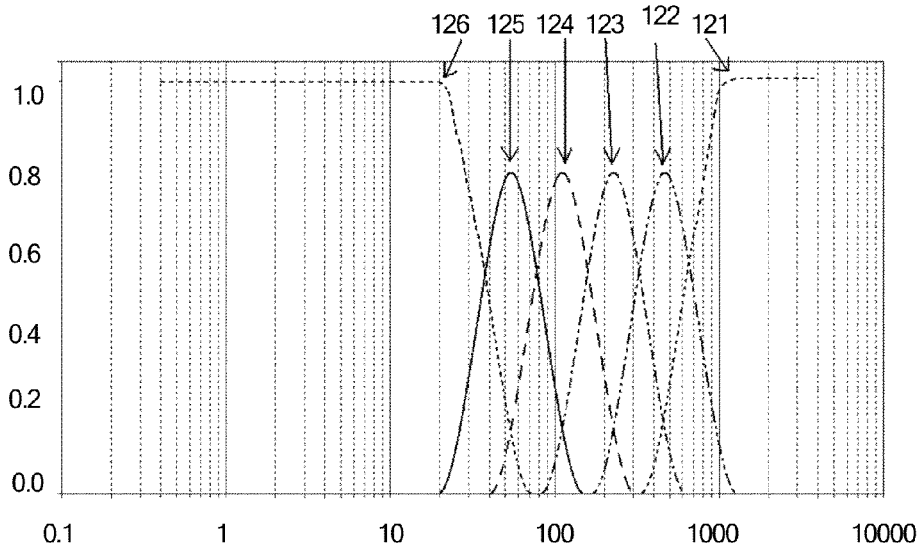
FIG. 19 is a diagram illustrating separation of frequency bands in the first time multiresolution analysis.

In the present invention, the graph in FIG. 18A is separated into six graphs in FIG. 18B according to the frequencies, and a state of the separation of frequencies is illustrated in FIG. 19.

In FIG. 19, the horizontal axis is the number of concaves and convexes being present in a length of 1 mm when the shape of the concaves and convexes are a sine wave. The vertical axis represents a ratio when the frequencies are separated in each frequency band.

In FIG. 19, (121) is a frequency band (HHH) of the highest frequency component in the first time multiresolution analysis (MRA-1), (122) is a frequency band (HHL) of frequency component whose level being one-level lower than that of the highest frequency component in the first time multiresolution analysis, (123) is a frequency band (HMH) of frequency component whose level being two-level lower than that of the highest frequency component in the first time multiresolution analysis, (124) is a frequency band (HML) of frequency component whose level being three-level lower than that of the highest frequency component in the first time multiresolution analysis, (125) is a frequency band (HLH) of frequency component whose level being four-level lower than that of the highest frequency component in the first time multiresolution analysis, and (126) is a frequency band (HLL) of the lowest frequency component in the first time multiresolution analysis.

More specifically, FIG. 19 illustrates that when the number of concaves and convexes per length of 1 mm is 20 or smaller, all the concaves and convexes appears in Graph (126). For example when the number of concaves and convexes per length of 1 mm is 110, the concaves and convexes appear most significantly in Graph (124), and in FIG. 19B, they appear in the frequency band of HML. When the number of concaves and convexes per length of 1 mm is 220, the concaves and convexes appear most significantly in Graph (123), and in FIG. 18B, they appear in the frequency band of HMH. In addition, when the number of concaves and convexes per length of 1 mm is 310, the concaves and convexes appear most significantly in Graphs (122) and (123), and in FIG. 18B, they appear in both of the frequency bands of HHL and HMH. Therefore, the frequency of surface roughness determines where signals appear in the six graphs of FIG. 18B. In other words, minute surface roughness appears in the upper side of the graph in FIG. 18B, and a large roughness curve appears in the lower side of the graph in FIG. 18B.

In the present invention, surface roughness is separated by the frequency thereof, which is graphed as FIG. 18B. A surface roughness in respective frequency bands is determined from graphs on a frequency band basis. Here, in order to examine the surface roughness, a center-line average roughness Ra, a maximum height Rmax and a 10-point-average roughness Rz can be calculated.

In this way, in FIG. 18B, the center-line average roughness Ra, the maximum height Rmax and the 10-point-average roughness Rz are represented in each of the graphs.

In the present invention, data arrays obtained in measurement with a surface roughness/profile measuring device is separated into a plurality of data arrays according to the frequencies, and thus the variation in concave-convex shape in each frequency band can be measured.

In the present invention, the lowest frequency among data arrays that have been separated according to the frequencies as illustrated in FIG. 18B, i.e., data arrays of HLL are thinned out.

In the present invention, the procedure for thinning out the number of data arrays, i.e., how many data arrays should be reduced can be determined by performing experiments. By selecting the optimum number of reduced data arrays, it is possible to optimize the separation of frequency bands in the multiresolution analysis illustrated in FIG. 19 and to make a desired frequency positioned at a center of the frequency band thereof.

In FIG. 18A to FIG. 18D, 40 data arrays to 1 (one) data array are thinned out.

Figure 20:
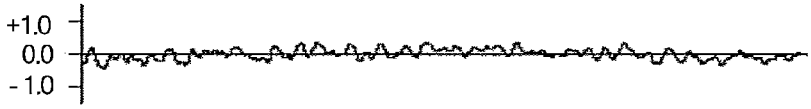
FIG. 20 is a graph of the lowest frequency data in the first time multiresolution analysis.

The result of thinning-out process of the data arrays is illustrated in FIG. 20. In FIG. 20, the vertical axis represents concaves and convexes in a surface of photoconductor (in unit of micrometer). No scale is provided to the horizontal axis, but the length is 12 mm.

In the present invention, the data in FIG. 20 is further subjected to a multiresolution analysis. That is, the second time multiresolution analysis (MRA-2) was performed.

Figure 18C:
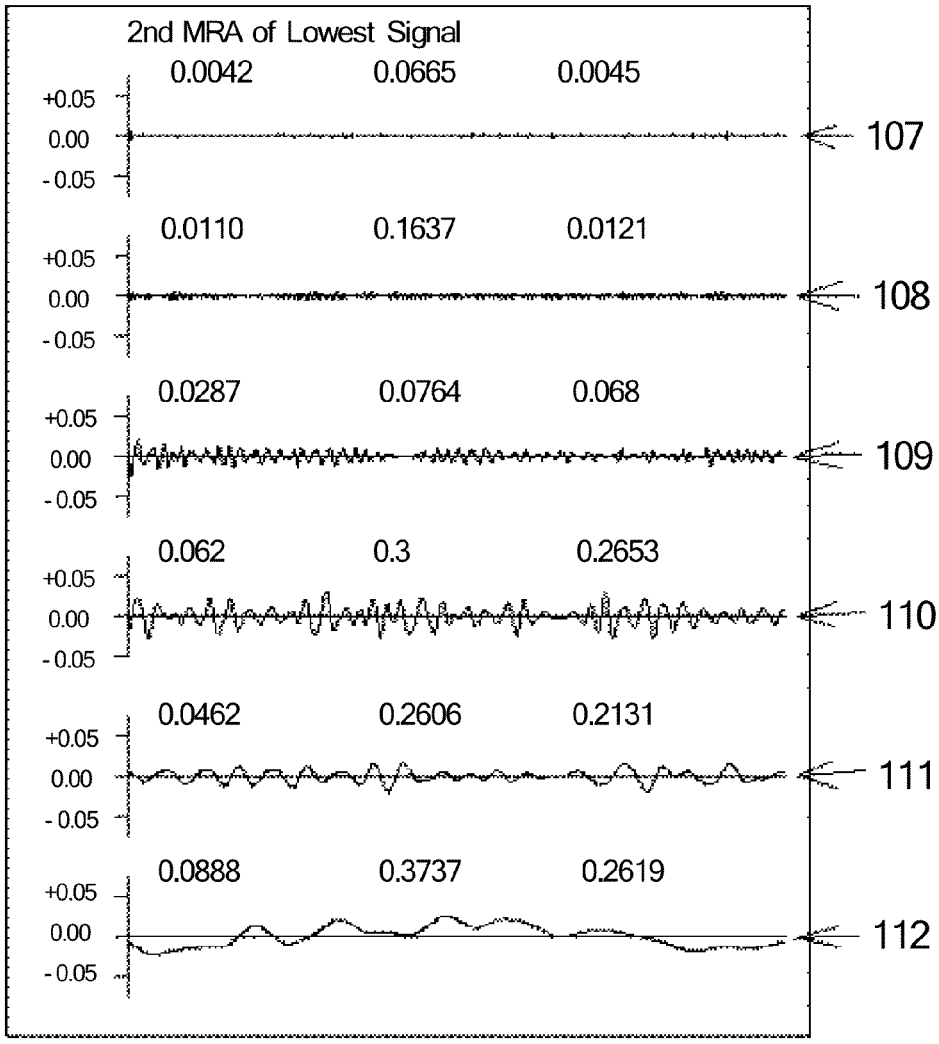
FIG. 18C is still another diagram exemplarily showing a result of multiresolution analysis using wavelet transformation.
Figure 18D:
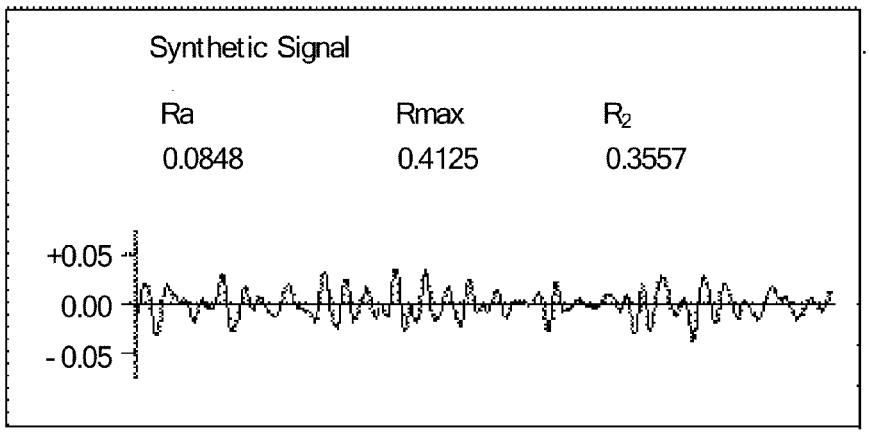
FIG. 18D is yet still another diagram exemplarily showing a result of multiresolution analysis using wavelet transformation.

The six graphs illustrated in FIG. 18C are results of the second time multiresolution analysis (MRA-2), and Graph (107) placed uppermost is the highest frequency component in the second time multiresolution analysis result, which is called "LHH".

Graph (108) is a frequency component whose level being one-level lower than that of the highest frequency component in the second time multiresolution analysis result, which is called "LHL".

Graph (109) is a frequency component whose level being two-level lower than that of the highest frequency component in the second time multiresolution analysis result, which is called "LMH".

Graph (110) is a frequency component whose level being three-level lower than that of the highest frequency component in the second time multiresolution analysis result, which is called "LML".

Graph (111) is a frequency component whose level being four-level lower than that of the highest frequency component in the second time multiresolution analysis result, which is called "LLH".

Graph (112) is the lowest frequency component in the second time multiresolution analysis result, which is called "LLL".

Figure 21:
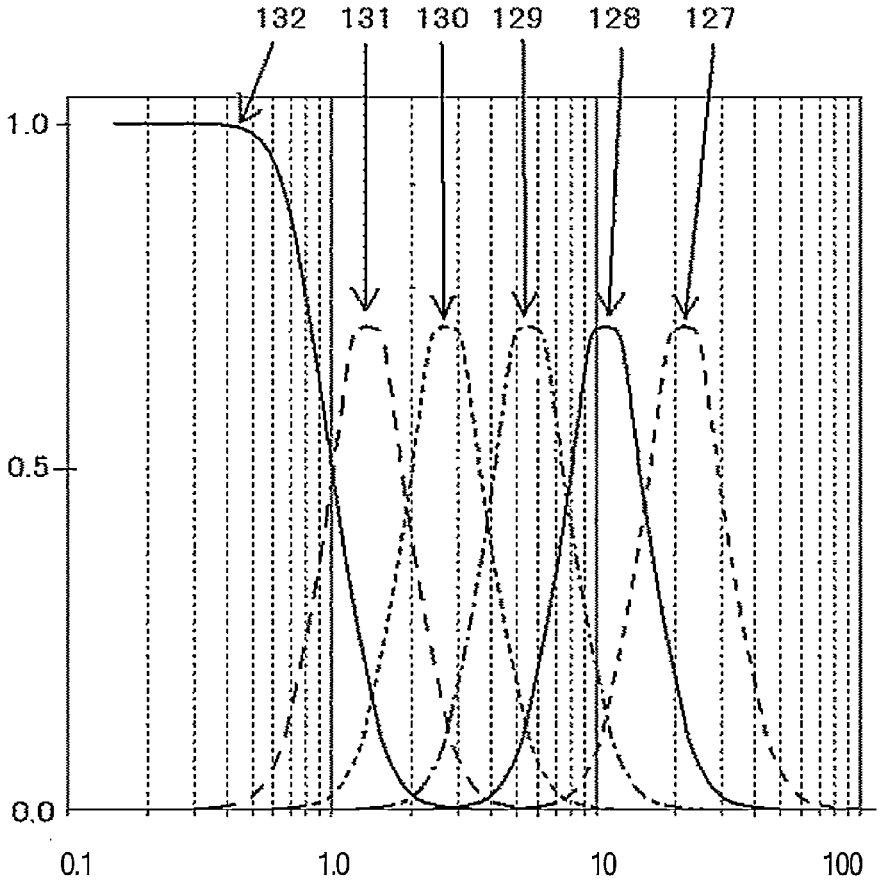
FIG. 21 is a diagram illustrating separation of frequency bands in the second time multiresolution analysis.

In the present invention, FIG. 18C illustrates six graphs corresponding to each of the frequencies, and the state of separation of frequencies is illustrated in FIG. 21.

In FIG. 21, the horizontal axis is the number of concaves and convexes being present in a length of 1 mm when the shape of the concaves and convexes is a sine wave. The vertical axis represents a ratio when the frequencies are separated in each frequency band.

In FIG. 21, (127) is a frequency band (LHH) of the highest frequency component in the second time multiresolution analysis, (128) is a frequency band (LHL) of frequency component whose level being one-level lower than that of the highest frequency component in the second time multiresolution analysis, (129) is a frequency band (LMH) of frequency component whose level being two-level lower than that of the highest frequency component in the second time multiresolution analysis, (130) is a frequency band (LML) of frequency component whose level being three-level lower than that of the highest frequency component in the second time multiresolution analysis, (131) is a frequency band (LLH) of frequency component whose level being four-level lower than that of the highest frequency component in the second time multiresolution analysis, and (132) is a frequency band (LLL) of the lowest frequency component in the second time multiresolution analysis.

More specifically, FIG. 21 illustrates that when the number of concaves and convexes per length of 1 mm is 0.2 or smaller, all the concaves and convexes appear in Graph (132).

For example when the number of concaves and convexes per length of 1 mm is 11, the concaves and convexes appear most significantly in Graph (128), and this means that surface roughness appear most significantly in the frequency band of a frequency component whose level is one-level lower than that of the highest frequency component in the second time multiresolution analysis, and in FIG. 18C, it is meant that surface roughness appear in the frequency band of LML.

Therefore, the frequency of surface roughness determines where signals appear in the six graphs of FIG. 18C.

In other words, minute surface roughness appears in the upper side of the graph in FIG. 18C, and a large roughness curve appears in the lower side of the graph in FIG. 18C.

In the present invention, surface roughness is separated by the frequency thereof, which is graphed as FIG. 18C. A surface roughness in respective frequency bands is determined from graphs on a frequency band basis. Here, as the surface roughness, a center-line average roughness Ra (WRa), a maximum height Rmax and a 10-point-average roughness Rz can be calculated.

In the manner described above, shapes of concaves and convexes in a surface of the electrophotographic photoconductor are measured by a surface roughness/profile measuring device to obtain one-dimensional data arrays, the one-dimensional data arrays are subjected to a multiresolution analysis (MRA-1) through wavelet transformation so as to be separated into a plurality of frequency components ranging from a highest frequency component to a lowest frequency component, the one-dimensional data arrays of the lowest frequency component thus obtained are thinned out so that the number of data arrays is reduced to thereby produce one-dimensional data arrays, the one-dimensional data arrays thus produced are subjected to a multiresolution analysis (MRA-2) through wavelet transformation so as to be separated into a plurality of frequency components ranging from a higher frequency component to a lowest frequency component. From each of the frequency components thus obtained, a center-line average roughness Ra (WRa), a maximum height Rmax and a 10-point-average roughness Rz were determined. The results are shown in Table 1.

TABLE 1

| | | Surface roughness determined from result of multiresolution analysis | | |
|---|---|---|---|---|
| No. of times of multiresolution analyses | Name of signal | Maximum height Rmax | Center line average roughness Rmax | 10-point average roughness Rz |
| First time | HHH | 0.0045 | 0.0505 | 0.0050 |
| | HHL | 0.0027 | 0.0399 | 0.0025 |
| | HMH | 0.0023 | 0.0120 | 0.0102 |
| | HML | 0.0039 | 0.0330 | 0.0283 |
| | HLH | 0.0024 | 0.0758 | 0.0448 |
| | HLL | 0.1753 | 0.7985 | 0.6989 |
| Second time | LHH | 0.0042 | 0.0665 | 0.0045 |
| | LHL | 0.0110 | 0.1632 | 0.0121 |
| | LMH | 0.0287 | 0.0764 | 0.0660 |
| | LML | 0.0620 | 0.3000 | 0.2663 |
| | LLH | 0.0462 | 0.2606 | 0.2131 |
| | LLL | 0.0888 | 0.3737 | 0.2619 |

With the multiresolution analyses through wavelet transformation, photoconductors produced so as to have a rough surface were evaluated for the coatability of solid lubricant on the surfaces of the photoconductors (otherwise referred to as "solid lubricant coatability") by the method described below. For the purpose of verifying the effect of surface configuration of photoconductors affecting the solid lubricant coatability, which was contrived by the present inventors, with respect to a relationship between evaluated values of the solid lubricant coatability and WRa, a contribution ratio of WRa in individual frequency bands was estimated from a multivariate data analysis. For the multivariate data analysis, statistical software, JMP Ver. 5.01a manufactured by SAS Institute was used.

Roughing of a photoconductor surface can be achieved by various methods, for example, by adding an agent capable of controlling the shape, such as a filler, into a surface layer coating liquid, by contriving the production conditions, and/or by subjecting a photoconductor surface to mechanical processing. However, it has not been clearly demonstrated that what surface configurations can be obtained under various conditions in these methods.

On electrophotographic photoconductors having various rough surfaces, the present inventors examined a relationship, between evaluation values of solid lubricant coatability and WRa values. As a result, it was verified that a correlation therebetween, supporting the contrivance of the present inventors, can be obtained, which leads to completion of the present invention.

That is, the present invention is based on the findings of the present inventors, and means for solving the above problems are as follows:

(1) An electrophotographic photoconductor comprising:

a support, a photosensitive layer, and a crosslinked resin surface layer, the photosensitive layer and crosslinked resin surface layer being provided over the support, wherein shapes of concaves and convexes in a surface of the electrophotographic photoconductor are measured by a surface roughness/profile measuring device to obtain one-dimensional data arrays, the one-dimensional data arrays are subjected to a multiresolution analysis (MRA-1) through wavelet transformation so as to be separated into six frequency components including a highest frequency component (HHH), a second highest frequency component (HHL), a third highest frequency component (HMH), a fourth highest frequency component (HML), a fifth highest frequency component (HLH) and a lowest frequency component (HLL), the one-dimensional data arrays of the lowest frequency component (HHL) thus obtained are thinned out so that the number of data arrays is reduced to 1/10 to 1/100 thereof to thereby produce one-dimensional data arrays, the one-dimensional data arrays thus produced are subjected to a multiresolution analysis (MRA-2) through wavelet transformation so as to be separated into six frequency components including a highest frequency component (LHH), a second highest frequency component (LHL), a third highest frequency component (LMH), a fourth highest frequency component (LML), a fifth highest frequency component (LLH) and a lowest frequency component (LLL) to thereby obtain 12 frequency components in total; and a center-line average roughness (WRa) of each of the 12 frequency components satisfies a relationship (i) below, $$1-597\times WRa(HML)+238\times WRa(HLH)-95\times WRa(LHL)+84\times WRa(LMH)-79\times WRa(LML)+55\times WRa(LLH)-17\times WRa(LLL)>0 \quad (i)$$

where a center-line average roughness (WRa) of each of the frequency components is a center-line average roughness based on one-dimensional data arrays, which is obtained by a procedure in which shapes of concaves and convexes in a surface of the electrophotographic photoconductor are measured by a surface roughness/profile measuring device to obtain one-dimensional data arrays, and the one-dimensional data arrays are subjected to the multiresolution analyses (MRA-1) and (MRA-2) so as to be separated into different frequency components ranging from a highest frequency component to a lowest frequency component; and HML, HLH, LHL, LMH, LML, LLH, and LLL each represent an individual frequency band obtained when the one-dimensional data arrays are separated into frequency components having one concave-convex cycle length of from 4 μm to 25 μm, from 10 μm to 50 μm, from 53 μm to 183 μm, from 106 μm to 318 μm, from 214 μm to 551 μm, from 431 μm to 954 μm, and from 867 μm to 1,654 μm, in this order.

Figure 23:
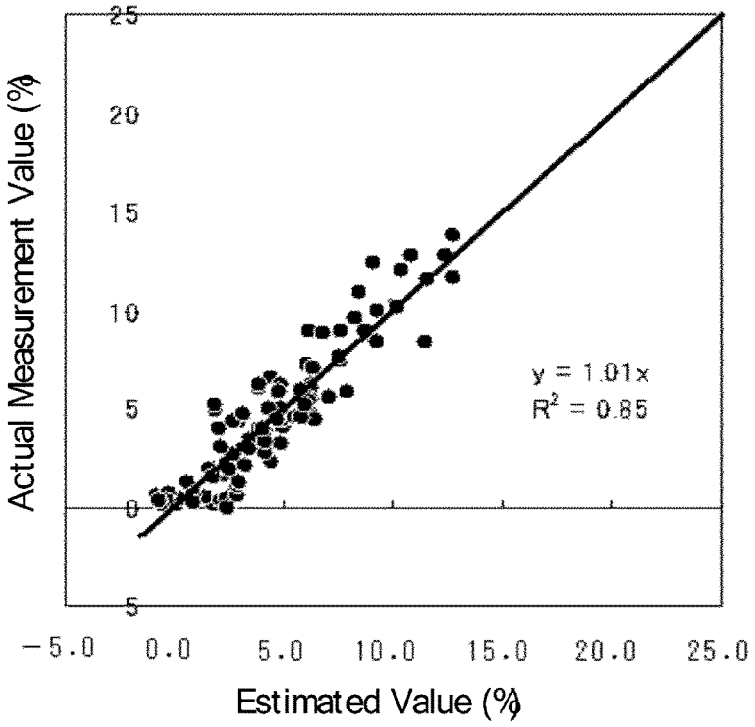
FIG. 23 is an exemplary diagram illustrating a relationship between an estimated value and an actual measurement value of the coatability of solid lubricant, which is obtained through multivariate data analysis.

The relationship (i) in the item (1) is obtained from the multivariate data analysis. A photoconductor satisfying the relationship (i) is extremely excellent in solid lubricant coatability. In estimated values obtained by the multivariate data analysis and actual evaluation values, a favorable relationship was obtained. The relationship is illustrated in FIG. 23. Since a correlation therebetween was obtained, it is considered that the multivariate data analysis was a success.

Figure 24:
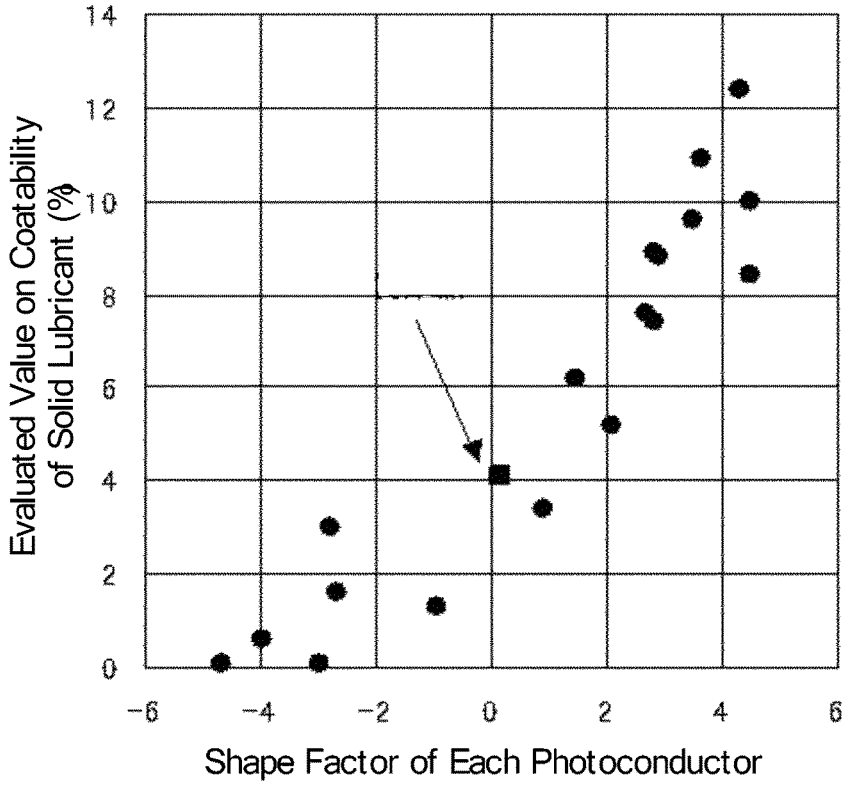
FIG. 24 is a correlation diagram showing a relationship between shape factor and coatability of solid lubricant.

The left side value of the relationship (i) in the item (1) is defined as a shape factor of the solid lubricant coatability of an electrophotographic photoconductor, and a relationship between shape factor and solid lubricant coatability is illustrated in FIG. 24. It is found that a photoconductor having a shape factor of 0 or more linearly exhibits excellent solid lubricant coatability as compared to a conventional photoconductor which is recognized as being excellent in solid lubricant coatability. It is also understandable that the shape factor correlates directly with the solid lubricant coatability.

As a requirement for providing a rough surface to an electrophotographic photoconductor, specifically, electrophotographic photoconductors satisfying the relationship (i) in the item (1) were obtained, in which a photosensitive layer is sprayed with a crosslinked-resin-surface-layer coating liquid to form a wet film and the wet film is sprayed with water and cured by UV irradiation, and electrophotographic photoconductors satisfying the relationship (i) were also obtained by adding a large amount of water or adding an acrylic resin fine particle into a surface layer coating liquid. The present invention is not limited to these methods.

(2) the crosslinked resin surface layer contains at least a crosslinked product of a curable charge transporting material represented by the following General Formula (1) in an amount equal to or more than 5% by mass and less than 60% by mass, General Formula (1)

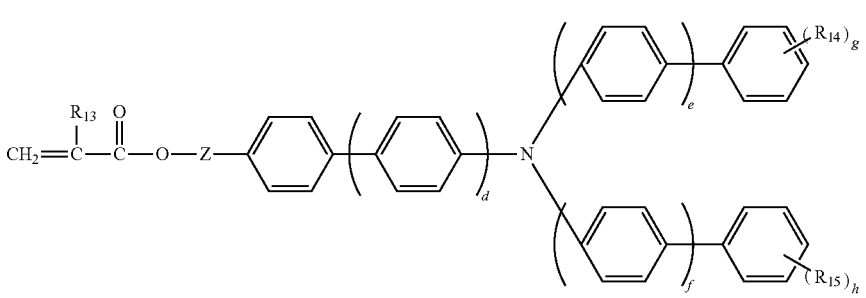

where d, e and f each represent an integer of zero or 1, $R_{13}$ represents a hydrogen atom or a methyl group; $R_{14}$ and $R_{15}$ each represent an alkyl group having 1 to 6 carbon atoms, which is a substituent other than hydrogen atom, and in the case where $R_{14}$ and $R_{15}$ are present in plural number, each may be different; g and h each represent an integer of zero to 3; and Z represents any one of a single bond, a methylene group, an ethylene group and a divalent group represented by one of the following formulae:

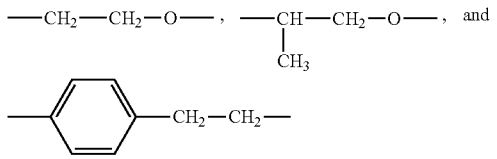

The item (2) is restricted to the crosslinked resin surface layer material as an especially effective compound, and with use of the radical polymerizable charge transporting material, high-sensitivity of the crosslinked resin surface layer and the adhesiveness thereof to an underlying layer can be improved (3) The crosslinked resin surface layer desirably contains a crosslinked product of trimethylolpropane triacrylate in an amount equal to or more than 10% by mass and less than 50% by mass.

The item (3) is restricted to the crosslinked resin surface layer material as another especially effective compound, and with use of these compounds, the mechanical strength of the crosslinked resin surface layer can be improved.

(4) The crosslinked resin surface layer is desirably a layer which is cured after an uncured wet film immediately after coating with a crosslinked-resin-surface-layer coating liquid is sprayed with water.

The item (4) is restricted to a method of providing a rough surface on the crosslinked resin surface layer, whereby making it possible to form a surface configuration excellent in solid lubricant coatability of the present invention.

(5) The crosslinked resin surface layer is desirably formed with a crosslinked-resin-surface-layer coating liquid containing water in an amount of 5% by mass to 15% by mass with respect to the mass of the crosslinked-resin-surface-layer coating liquid.

The item (5) is restricted to another method of providing a rough surface on the crosslinked resin surface layer, whereby making it possible to form a surface configuration excellent in solid lubricant coatability of the present invention.

(6) A method for producing an electrophotographic photoconductor having a photosensitive layer and a crosslinked resin surface layer over a support, wherein shapes of concaves and convexes in a surface of the electrophotographic photoconductor are measured by a surface roughness/profile measuring device to obtain one-dimensional data arrays, the one-dimensional data arrays are subjected to a multiresolution analysis (MRA-1) through wavelet transformation so as to be separated into six frequency components including a highest frequency component (HHH), a second highest frequency component (HHL), a third highest frequency component (HMH), a fourth highest frequency component (HML), a fifth highest frequency component (HLH) and a lowest frequency component (HLL), the one-dimensional data arrays of the lowest frequency component (HHL) thus obtained are thinned out so that the number of data arrays is reduced to 1/10 to 1/100 thereof to thereby produce one-dimensional data arrays, the one-dimensional data arrays thus produced are subjected to a multiresolution analysis (MRA-2) through wavelet transformation so as to be separated into six frequency components including a highest frequency component (LHH), a second highest frequency component (LHL), a third highest frequency component (LMH), a fourth highest frequency component (LML), a fifth highest frequency component (LLH) and a lowest frequency component (LLL) to thereby obtain 12 frequency components in total; and a center-line average roughness (WRa) of each of the 12 frequency components satisfies a relationship (i) below, $$1-597\times WRa(HML)+238\times WRa(HLH)-95\times WRa(LHL)+84\times WRa(LMH)-79\times WRa(LML)+55\times WRa(LLH)-17\times WRa(LLL)>0 \quad (i)$$

where a center-line average roughness (WRa) of each of the frequency components is a center-line average roughness based on one-dimensional data arrays, which is obtained by a procedure in which shapes of concaves and convexes in a surface of the electrophotographic photoconductor are measured by a surface roughness/profile measuring device to obtain one-dimensional data arrays, and the one-dimensional data arrays are subjected to the multiresolution analyses (MRA-1) and (MRA-2) so as to be separated into different frequency components ranging from a highest frequency component to a lowest frequency component; and HML, HLH, LHL, LMH, LML, LLH, and LLL each represent an individual frequency band obtained when the one-dimensional data arrays are separated into frequency components having one concave-convex cycle length of from 4 μm to 25 μm, from 10 μm to 50 μm, from 53 μm to 183 μm, from 106 μm to 318 μm, from 214 μm to 551 μm, from 431 μm to 954 μm, and from 867 μm to 1,654 μm, in this order.

The (6) above discloses specific requirements for forming a surface layer of photoconductor satisfying the (1) to (3) above. Specific examples of the production method are referred to Examples of the present invention described below.

(7) An image forming apparatus including the electrophotographic photoconductor according to any one of the items (1) to (5), a solid-lubricant applying unit which scrapes a solid lubricant with a brush roller and applies the scraped solid lubricant onto the electrophotographic photoconductor, and a coating blade for spreading the solid lubricant over a surface of the electrophotographic photoconductor.

In the item (7), in the image forming apparatus where a solid lubricant is scraped by a brush, the scraped solid lubricant is applied onto a surface of the electrophotographic photoconductor. With use of the electrophotographic photoconductor satisfying the conditions described in the items (1) to (3), solid lubricant acceptability more excellent than in the case of conventional photoconductors can be obtained.

(8) In the electrophotographic photoconductor, preferably, at least frequency components other than HLL have a WRa of 0.06 μm or greater, and a frequency band of each of the frequency components is higher than that of LLL, and when the frequency band of the frequency components in the electrophotographic photoconductor is plotted against a logarithmic value of each of the WRa values on a two-dimensional graph to obtain a relationship therebetween, an inflection point or a local maximum point is present in the frequency band of any one of LLH, LMH, and LML, and wherein the electrophotographic photoconductor satisfies a linear velocity requirement that 250 to 1,000 concaves and convexes in the surface of the photoconductor pass the coating blade per second.

The item (8) is restricted to an electrophotographic photoconductor, in which at least frequency components other than HLL have a WRa of 0.06 μm or greater, as a condition for maintaining an effectively high value of WRa. This is important as a condition for effecting a variation in linear pressure of a coating blade capable of efficiently spreading a solid lubricant. If the value exceedingly increases, toner inconveniently passes through a cleaning blade. The upper limit of this value is 0.1 μm or lower.

Figure 25:
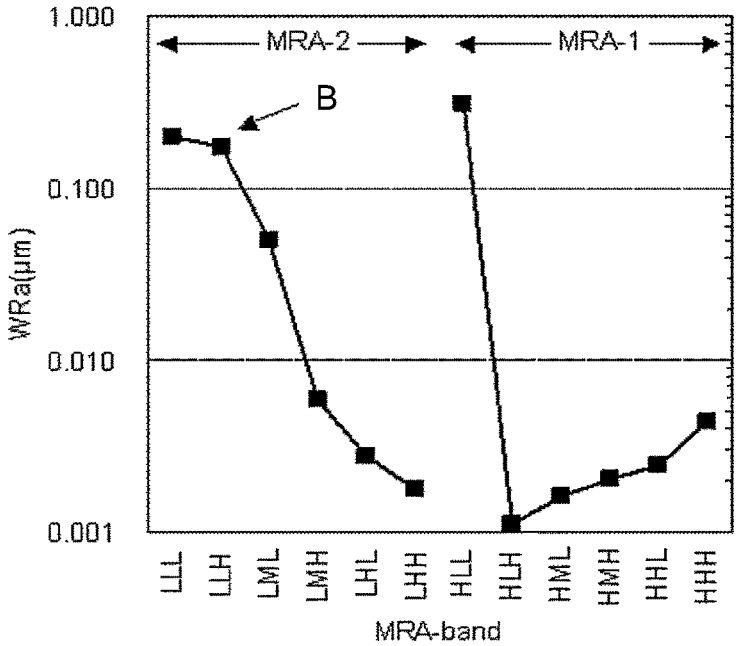
FIG. 25 is an exemplary diagram illustrating a relation between WRa values which have been separated into frequency components, and frequencies, in which an inflection point of WRa is observed in a low frequency band region.
Figure 26:
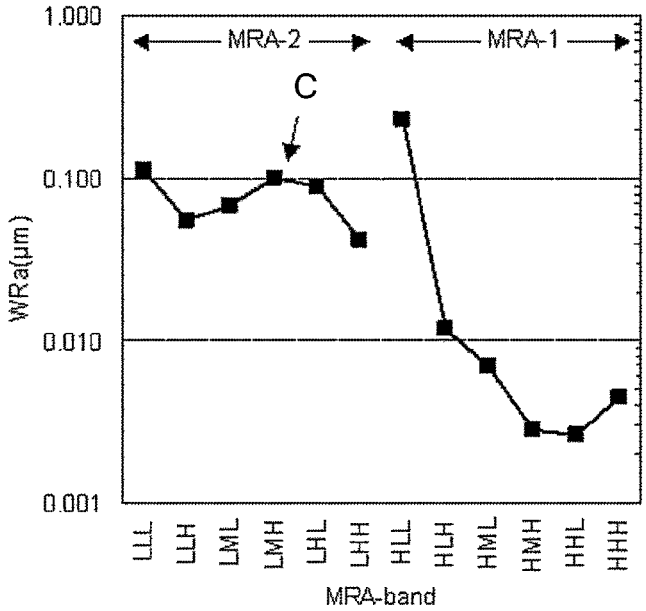
FIG. 26 is an exemplary diagram illustrating a relation between WRa values which have been separated into frequency components, and frequencies, in which a local maximum point of WRa is observed in a low frequency band region.
Figure 27:
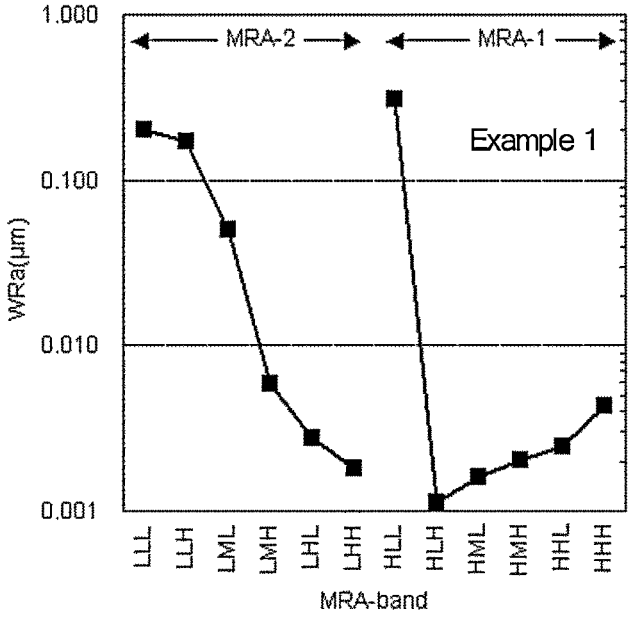
FIG. 27 is a relationship diagram of WRa after having been separated into frequency components of Example 1.
Figure 28:
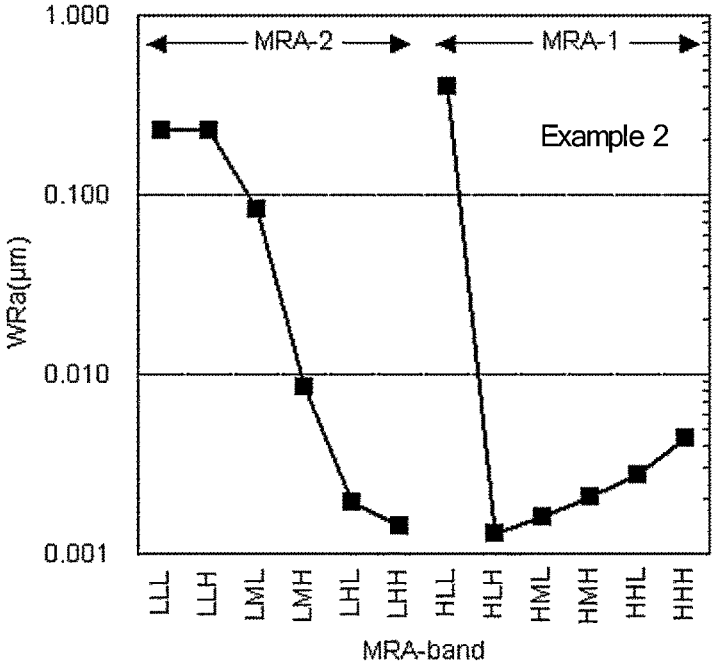
FIG. 28 is a relationship diagram of WRa after having been separated into frequency components of Example 2.
Figure 29:
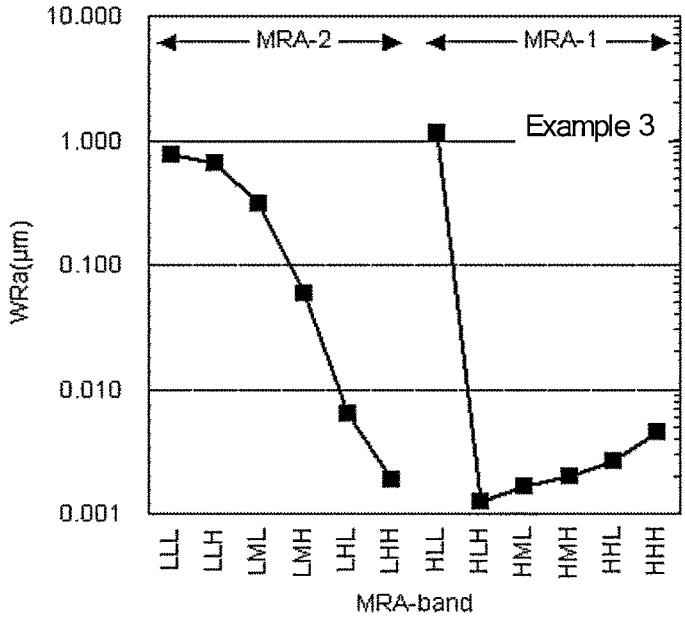
FIG. 29 is a relationship diagram of WRa after having been separated into frequency components of Example 3.
Figure 30:
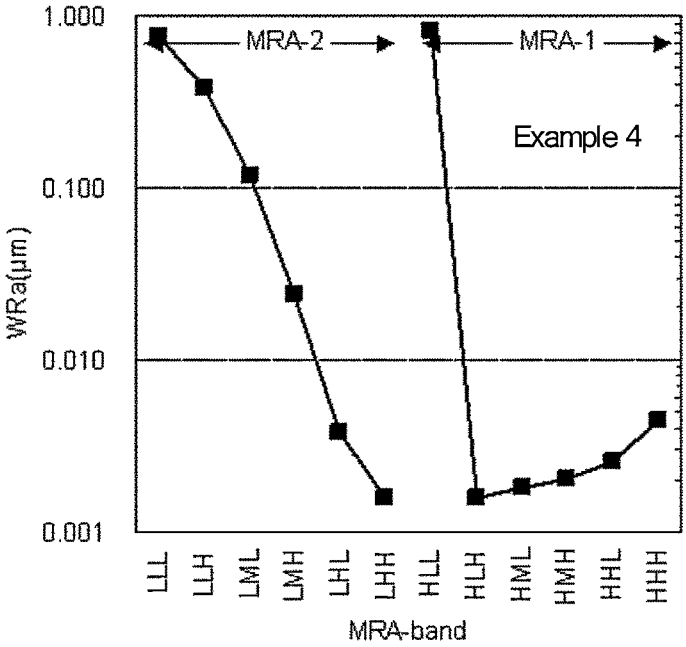
FIG. 30 is a relationship diagram of WRa after having been separated into frequency components of Example 4.
Figure 31:
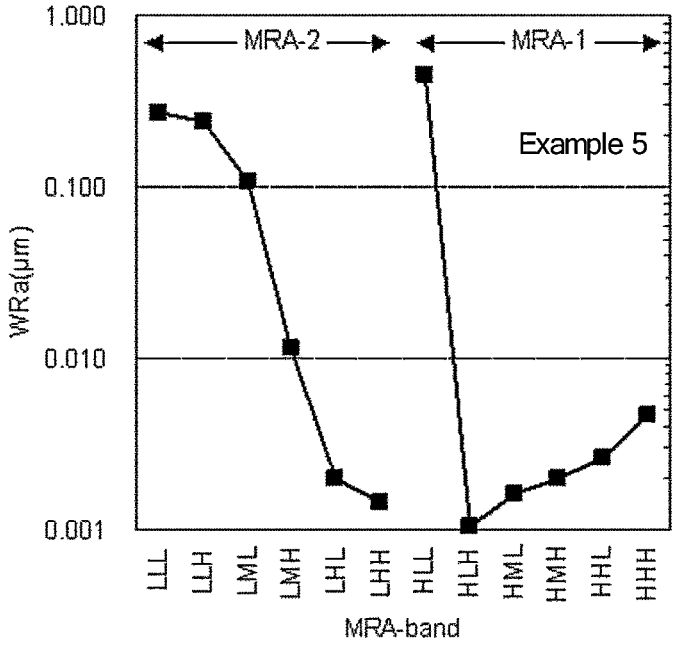
FIG. 31 is a relationship diagram of WRa after having been separated into frequency components of Example 5.
Figure 32:
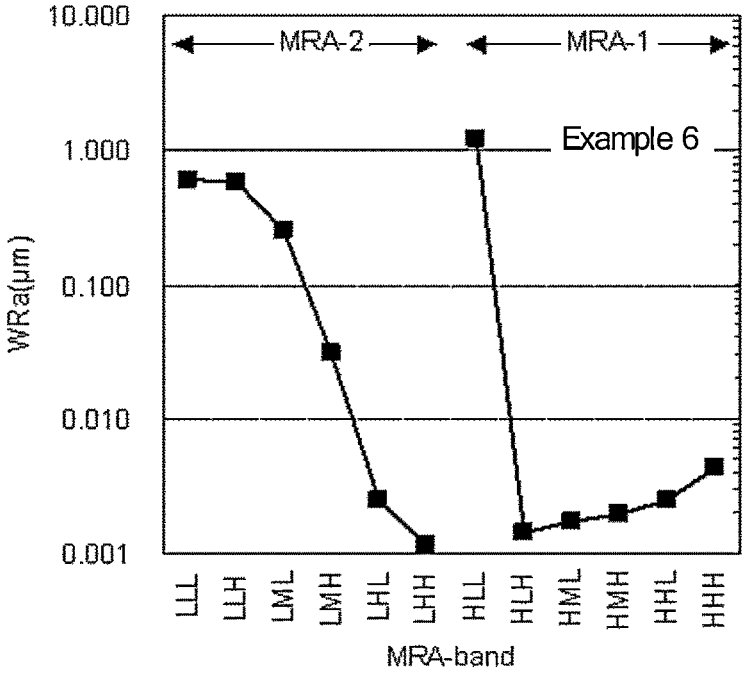
FIG. 32 is a relationship diagram of WRa after having been separated into frequency components of Example 6.
Figure 33:
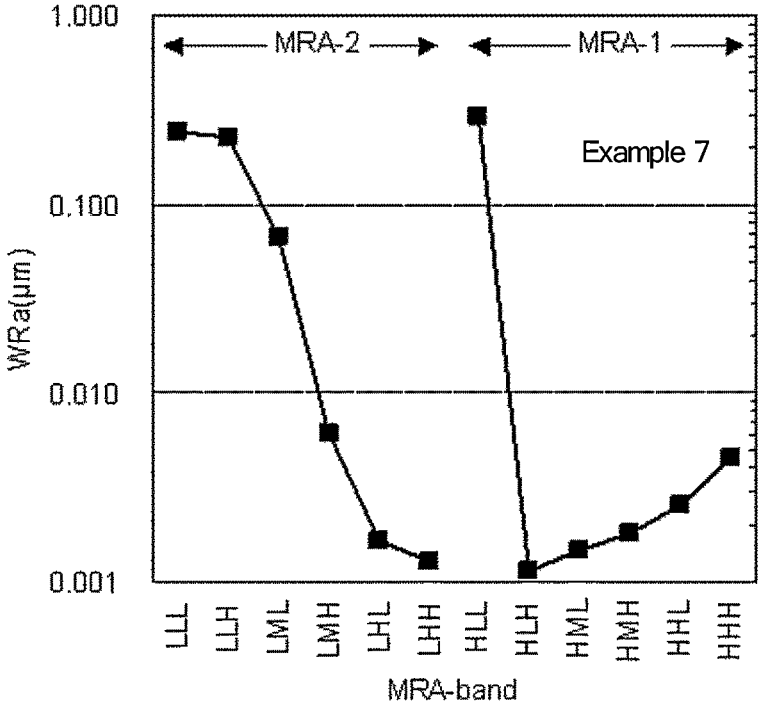
FIG. 33 is a relationship diagram of WRa after having been separated into frequency components of Example 7.
Figure 34:
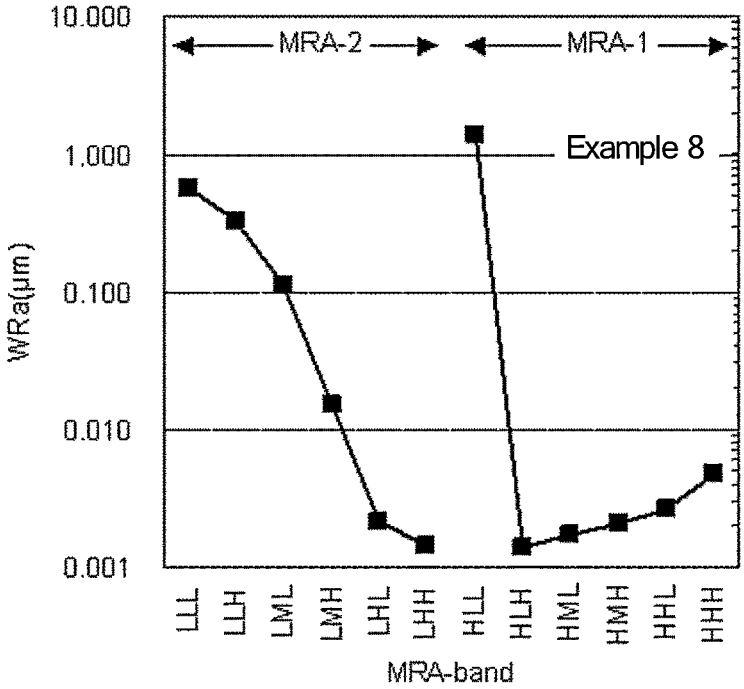
FIG. 34 is a relationship diagram of WRa after having been separated into frequency components of Example 8.
Figure 35:
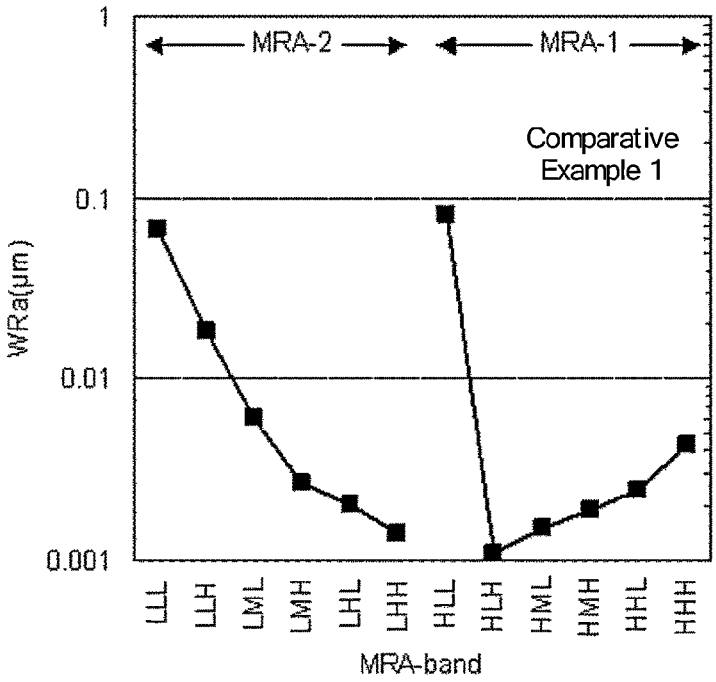
FIG. 35 is a relationship diagram of WRa after having been separated into frequency components of Comparative Example 1.
Figure 36:
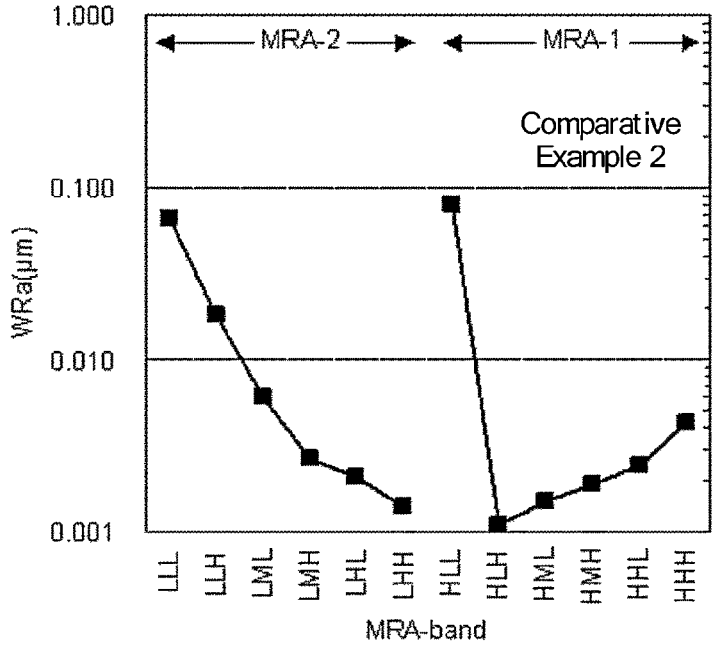
FIG. 36 is a relationship diagram of WRa after having been separated into frequency components of Comparative Example 2.
Figure 37:
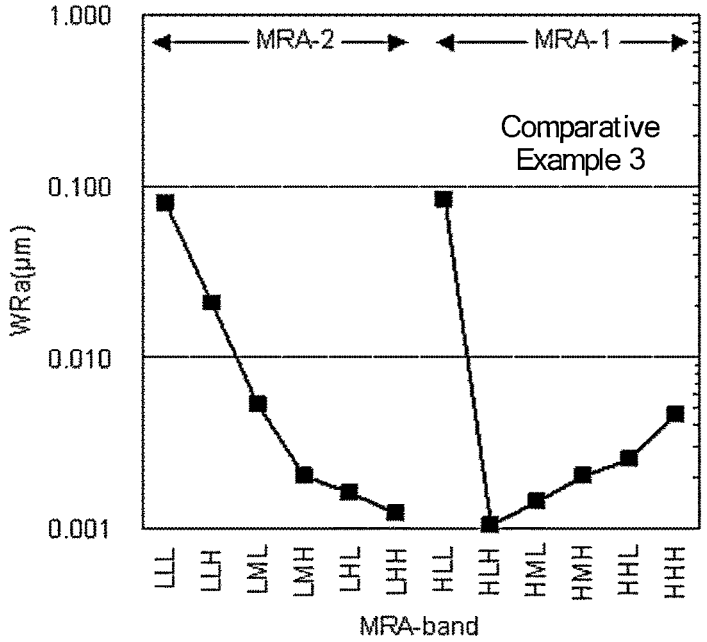
FIG. 37 is a relationship diagram of WRa after having been separated into frequency components of Comparative Example 3.
Figure 38:
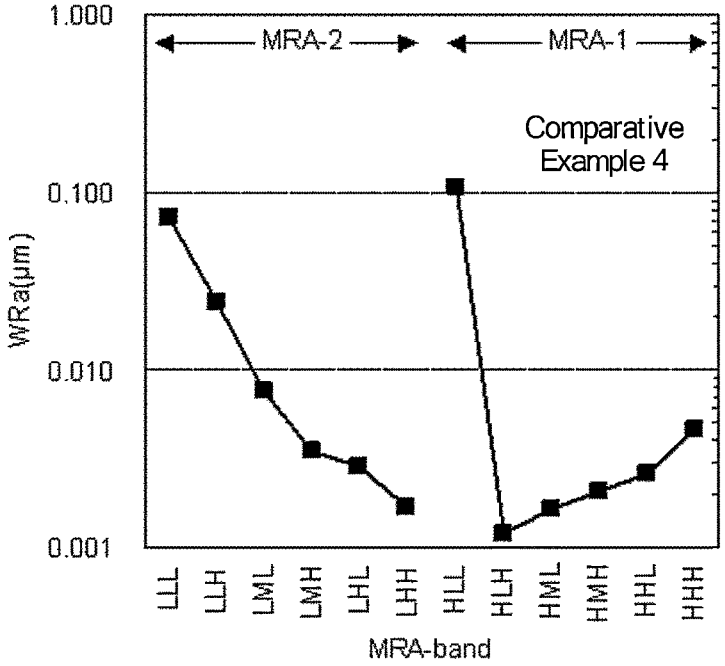
FIG. 38 is a relationship diagram of WRa after having been separated into frequency components of Comparative Example 4
Figure 39:
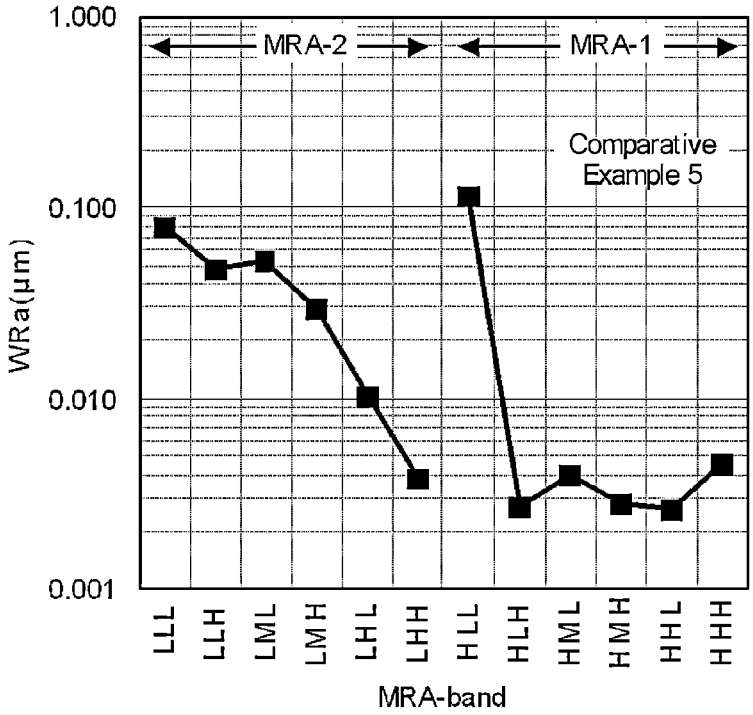
FIG. 39 is a relationship diagram of WRa after having been separated into frequency components of Comparative Example 5.

When a WRa obtained by subjecting one-dimensional data arrays of the surface configuration of an electrophotographic photoconductor to wavelet transformation are arranged sequentially on a frequency component basis, an inflection point or a local maximum point as illustrated in FIG. 25 or FIG. 26 is observed in some cases. The inflection point and the local maximum point represent the most dominating frequency component having an effectively high value of WRa.

With respect to image forming process, a frequency at which concaves and convexes in an electrophotographic photoconductor pass a coating blade is calculated as a value which is obtained by dividing the linear velocity of the electrophotographic photoconductor by a distance of one concave-convex cycle length. Electrophotographic photoconductors having a same average distance between a concave and a convex have a different result in solid lubricant coatability if the linear velocity of the electrophotographic photoconductors is different. To solve this problem, in the present invention, as a requirement for an electrophotographic photoconductor to exhibit excellent solid lubricant acceptability, it is important to satisfy a linear velocity requirement that 250 to 1,000 concaves and convexes of dominating frequency components in the surface of the photoconductor pass the coating blade per second. Note that in the present invention, for the convenience of using numerical expressions, for the distance of one concave-convex cycle length in the surface, a center value in each frequency band obtained based on frequency analyses is used.

(9) It is preferable to use a polymerized toner to develop an image.

The item (9) relates to the image-forming-process cartridge, which corresponds to the (5) above, whereby the coatability of the electrophotographic photoconductor to solid lubricant can be improved, and the maintainability of the electrophotographic photoconductor can be improved.

(10) The image forming apparatus preferably includes at least two developing units and employs a tandem system, wherein a polymerized toner is used to develop an image.

The item (10) relates to the image-forming-process cartridge, which corresponds to the (6) above, whereby the coatability of the electrophotographic photoconductor to solid lubricant can be improved, and the maintainability of the electrophotographic photoconductor can be improved.

(11) A process cartridge including:

the electrophotographic photoconductor according to any one of the items (1) to (5), a solid-lubricant applying unit which scrapes a solid lubricant with a brush roller and applies the scraped solid lubricant onto the electrophotographic photoconductor, and a coating blade for spreading the solid lubricant over a surface of the electrophotographic photoconductor.

The item (11) is restricted to the use of a polymerized toner for a developer of the image forming apparatus, whereby the coatability of the electrophotographic photoconductor to solid lubricant can be improved, and the high quality image forming performance and the environmental protection of the image forming apparatus can be improved.

(12) in the electrophotographic photoconductor, in the electrophotographic photoconductor, at least frequency components other than HLL have a WRa of 0.06 μm or greater, and a frequency band of each of the frequency components is higher than that of LLL, and when the frequency band of the frequency components in the electrophotographic photoconductor is plotted against a logarithmic value of each of the WRa values on a two-dimensional graph to obtain a relationship therebetween, an inflection point or a local maximum point is present in the frequency band of any one of LLH, LMH, and LML, and the electrophotographic photoconductor satisfies a linear velocity requirement that 250 to 1,000 concaves and convexes in the surface of the photoconductor pass the coating blade per second.

The item (12) is restricted to the image forming apparatus which has at least developing stations for two or more colors and employs a tandem system, wherein an image is developed using a polymerized toner, whereby the coatability of the electrophotographic photoconductor to solid lubricant can be improved, and the high-speed performance of image forming process can be improved.

Hereinafter, the electrophotographic photoconductor of the present invention will be further described with reference to the drawings.

Figure 7:
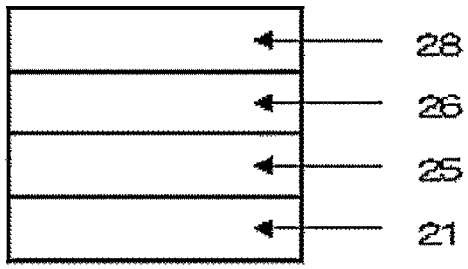
FIG. 7 is a cross-sectional diagram illustrating a laminar structure of an electrophotographic photoconductor of the present invention.

FIG. 7 is a cross-sectional diagram illustrating an electrophotographic photoconductor of the present invention, which has another laminar structure. A charge generating layer 25 and a charge transporting layer 26 and a crosslinked resin surface layer 28 are provided over a conductive support 21.

Figure 8:
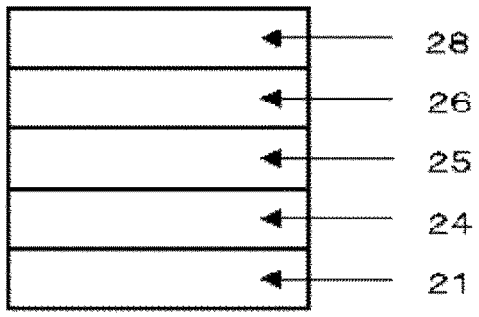
FIG. 8 is a cross-sectional diagram illustrating another laminar structure of an electrophotographic photoconductor of the present invention.

FIG. 8 is a cross-sectional diagram illustrating an electrophotographic photoconductor of the present invention which has still another laminar structure. An undercoat layer 24 is provided between a conductive support 21 and a charge generating layer 25, and a charge transporting layer 26 and a crosslinked resin surface layer 28 are provided over the charge generating layer 25.

—Conductive Support—

As the conductive support 21, a support exhibiting conductivity of a volume resistivity of $10^{10}$ Ω·cm or lower is exemplified. For example, the support may be prepared by applying a metal such as aluminum, nickel, chromium, nichrome, copper, gold, silver, or platinum or the like, or a metal oxide such as tin oxide or indium oxide or the like, for example, by vapor deposition or sputtering, onto film-form or cylindrical plastic or paper, or using a sheet or plate of aluminum, aluminum alloy, nickel, or stainless steel or the like, and making it into a crude tube by Drawing Ironing, Impact Ironing, Extruded Ironing, Extruded Drawing or cutting, and then surface-treating the tube by cutting, super-finishing, or grinding or the like.

—Undercoat Layer—

In an electrophotographic photoconductor used in the present invention, the undercoat layer 24 can be provided between the conductive support and the photosensitive layer.

The undercoat layer is provided for the purpose of improvement in adhesiveness, prevention of moiré, improvement in coatability of layers formed thereabove, prevention of injection of charge from the conductive support, and the like.

The undercoat layer is mainly composed of a resin. A photosensitive layer is usually applied over the undercoat layer, the resin for use in the undercoat layer, and thus a thermocurable resin, which is sparsely soluble in an organic solvent is suitable for the resin for use in the undercoat layer. Most of polyurethane resins, melamine resins and alkyd-melamine resins are especially preferred because these satisfy the purposes described above. A coating liquid can be prepared by suitably diluting such a resin in a solvent such as tetrahydrofuran, cyclohexanone, dioxane, dichloroethane and butanone.

In addition, fine particles of metal or metal oxide may be added to the undercoat layer to adjust the conductivity and prevent moiré. Especially, titanium oxide is preferably used.

The fine particles are dispersed in a solvent such as tetrahydrofuran, cyclohexanone, dioxane, dichloroethane or butanone with a ball mill, an attritor or a sand mill to form a dispersion liquid, and the dispersion liquid is mixed with resin component, thereby preparing a coating liquid.

The coating liquid is applied onto the support by a dip coating method, a spray coating method, or a bead coating method and optionally cured by heating, so that the undercoat layer is formed.

The thickness of the undercoat layer is preferably 2 μm to 5 μm. When a photoconductor tends to have a high residual voltage, the thickness thereof is preferred to be less than 3 μm.

As the photosensitive layer of the present invention, a multilayered photosensitive layer is suitable in which a charge generating layer and a charge transporting layer are formed in this order.

—Charge Generating Layer—

Among the layers of a multilayered photoconductor, a charge generating layer 25 will be described below.

The charge generating layer is a part of the multilayered photosensitive layer and has a function of generating charges by irradiation of light. This layer is mainly formed of a charge generating material in a compound contained therein. The charge generating layer contains a binder resin, if desired. Inorganic material and organic material can be used as the charge generating material.

The inorganic material is not particularly limited and may be suitably selected in accordance with the intended use. Specific examples of the inorganic materials include crystal selenium, amorphous-selenium, selenium-tellurium, selenium-tellurium-halogen, selenium-arsenic compounds, and amorphous-silicon. With regard to the amorphous-silicon, those in which a dangling-bond is terminated with a hydrogen atom or a halogen atom, and those in which boron atoms or phosphorous atoms are doped are preferably used.

The organic material is not particularly limited, and those known in the art may be used. Specific examples of the organic materials include metal phthalocyanines such as titanyl phthalocyanine, chlorogallium phthalocyanine, metal-free phthalocyanine, azulenium salt pigments, squaric acid methine pigments, symmetric or asymmetric azo pigments having a carbazole skeleton, symmetric or asymmetric azo pigments having a triphenyl amine skeleton, symmetric or asymmetric azo pigments having a fluorenone skeleton, and perylene pigments. Among these, metal phthalocyanine, symmetric or asymmetric azo pigments having a fluorenone skeleton, symmetric or asymmetric azo pigments having a triphenyl amine skeleton, and perylene pigments are preferably used in the present invention since all of these have high quantum efficiency of charge generation. These charge generating materials may be used alone or in combination.

The binder resins optionally used in the charge generation layer are not particularly limited and may be suitably selected in accordance with the intended use. Specific examples thereof include polyamides, polyurethanes, epoxy resins, polyketones, polycarbonates, polyarylates, silicone resins, acrylic resins, polyvinylbutyrals, polyvinylformals, polyvinylketones, polystyrenes, poly-N-vinylcarbazoles, and polyacrylamides. In addition, charge transporting polymers, which are described later, can be also used. Among these, polyvinyl butyral is most used and useful. These binder resins can be used alone or in combination.

The method of forming a charge generating layer is typified into a vacuum thin-film forming method and a casting method using a dispersion liquid.

Specific examples of the vacuum thin-film forming methods include, but are not limited to, a vacuum evaporation method, a glow discharge decomposition method, an ion-plating method, a sputtering method, a reactive sputtering method, and a chemical vapor deposition (CVD) method. Charge generating layers can be preferably formed by these method using the above-mentioned inorganic material(s) or organic material(s).

In the casting method, the above-mentioned inorganic or organic charge generating material is dispersed, if necessary, with a binder resin in a solvent, for example, tetrahydrofuran, cyclohexanone, dioxane, dichloroethane, and butanone by, for example, a ball mill, an attritor, or a sand mill. Thereafter, suitably diluted dispersion liquid is applied to the surface of a support to form the charge generation layer. Among these solvents, methylethylketone, tetrahydrofuran, and cyclohexanone are preferred in comparison with chlorobenzene, dichloromethane, toluene and xylene in terms of less burden on the environment. The diluted dispersion liquid can be applied by a dip coating method, a spray coating method, a bead coating method, etc.

The thickness of the charge generating layer is preferably from 0.01 μm to 5 μm.

The charge generating layer is thickened to reduce the residual voltage or improve the sensitivity. However, the chargeability may degrade in terms of maintainability of the charge and the formation of space charge in most cases.

Considering the balance between these points, the thickness of the charge generating layer is more preferably from 0.05 μm to 2 μm.

In addition, a compound having a low molecular weight, such as an anti-oxidant, a plasticizer, a lubricant, and an ultraviolet absorber, which are described later, and a leveling agent can be added to the charge generating layer, if desired. These compounds can be used alone or in combination. However, when a compound having a low molecular weight and a leveling agent are used in combination, the sensitivity of the charge generating layer easily degrades in most cases. Therefore, the addition amount of the compound having a low molecular weight is preferably from 0.1 parts by mass to 20 parts by mass and more preferably from 0.1 parts by mass to 10 parts by mass. The addition amount of the leveling agent is from 0.001 parts by mass to 0.1 parts by mass.

—Charge Transporting Layer—

The charge transporting layer is a part of the multilayered photosensitive layer and has a function of neutralizing the surface charge of a photoconductor generated by charging by infusing and transporting the charges generated in the charge generation layer. The main component of the charge transporting layer is a charge transporting component and a binder component to bind the charge transporting component.

Materials suitably used as the charge transporting component are electron transporting materials having a low molecular weight, a positive hole transport material having a low molecular weight and a charge transporting polymer.

Specific examples of the electron transporting materials include, but are not limited to, electron accepting materials such as an asymmetry diphenoquinone derivative, a fluorenone derivative, and naphthalimide derivative. These electron transporting materials may be used alone or in combination.

As the positive hole transporting material, electron donating materials are suitably used. Specific examples of the positive hole transport materials include, but are not limited to, oxazole derivatives, oxadiazole derivatives, imidazole derivatives, triphenyl amine derivatives, butadiene derivatives, 9-(p-diethylaminostyryl anthracene), 1,1-bis-(4-dibenzyl aminophenyl)propane, styryl anthracene, styryl pyrazoline, phenyl hydrazones, α-phenylstilbene derivatives, thiazole derivatives, triazole derivatives, phenazine derivatives, acridine derivatives, benzofuran derivatives, benzimidazole derivatives, and thiophene derivatives. These positive hole transporting materials may be used alone or in combination.

In addition, the following charge transporting polymers can be also used: polymers having a carbazole ring such as poly-N-vinyl carbazole; polymers having a hydrazone structure illustrated in Japanese Patent Application Laid-Open (JP-A) No. 57-78402, etc.; polysilylene polymers illustrated in JP-A No. 63-285552, etc.; and aromatic polycarbonates illustrated in the chemical formulae (1) to (6) of JP-A No. 2001-330973. These charge transporting polymers can be used alone or in combination. The illustrated compounds in JP-A No. 2001-330973 are preferable because those compounds have good electrostatic characteristics.

When the crosslinked resin surface layer is stacked, the charge transporting polymer oozes its component to the crosslinked resin surface layer less than the charge transporting material having a low molecular weight. Therefore, the charge transporting polymer is a suitable material to prevent curing defects of the crosslinked resin surface layer. Furthermore, since the molecular weight of the charge transporting polymer is large, the charge transporting layer has good heat resistance. Therefore, the charge transporting polymer is advantageous in terms that the charge transporting layer is protected from the curing heat generated when the crosslinked resin surface layer is formed.

Specific examples of polymers suitably used as the binder components of the charge transporting layer include, but are not limited to, thermoplastic resins or thermocurable resins such as polystyrenes, polyesters, polyvinyl, polyarylate, polycarbonates, acrylic resins, silicone resins, fluororesins, epoxy resins, melamine resins, urethane resins, phenol resins, and alkyd resins. Among these, when polystyrenes, polyesters, polyarylates or polycarbonates are used as the binder component of the charge transporting component, most of those polymers have good charge mobility and are thus useful. In addition, since the crosslinked resin surface layer is stacked on the charge transporting layer, the charge transporting layer is not required to have a mechanical strength, which is usually required for a typical charge transporting layer. Therefore, a material such as polystyrene, which is highly transparent but slightly weak in terms of the mechanical strength, is unsuitable for use in a typical charge transporting layer but can be effectively used as the binder component of the charge transporting layer having the crosslinked resin surface layer.

These polymers can be used alone or in combination. In addition, a copolymer formed of two or more kinds of monomers or a compound copolymerized with the charge transporting material can be used as the polymer.

When an electrically inactive polymer is used to reform the charge transporting layer, using polyesters of Cardo polymer type having a bulky skeleton such as fluorine, polyesters such as polyethylene terephthalate and polyethylene naphthalate, polycarbonates in which 3,3' portion of the phenol component is substituted by an alkyl group for a polycarbonate of bisphenol type such as a C type polycarbonate; polycarbonates in which a geminal methyl group of bisphenol A is substituted by a long-chain alkyl group having two or more carbon atoms; polycarbonates having biphenyl or biphenyl ether skeleton; polycarbonates having a long chain alkyl skeleton such as polycaprolactone (refer to, for example, Japanese Patent Application Laid-Open (JP-A) No. 7-292095); acrylic resins; polystyrenes; and hydrogenerated butadiene.

The electrically inactive polymer represents a polymer including no chemical structure having photoconductivity such as triaryl amine structure. When these resins are used as additives in combination with a binder resin, the addition amount of these resins is preferably 50% by mass or less based on the total solid content of the charge transporting layer due to the constraint of the optical decay sensitivity.

When the electron transporting material having a low molecular weight is used, the addition amount thereof is preferably from 40 parts by mass to 200 parts by mass, more preferably 70 parts by mass to 100 parts by mass. In addition, when the charge transporting polymer is used, a material formed of copolymerization of the resin component with the charge transporting component with a ratio of 200 parts by mass or less, and preferably from about 80 parts by mass to about 150 parts by mass of the resin component based on 100 parts by mass of the charge transporting component is suitably used.

Furthermore, when the charge transporting layer contains at least two kinds of charge transporting materials, using the charge transporting materials having a small ion potential difference from each other is preferred. To be specific, one charge transporting material is prevented to be a charge trap for the other charge transporting material (s) by making the difference in the ionization potentials thereof 0.10 eV or lower.

This ionization potential relationship is applicable to the charge transporting material contained in the charge transporting layer and the curable charge transporting material described later, i.e., the ionization potential difference therebetween is preferably 0.10 eV. The ionization potential of the charge transporting material for use in the present invention is measured by a typical method using an atmosphere type ultraviolet photon analyzer (AC-1, manufactured by Riken Keiki Co., Ltd.).

To improve the sensitivity, the blend amount of the charge transporting component is preferably 70 parts by mass or more. In addition, monomers or dimers of α-phenyl stilbene compounds, benzidine compounds and butadiene compounds are suitable as the charge transporting material, and the charge transporting polymer having such a structure in the main chain or branched chain are also useful because these compounds tend to have a high charge mobility.

Specific examples of the solvent dispersion for use in preparing a coating liquid for the charge transporting layer include, but are not limited to, ketones such as methylethylketone, acetone, methylisobutyl ketone and cyclohexanone, ethers such as dioxane, tetrahydrofuran and ethylcellosolve, aromatic compounds such as toluene and xylene, halogens such as chlorobenzene and dichloromethane, and esters such as methyl acetate and butyl acetate. Among these, methylethylketone, tetrahydrofuran, and cyclohexanone are preferable in comparison with chlorobenzene, dichloromethane, toluene, and xylene since these solvents are less burden on the environment. These solvents can be used alone or in combination The charge transporting layer is formed by dissolving or dispersing a mixture or a copolymer mainly formed of the charge transporting component and the binder component followed by coating and drying of the resultant liquid.

The employed coating methods are, for example, a dip coating method, a spray coating method, a ring coating method, a roll coating method, a gravure coating method, a nozzle coating method and a screen printing method.

Since the crosslinked resin surface layer is stacked on the charge transporting layer, the layer thickness of the charge transporting layer is determined without considering the layer scraping caused by actual usage. The thickness of the charge transporting layer is preferably from 10 μm to 40 μm and more preferably from 15 μm to 30 μm to secure the desirable sensitivity and chargeability.

In addition, low molecular weight compounds such as an anti-oxidant, a plasticizer, a lubricant, an ultraviolet absorber, and/or leveling agents which are described later, can be added to the charge transporting layer. These compounds can be used alone or in combination. When such a low molecular weight compound and a leveling agent are used in combination, the sensitivity of the photoconductor tends to degrade in most cases. Therefore, the addition amount of these compounds is generally from 0.1 parts by mass to 20 parts by mass, and more preferably from 0.1 parts by mass to 10 parts by mass. The addition amount of the leveling agent is preferably from 0.001 parts by mass to 0.1 parts by mass.

—Crosslinked Resin Surface Layer—

The crosslinked resin surface layer represents a protective layer applied on the surface of a photoconductor. This protective layer is formed as a resin having a crosslinked structure due to the polycondensation reaction after the coating liquid is applied on the surface of the photoconductor. Due to the crosslinked structure, the resin layer is the strongest of all the layers of the photoconductor with regard to abrasion resistance. In addition, since the charge transporting material having crosslinking property is blended, the resin surface layer tends to have charge transportability similar to that of the charge transporting layer.

In the present invention, to improve the acceptability of solid lubricant on the surface of an photoconductor, shapes of concaves and convexes in a surface of the electrophotographic photoconductor are measured by a surface roughness/profile measuring device to obtain one-dimensional data arrays, the one-dimensional data arrays are subjected to a multiresolution analysis (MRA-1) through wavelet transformation so as to be separated into six frequency components including a highest frequency component (HHH), a second highest frequency component (HHL), a third highest frequency component (HMH), a fourth highest frequency component (HML), a fifth highest frequency component (HLH) and a lowest frequency component (HLL), the one-dimensional data arrays of the lowest frequency component (HHL) thus obtained are thinned out so that the number of data arrays is reduced to 1/10 to 1/100 thereof to thereby produce one-dimensional data arrays, the one-dimensional data arrays thus produced are subjected to a multiresolution analysis (MRA-2) through wavelet transformation so as to be separated into six frequency components including a highest frequency component (LHH), a second highest frequency component (LHL), a third highest frequency component (LMH), a fourth highest frequency component (LML), a fifth highest frequency component (LLH) and a lowest frequency component (LLL) to thereby obtain 12 frequency components in total; and a center-line average roughness (WRa) of each of the 12 frequency components satisfies a relationship (i) below, $$1-597\times WRa(HML)+238\times WRa(HLH)-95\times WRa(LHL)+84\times WRa(LMH)-79\times WRa(LML)+55\times WRa(LLH)-17\times WRa(LLL)>0 \quad (i)$$

where a center-line average roughness (WRa) of each of the frequency components is a center-line average roughness based on one-dimensional data arrays, which is obtained by a procedure in which shapes of concaves and convexes in a surface of the electrophotographic photoconductor are measured by a surface roughness/profile measuring device to obtain one-dimensional data arrays, and the one-dimensional data arrays are subjected to the multiresolution analyses (MRA-1) and (MRA-2) so as to be separated into different frequency components ranging from a highest frequency component to a lowest frequency component; and HML, HLH, LHL, LMH, LML, LLH, and LLL each represent an individual frequency band obtained when the one-dimensional data arrays are separated into frequency components having one concave-convex cycle length of from 4 μm to 25 μm, from 10 μm to 50 μm, from 53 μm to 183 μm, from 106 μm to 318 μm, from 214 μm to 551 μm, from 431 μm to 954 μm, and from 867 μm to 1,654 μm, in this order.

<Radical Polymerizable Material Component>

In the present invention, for the purpose of preventing image flow due to the use of a silica fine particle in the surface of a photoconductor, especially, it is indispensable to use trimethylolpropane triacrylate. The use of trimethylolpropane is also advantageous in improving the abrasion resistance.

The binder component having three or more functional groups preferably contains caprolactone modified dipentaerythritol hexaacrylate or dipentaerythritol hexaacrylate, thereby improving the abrasion resistance of the crosslinked layer or increasing the strength inmost cases.

As the radical polymerizable monomer having three or more functional groups without a charge transport structure, trimethylolpropane triacrylate, caprolactone modified dipentaerythritol hexaacrylate, and dipentaerythritol hexaacrylate are preferred.

These compounds are available from reagent manufacturers such as Tokyo Chemical Industry Co., Ltd. and Nippon Kayaku Co., Ltd. (KAYARAD DPCA series and KAYARAD DPHA series).

In order to accelerate the curing and stabilize the crosslinked resin surface layer, an initiator such as IRGACURE 184, etc., manufactured by Ciba Specialty Chemical K.K., can be added to the radical polymerizable monomer in an amount of from about 5% by mass to about 10% by mass based on the total solid content of the coating liquid.

The solvent dispersion for use in preparation of the crosslinked-resin-surface-layer coating liquid is preferably a solvent which sufficiently dissolves monomers. Specific examples thereof include, but are not limited to, cellosolves such as ethoxyethanol, and propylene glycols such as 1-methoxy-2-propanol in addition to the ethers, the aromatic compounds, the halogens and the esters specified above. Among these, methylethylketone, tetrahydrofuran, cyclohexanone and 1-methoxy-2-propanol are preferable in comparison with chlorobenzene, dichloromethane, toluene, and xylene since these are less burden on the environment. These solvents can be used alone or in combination.

The method of coating the crosslinked-resin-surface-layer coating liquid are, for example, a dip coating method, a spray coating method, a ring coating method, a roll coating method, a gravure coating method, a nozzle coating method and a screen printing method. Since the coating liquid does not have a long pot life in most cases, the method which can cover the required coating in a small amount of coating liquid is advantageous in light of the care for the environment and the cost. Among the methods specified above, the spray coating method and the ring coating method are preferred.

When the crosslinked resin surface layer is formed, a high pressure mercury lamp having an oscillation wavelength mainly in the ultraviolet range or an ultraviolet irradiation light source such as a metal halide lamp can be used. In addition, a visible radiation light source can be also selected according to the absorption wavelength of a radical polymeric compound and an optical polymerization initiator. The irradiation amount is preferably from 50 mW/cm$^2$ to 1,000 mW/cm$^2$. When the irradiation amount is smaller than 50 mW/cm$^2$, it tends to take a long time to complete curing reaction. To the contrary, when the irradiation amount is greater than 1,000 mW/cm$^2$, the reaction tends to not uniformly proceed and thus the surface of the crosslinked resin surface layer locally wrinkles or a great number of non-reacting residual groups and reaction terminated ends are created. Furthermore, the internal stress increases due to rapid cross-linking, which may cause cracking and peeling of the layer.

If desired, low molecular weight compounds such as the anti-oxidant, the plasticizer, the lubricant, the ultraviolet absorber and/or leveling agents specified in the description of the charge generation layer, and the polymers specified in the description of the charge transport layer can be added to the crosslinked resin surface layer. These compounds can be used alone or in combination. When such a low molecular weight compound and a leveling agent are used in combination, the sensitivity of the photoconductor tends to degrade in most cases. Therefore, the addition amount of these compounds is generally from 0.1% by mass to 20% by mass and preferably from 0.1% by mass to 10% by mass. The addition amount of the leveling agent is suitably from about 0.1% by mass to about 5% by mass based on the total solid content of the coating liquid.

The thickness of the crosslinked resin surface layer is preferably from 3 μm to 15 μm. The lower limit is calculated according to the degree of effect with regard to the layer forming cost, and the upper limit is set by the electrostatic characteristics such as charging stability and optical decay sensitivity and the uniformity of the layer quality.

—Formation of Rough Surface—

In the present invention, it is important for a photoconductor to satisfy the relationship (i) described above. Therefore, the surface of a photoconductor is required to have a rough surface. As the specific method therefor, reagents, which are expected to control the surface configuration of a photoconductor, can be added into the coating liquid. Specific examples of the reagents to be added into the crosslinked-resin-surface layer include, but are not limited to, a filler, a sol-gel coating, a polymer blend containing various resins each having a different glass transition temperature, an organic fine particle, a foaming agent, and a large amount of silicone oil. In addition, to control the conditions for forming the surface layer, for example, a large amount of fluid may be added into the coating liquid, and liquid reagents each having a different boiling point may be added thereto. A method is also considered in which an uncured wet film immediately after coating with a crosslinked-resin-surface-layer coating liquid is sprayed with water. Besides, a method is considered in which a crosslinked resin film is cured, followed by polishing the surface of the film with sandpaper, such as sandblasting or film-lapping process, as additional processing.

As the provision of a rough surface to a photoconductor, various methods are available, and thus the relationship (i) is not always satisfied with ease. In some cases, two or more methods should be combined. The following specific methods were found to be effective as a method by which the relationship (i) can be satisfied from among the above-mentioned methods. Specifically, a method of adding a large amount of water into the crosslinked-resin-surface-layer coating liquid, and a method of spraying a wet film of the crosslinked resin with water.

The method is not limited to the above methods. However, for example, an uncured wet film immediately after coating with a crosslinked-resin-surface-layer coating liquid is sprayed with water, and then cured, thereby a photoconductor satisfying the above-mentioned relationship (i) can be relatively easily produced in an assured manner.

Alternatively, a crosslinked-resin-surface-layer coating liquid containing water in an amount of 5% by mass to 15% by mass with respect to the mass of the coating liquid is prepared, and the coating liquid is applied onto a photoconductor to form a surface layer, thereby a photoconductor satisfying the above-mentioned relationship (i) can be relatively easily produced in an assured manner.

Figure 40:
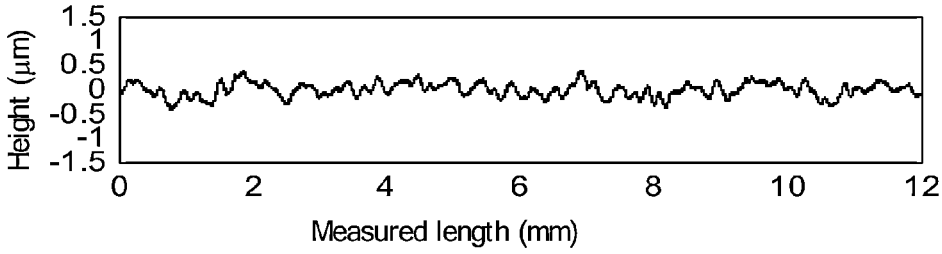
FIG. 40 is an exemplary diagram of a surface configuration of a photoconductor.

The provision of a rough surface to a photoconductor can be achieved by various methods, for example, by adding a chemical product capable of controlling the surface configuration, such as a filler, into the surface layer coating liquid, by trying to improve production conditions, and/or by subjecting the photoconductor surface to mechanical processing. However, it has not been determinately proved that what a surface configuration would be formed by these methods. For example, FIG. 40 illustrates a surface configuration of a photoconductor in the case where a filler is blended in the surface layer coating liquid. However, the surface of the photoconductor has a small shape factor of −0.09, and it cannot be said that the photoconductor has a surface configuration excellent in adhesion to solid lubricant.

Figure 41:
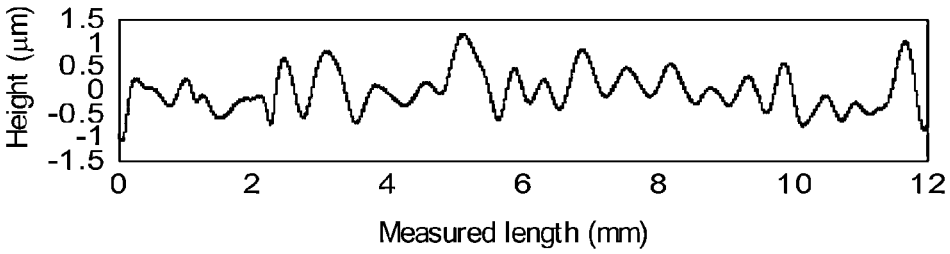
FIG. 41 is another exemplary diagram of a surface configuration of a photoconductor.
Figure 42:
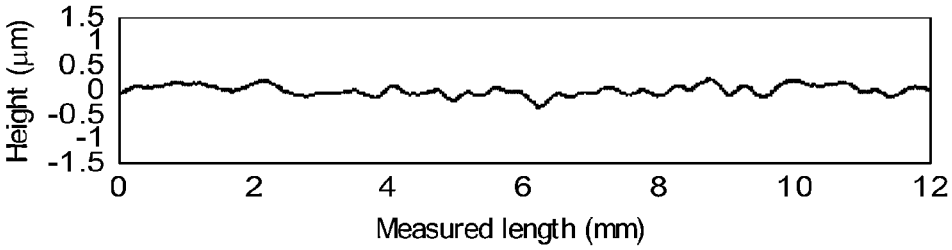
FIG. 42 is still another exemplary diagram of a surface configuration of a photoconductor.

The present inventors made attempts to form a variety of rough surfaces on conventional organic photoconductors and obtained specific surface configurations excellent in adhesion to solid lubricant, by the above two methods. For example, a surface configuration illustrated in FIG. 41 was obtained by spraying a wet film with water. In the surface, concaves and convexes in millimeter-size are observed, although the surface is smooth and curved. The surface configuration was obtained only after a plurality of conditions for selecting materials and methods. The shape factor of this cross-sectional curve, obtained by wavelet transformation, is 3.47, which is significantly high. In addition, the surface configuration illustrated in FIG. 42 was obtained by adding ion-exchanged water to a crosslinked-resin-surface-layer coating liquid. Similarly to the above, the shape factor of this cross-sectional curve, obtained by wavelet transformation, is higher than that of a conventional photoconductor, i.e., 1.69. Such a photoconductor having a high shape factor has not yet been found out. In addition, the photoconductors have a peculiar surface configuration.

(Image Forming Apparatus)

Hereinafter, an image forming apparatus for use in the present invention will be described with reference to the drawings. The after-mentioned unit for applying a solid lubricant to the surface of a photoconductor is attached to the image forming apparatus of the present invention. For simplification, this unit is separately described after the image forming apparatus is described.

Figure 1:
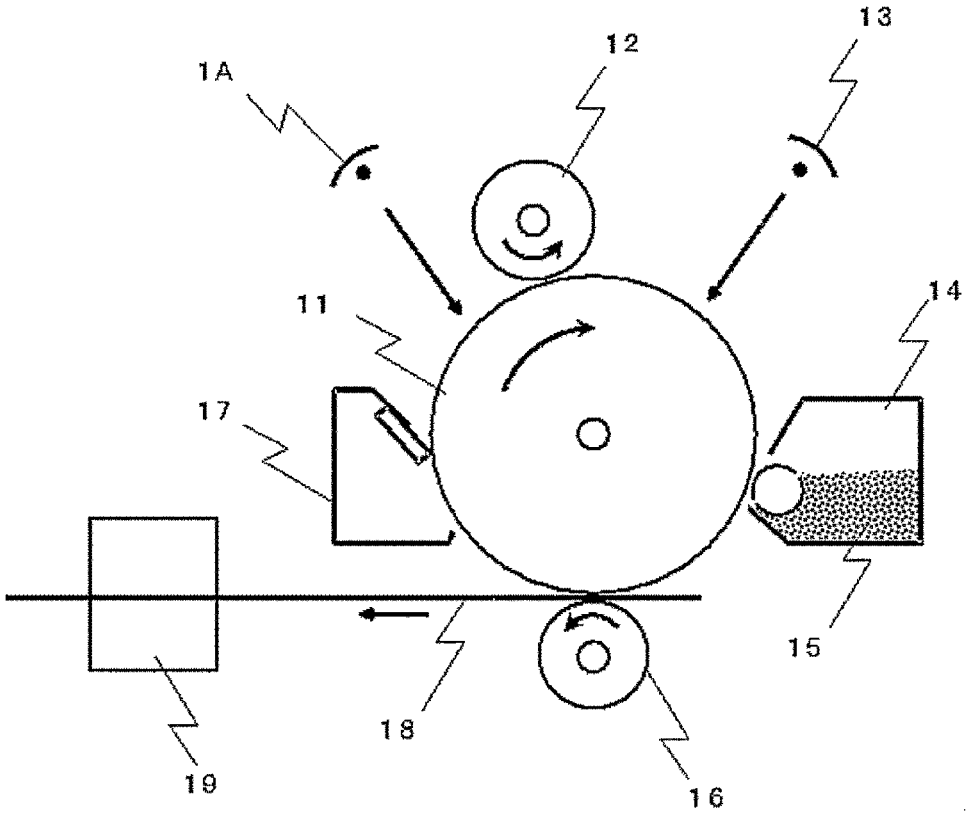
FIG. 1 is a cross-sectional diagram schematically illustrating an example of an image forming apparatus of the present invention.

FIG. 1 is a schematic diagram illustrating the image forming apparatus of the present invention and the variant examples described later are also within the scope of the present invention.

A photoconductor 11 illustrated in FIG. 1 is an electrophotographic photoconductor in which a crosslinked resin surface layer is stacked. The photoconductor 11 has a drum form but can also employ a sheet form or an endless belt form.

Any known charging unit such as a corotron, a scorotron, a solid state charger, and a charging roller can be employed as the charging unit 12. A charging unit which contacts or is provided in the vicinity of the photoconductor 11 is preferably used as the charging unit 12 in terms of the reduction of the consumption energy. Among these, a charging mechanism provided in the vicinity of the photoconductor 11 with a suitable gap between the photoconductor 11 and the surface of the charging unit 12 is preferable to prevent contamination of the charging unit 12. Generally, the charger specified above can be used as a transfer unit 16. A combination of a transfer charger and a separation charger is effectively used.

As the light source for use in an exposing unit 13 and a charge eliminating unit 1A, typical luminescent materials, for example, a fluorescent lamp, a tungsten lamp, a halogen lamp, a mercury lamp, a sodium lamp, a luminescent diode (LED), a semi-conductor laser (LD) and electroluminescence (EL) can be used. In addition, various kinds of filters, for example, a sharp cut filter, a band pass filter, an infrared cut filter, a dichroic filter, a coherency filter and a color conversion filter can be used to expose the photoconductor 11 to light having only a desired wavelength.

Toner 15 for use in developing a latent electrostatic image on the photoconductor 11 by a developing unit 14 is transferred to a recording medium 18 such as printing paper and transparent sheet. However, some of the toner 15 remains on the photoconductor 11 untransferred. Such residual toner remaining on the photoconductor 11 is removed therefrom by a cleaning unit 17. The cleaning unit 17 can employ a rubber cleaning blade, a brush such as a fur brush and a magnet fur brush, etc.

When the photoconductor 11 is positively (negatively) charged followed by exposure to light according to obtained data information, a positive (negative) latent electrostatic image is formed on the photoconductor 11. When the latent electrostatic image is developed with negatively (positively) charged toner (electric detecting particulates), a positive image is obtained. When the latent electrostatic image is developed with a positively (negatively) charged toner, a negative image is obtained. A typically used method is employed for the developing unit 14 and a charge eliminating unit as well.

Figure 2:
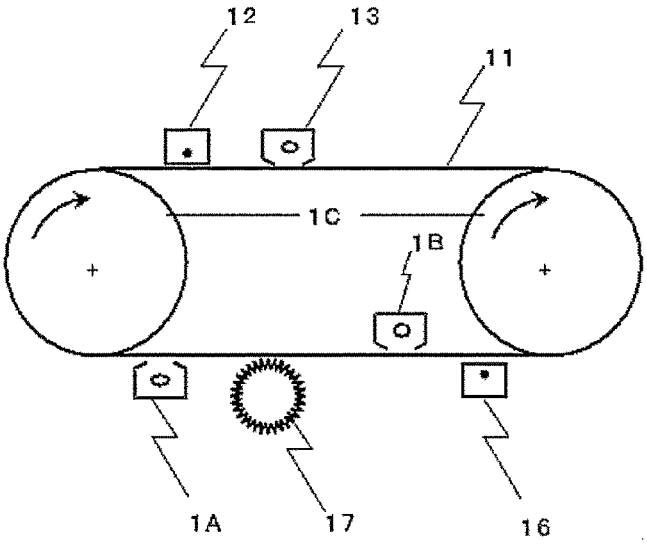
FIG. 2 is a cross-sectional diagram schematically illustrating another example of an image forming apparatus of the present invention.

FIG. 2 is a diagram illustrating another example of the electrophotographic process according to the present invention. In FIG. 2, the photoconductor 11 has a belt form but can also employ a drum form, a sheet form or an endless belt form. The photoconductor 11 is driven by a driving unit 1C and charged by the charging unit 12, exposed to light by the exposing unit 13 according to obtained image information, developed (not shown), transferred by the transfer unit 16, preliminarily exposed to light before cleaning by a pre-cleaning-exposing unit 1B, cleaned by the cleaning unit 17, and discharged by the charge eliminating unit 1A and these processes are repeated. In FIG. 2, the photoconductor is preliminarily exposed to light before cleaning from the side of the support thereof. The support is translucent in this case.

The electrophotographic processes described above are illustration only, and other embodiments are applicable to the image forming apparatus of the present invention. For example, in FIG. 2, the photoconductor 11 is preliminarily exposed to light before cleaning from the side of the support thereof but can be exposed to light from the side of the photosensitive layer of the photoconductor 11. In addition, image exposure and irradiation for discharging can be performed from the side of the support. With regard to the light irradiation processes, image exposure, preliminary exposure before cleaning and irradiation for discharging are illustrated. Other irradiation processes can be also employed, for example, exposure before transfer, preliminary exposure before image exposure, and other known irradiation processes can be employed to expose the photoconductor 11 to light.

Figure 3:
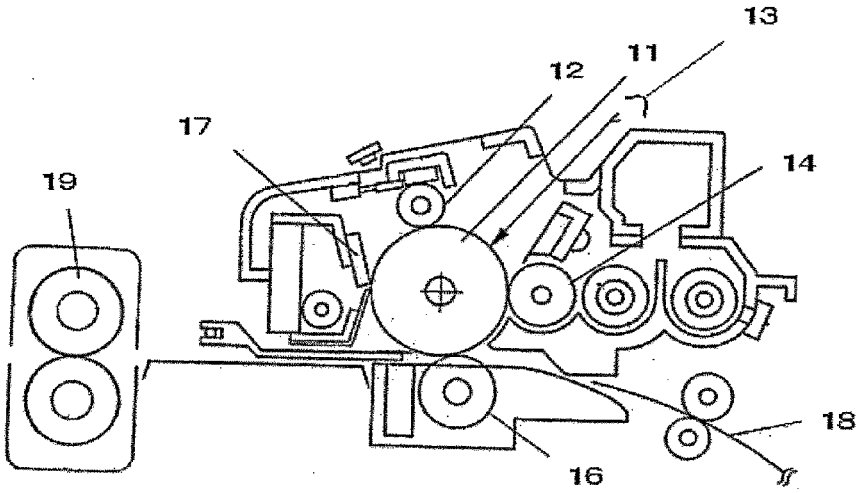
FIG. 3 is a cross-sectional diagram schematically illustrating still another example of an image forming apparatus of the present invention.

In addition, the image forming unit as illustrated above can be integrated into a photocopier, a facsimile machine, or a printer in a fixed manner or a form of a process cartridge. The process cartridge has various kinds of forms and FIG. 3 is a diagram illustrating a typical example of the process cartridge. The photoconductor 11 employs a drum form in FIG. 3 but can also employ a sheet form or an endless belt form.

In FIG. 3, reference numeral 12 denotes a charging unit, reference numeral 13 denotes an exposing unit, reference numeral 14 denotes a developing unit, reference numeral 16 denotes a transfer unit, reference numeral 17 denotes a cleaning unit, reference numeral 18 denotes a recording medium and reference numeral 19 denotes a fixing unit.

Figure 4:
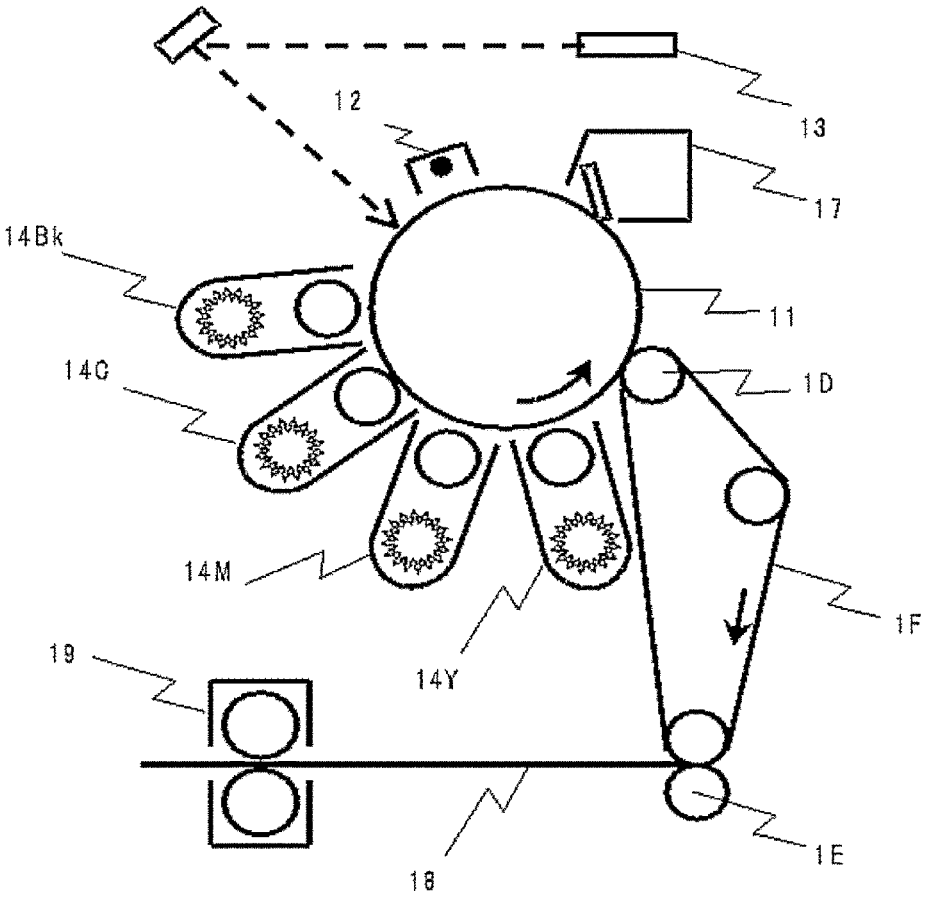
FIG. 4 is a cross-sectional diagram schematically illustrating still yet another example of an image forming apparatus of the present invention.

FIG. 4 is a diagram illustrating another example of the image forming apparatus of the present invention. The image forming apparatus includes the photoconductor 11 around which the charging unit 12, the exposing unit 13, the developing units (14Bk, 14C, 14M and 14Y) for respective color toners of black (Bk), cyan (C), magenta (M), and yellow (Y), an intermediate transfer belt 1F and the cleaning unit 17 are provided. The letters of Bk, C, M and Y represent correspondingly the color names mentioned above and are suitably omitted occasionally. The photoconductor 11 is an electrophotographic photoconductor having a crosslinked resin surface layer. Each color developing unit (14Bk, 14C, 14M and 14Y) is independently controllable and thus it is only the developing units required for image formation that are driven. A toner image formed on the photoconductor 11 is transferred to the intermediate transfer belt 1F by a primary transfer unit 1D located inside the intermediate transfer belt 1F. The primary transfer unit 1D is detachably attached to the photoconductor 11 and brings the intermediate transfer belt 1F into contact with the photoconductor 11 only during image transfer. Each color toner image is sequentially formed and superimposed on the intermediate transfer belt 1F. The superimposed toner image is transferred to the recording medium 18 at one time by a secondary transfer unit 1E and thereafter fixed thereon by a fixing unit 19 to form an image. The secondary transfer unit 1E is also situated in a detachably attached manner as to the intermediate transfer belt 1F and is brought into contact therewith only during image transfer.

In an image forming apparatus employing a transfer drum system, each color toner image is sequentially transferred to a transfer medium electrostatically attached to the transfer drum. Therefore, using thick paper is unsuitable. However, in an image forming apparatus having an intermediate transfer system as illustrated in FIG. 4, each color toner image is superimposed on the intermediate transfer member 1F. Therefore, there is no limit with regard to the kind of transfer media. This intermediate transfer system can be applied to not only the image forming apparatus illustrated in FIG. 4 but also to the image forming apparatuses illustrated in FIGS. 1, 2 and 3 and the after-illustrated image forming apparatus of FIG. 5 (specifically illustrated in FIG. 6).

Figure 5:
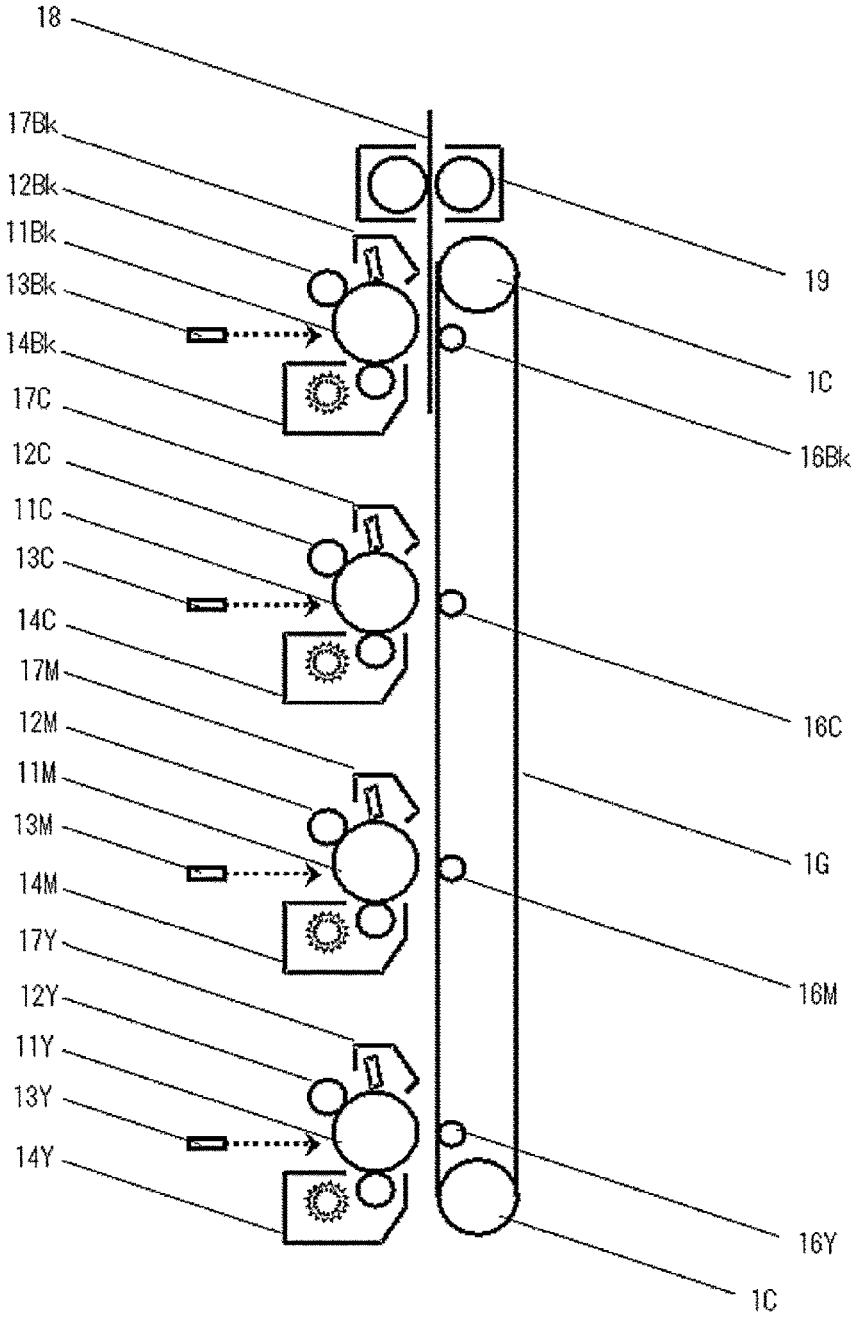
FIG. 5 is a cross-sectional diagram schematically illustrating still yet another example of an image forming apparatus of the present invention.
Figure 6:
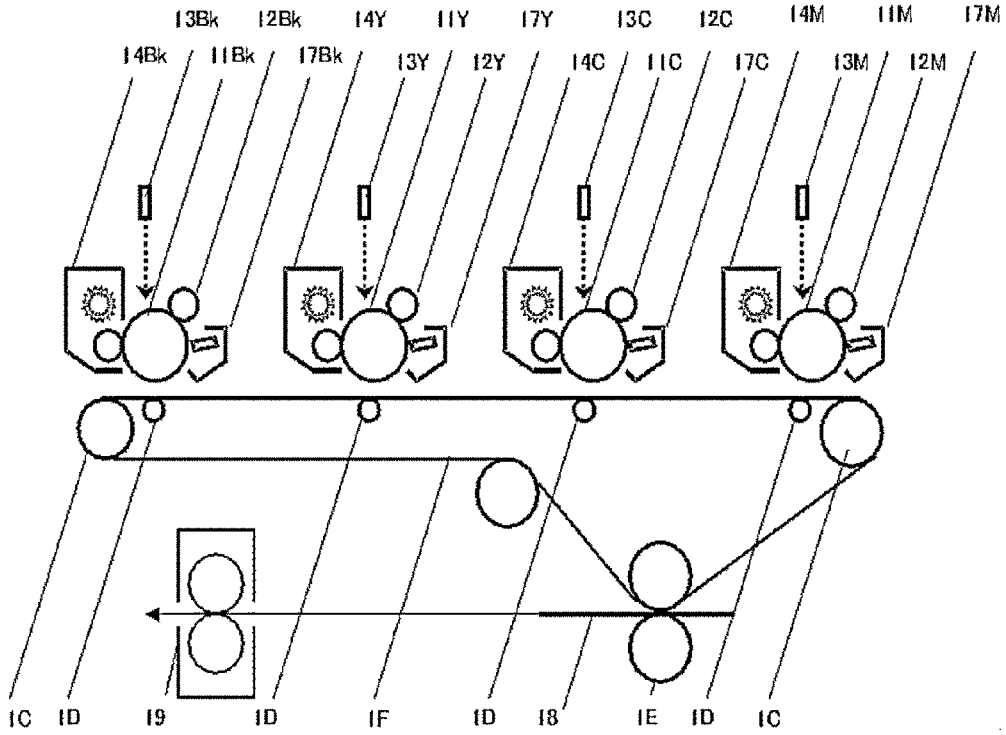
FIG. 6 is a cross-sectional diagram schematically illustrating still yet another example of an image forming apparatus of the present invention.

FIG. 6 is an example of an image forming apparatus where an intermediate transfer unit is additionally mounted to the image forming apparatus illustrated in FIG. 5. By addition of an intermediate transfer member, it is possible to enable applicability to a wide variety of papers and to obtain an effect of preventing abnormal images that would be caused by paper dust from print papers.

FIG. 5 is a diagram illustrating another example of the image forming apparatus of the present invention. This image forming apparatus uses four colors of yellow (Y), magenta (M), cyan (C) and black (Bk), and an image formation portion is provided for each color. In addition, photoconductors 11Y, 11M, 11C and 11Bk are provided for each color. The photoconductor 11 for use in the image forming apparatus is an electrophotographic photoconductor having a crosslinked resin surface layer. The charging unit 12, the exposing unit 13, the developing unit 14, the cleaning unit 17, etc. are provided around each photoconductor (11Y, 11M, 11C and 11Bk). In addition, a conveyance transfer belt 1G is suspended over the driving force 1C as a transfer material bearing member, which is detachably attached at respective transfer positions of the photoconductors 11Y, 11M, 11C and 11Bk arranged along a straight line. The transfer unit 16 is provided at the transfer position opposing the photoconductors 11Y, 11M, 11C and 11Bk with the conveyance transfer belt 1G therebetween.

The image forming apparatus having a tandem system as illustrated in FIG. 5 has photoconductors 11Y, 11M, 11C and 11Bk for respective colors and each color toner image is sequentially transferred to the recording medium 18 borne on the conveyance transfer belt 1G. Therefore, this image forming apparatus can output full color images at an extremely higher speed than a full color image forming apparatus having only one photoconductor.

(Supply of Solid Lubricant)

Figure 10:
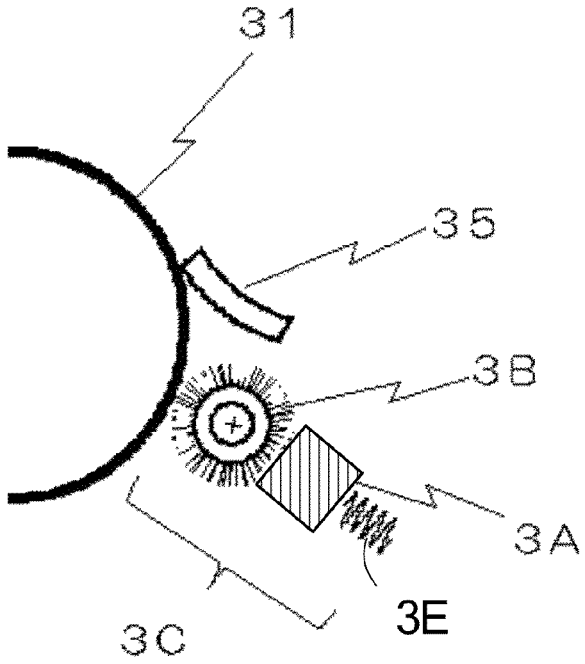
FIG. 10 is a cross-sectional diagram schematically illustrating a unit for supplying a photoconductor with a solid lubricant.

In the present invention, a lubricant application device 3C is provided to each of the image forming apparatuses described above as a lubricant supplying unit which supplies a lubricant 3A to a surface of a photoconductor 31, as illustrated in FIG. 10. This lubricant application device 3C includes a fur brush 3B as an applicator, a solid lubricant 3A, and a pressure spring 3E to press the solid lubricant 3A toward the fur brush 3B. The solid lubricant 3A is a solid lubricant molded to have a bar form. The front end of the fur brush 3B is in contact with the surface of a photoconductor 31 and rotates around its axis to take up, hold and convey the solid lubricant 3A to the contact position with the surface of the photoconductor 31 to apply the solid lubricant 3A thereto. Here, in the present invention, as a condition for exhibiting excellent adhesion to solid lubricant, it is important for the photoconductor 31 to satisfy a linear velocity condition that concaves and convexes of 250 to 1,000 in the surface of the photoconductor 31 pass the coating blade per second.

Furthermore, the solid lubricant 3A is scraped and reduced by the fur brush 3B over time but the pressure spring 3E constantly presses the solid lubricant 3A to the side of the fur brush 3B with a predetermined pressure to keep the solid lubricant 3A in contact with the surface of the photoconductor 31. Thereby, when the solid lubricant 3A is diminished to a minute amount, the fur brush can uniformly and constantly take up the solid lubricant 3A to the fur brush 3B.

In addition, a solid lubricant fixing unit can be provided to improve the fixability of the solid lubricant attached to the surface of the photoconductor 31. For example, a device having a board such as a cleaning blade can be provided in a trailing manner or a device such as a rubber roll pressed against a photoconductor can be used.

Specific examples of the solid lubricant 3A include, but are not limited to, aliphatic metal salts such as lead oleate, zinc oleate, copper oleate, zinc stearate, cobalt stearate, iron stearate, copper stearate, zinc palmitate, copper palmitate, and zinc linolenate, and fluorine containing resins such as polytetrafluoroethylene, polychlorotrifluoroethylene, polyvinylidene-fluoride, polytrifluoro chloroethylene, dichloro difluoroethylene, copolymers of tetrafluoroethylene and ethylene, and copolymers of tetrafluoroethylene and oxafluoropropylene. Among these, metal salts of stearate are preferred and zinc stearate is more preferred to reduce the friction coefficient of the photoconductor 31.

EXAMPLES

Hereinafter, the present invention will be further described in detail with reference to Examples, which however shall not be construed as limiting the present invention.

First, the evaluation tests and measuring methods employed in Examples and Comparative Examples will be described.

(1) Measurement of Surface Configuration of Photoconductor

A pick-up, E-DT-S02A, was attached to a surface of an electrophotographic photoconductor, and the surface of the photoconductor was measured, at four points for one photoconductor, by a surface roughness/profile measuring device (SURFCOM 1400D manufactured by Tokyo Seimitsu Co., Ltd.) under the conditions: a measurement length: 12 mm; and a linear velocity: 0.06 mm/s. In each measurement, text data of a curved line of a photoconductor was recorded, and the data was subjected to multiresolution analysis using wavelet transformation. An average value of the surface roughness parameters for the four points obtained from the analysis was defined as a WRa of each frequency component.

(2) Test on Acceptability of Solid Lubricant

Figure 9:
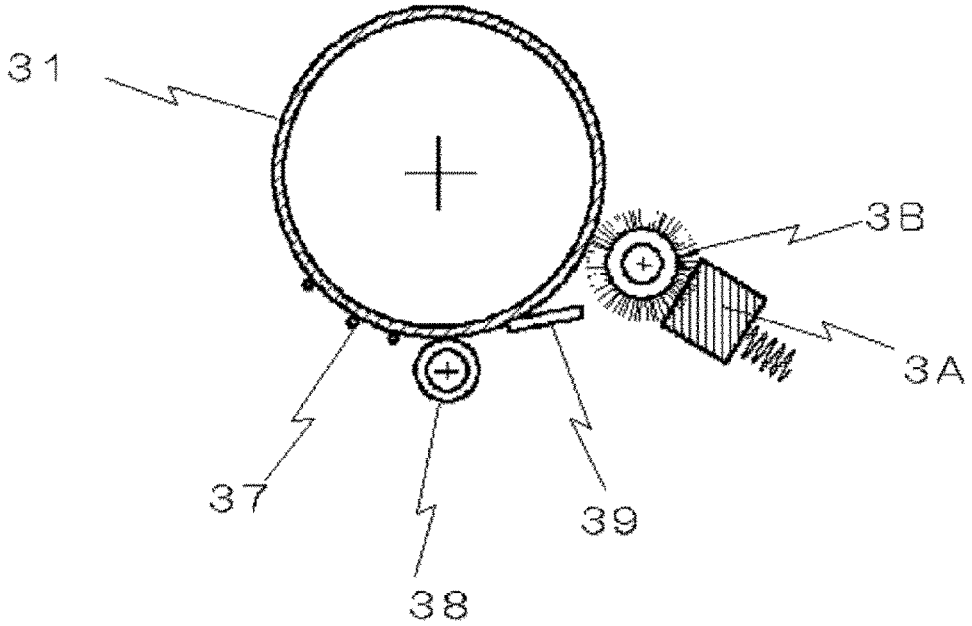
FIG. 9 is an exemplary diagram illustrating a layout of the circumference of a photoconductor when the acceptability of solid lubricant on the surface of the photoconductor is measured.

The acceptability of solid lubricant on the surface of a photoconductor was evaluated by using a machine remodeled based on a color printer (IPSIO SP C811, manufactured by Ricoh Company Ltd.). The color printer was remodeled in such a manner that some of the units around the photoconductor were removed to have the structure illustrated in FIG. 9. To have the same conditions for the tests, unused and proper products of a solid lubricant bar of zinc stearate, a solid lubricant application brush, and a solid lubricant application blade were attached to a complex unit of a photoconductor unit and a developing unit (for simplification, called "PD unit"). The color printer having the PD unit was subjected to free running operation for 30 minutes so that the application brush was impregnated with the solid lubricant at the same level. In addition, the developer in the developing unit was completely removed.

Figure 22:
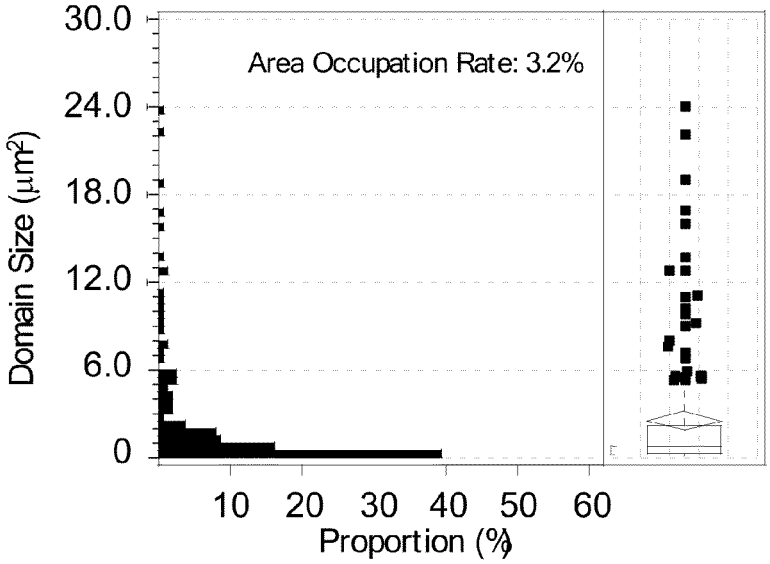
FIG. 22 is a graph illustrating the results of a domain size of zinc stearate and an area occupation rate of zinc stearate.

The photoconductors to be evaluated were observed for the surface thereof by a laser microscope (VK-8500, manufactured by Keyence Corporation). Next, the photoconductor was attached to the PD unit followed by the free running operation in the color printer for 15 seconds. After this 15 second running, the photoconductor was collected and the surface thereof was observed with the laser microscope. According to the obtained image, the zinc stearate remaining on the photoconductor was distinguished from the surface of the photoconductor and the domain size and the area occupation rate of the solid lubricant were calculated by using image analysis software (IMAGE PROPLUS Ver. 3.0, manufactured by MediaCybernetics Co., Ltd.) with Measure and Count commands. FIG. 22 is a graph illustrating an example of the measurement results. The acceptability of solid lubricant on the surface of a photoconductor was evaluated based on the area ratio measured immediately after the free running operation of 15 seconds.

(3) Evaluation of Image

A halftone pattern A half tone pattern having 4 dots×4 dots in 8×8 matrix with a pixel density of 600 dpi (dot per inch)×600 dpi and a white-paper pattern were continuously alternately printed (5 sheets for each pattern). Thereafter, the sheets of white pattern were visually observed to detect the presence or absence of background smear, and evaluated according to the following criteria.

[Evaluation Criteria]

5: Extremely excellent
4: Excellent
3: No problem
2: Dull in color, but no problem in practical use
1: Dull in color Example 1

On each of an aluminum drum having a wall thickness of 0.8 mm, a length of 340 mm and an external diameter of 40 mm and another aluminum drum having a wall thickness of 0.8 mm, a length of 340 mm and an external diameter of 30 mm, an undercoat layer coating liquid, a charge generating layer coating liquid, a charge transporting layer coating liquid each containing the following composition were applied and dried in this order, thereby forming an undercoat layer having a thickness of 3.5 μm, a charge generating layer having a thickness of 0.2 μm and a charge transporting layer having a thickness of 24 μm.

The charge transporting layer was spray-coated with a crosslinked-resin-surface-layer coating liquid containing the following composition. After the coating liquid was set to touch for five minutes, ion exchanged water was sprayed over a resulting wet film under the conditions, a rotation speed of drum: 40 rpm, a spray speed: 1.4 mm/s, a spray pressure: 1.0 kgf/cm$^2$, and the number of spray treatments: once. Then, the resulting film was further set to touch for 10 minutes. Subsequently, the drum was placed at a distance of 120 mm from a UV curing lamp, and the drum was subjected to UV curing while being rotated. The illumination intensity of the UV curing lamp measured at that position was 550 mW/cm$^2$ (a value measured by an integrated light intensity measurement device UIT-150, manufactured by Ushio Inc). In addition, the rotation speed of the drum was set to 25 rpm. In the UV curing treatment, the wet film was cured continuously for four minutes while circulating water of 30° C. inside the aluminum drum, followed by heat drying at 130° C. for 30 minutes. As a result, a crosslinked resin surface layer of 6 μm in thickness was formed, thereby producing an electrophotographic photoconductor.

[Undercoat Layer Coating Liquid]

| | |
|---|---|
| alkyd resin solution (BECKOLITE M6401-50, produced by Dainippon Ink Chemical Industries Co., Ltd.) | 12 parts by mass |
| melamine resin solution (SUPER BECKAMINE G-821-60, produced by Dainippon Ink Chemical Industries Co., Ltd.) | 8.0 parts by mass |
| titanium oxide (CR-EL, produced by ISHIHARA SANGYO KAISHA LTD.) | 40 parts by mass |
| methylethylketone | 200 parts by mass |

[Charge Generating Layer Coating Liquid]

bis-azo pigment represented by the following structural formula (produced by Ricoh Company Ltd.) 5.0 parts by mass

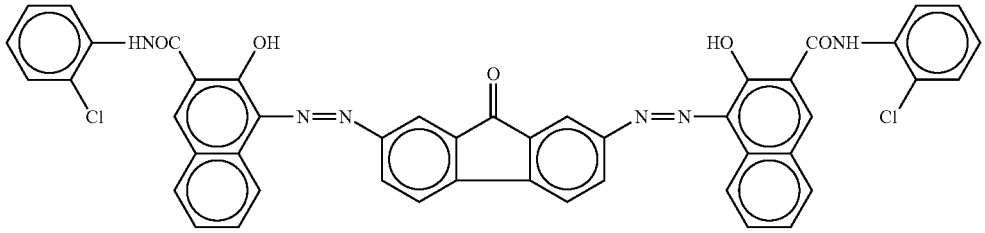

| | |
|---|---|
| polyvinyl butyral (XYHL, produced by UCC) | 1 part by mass |
| cyclohexanone | 200 parts by mass |
| methylethylketone | 80 parts by mass |

[Charge Transporting Layer Coating Liquid]

| | |
|---|---|
| Z-type polycarbonate (PANLITE TS-2050, produced by Teijin Chemicals Ltd.) | 10 parts by mass |
| low-molecular-weight charge transporting material represented by the following structural formula | 7.0 parts by mass |

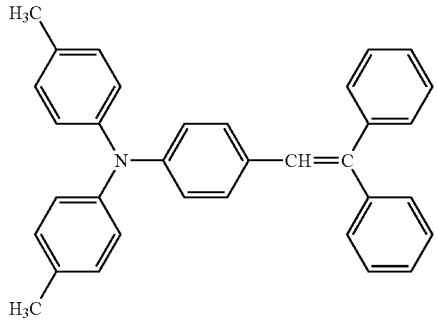

| | |
|---|---|
| tetrahydrofuran | 100 parts by mass |
| tetrahydrofuran solution containing 1% silicone oil (KF50-100CS, produced by Shin-Etsu Chemical Co., Ltd.) | 1 part by mass |

[Crosslinked-Resin-Surface-Layer Coating Liquid]

| | |
|---|---|
| crosslinked charge transporting material represented by the following structural formula | 6.0 parts by mass |

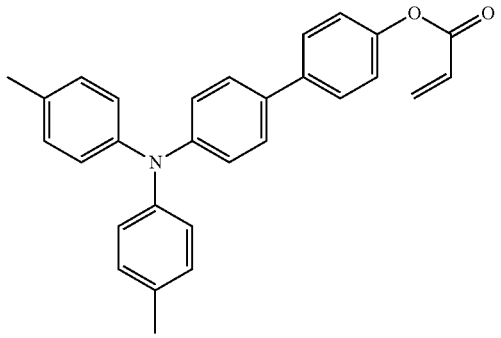

| | |
|---|---|
| trimethylolpropane triacrylate (KAYARAD TMPTA, produced by Nippon Kayaku Co., Ltd.) | 3.0 parts by mass |
| 50% diluent (THF) of caprolactone-modified dipentaerythritol hexaacrylate (KAYARAD DPCA-120, produced by Nippon Kayaku Co., Ltd.) | 6 parts by mass |
| 5% diluent (THF) of a mixture of an acrylic group-containing polyester-modified polydimethyl siloxane and propoxy-modified-2-neopentyl glycol diacrylate (BYK-UV3570, produced by BYK Chemie Gmbh.) | .0.24 parts by mass |
| 1-hydroxycyclohexyl phenylketone (IRGACURE 184, produced by Chiba Specialty Chemicals K.K.) | 0.6 parts by mass |
| tris(2,4-di-tert-butylphenyl)phosphite | 0.12 parts by mass |
| tetrahydrofuran | 68.92 parts by mass |

Example 2

An electrophotographic photoconductor was produced in the same manner as in Example 1, except that the conditions for water spraying on a wet film were changed to rotation speed of drum: 100 rpm, spray speed: 1.4 mm/s, a spray pressure: 2.0 kgf/cm$^2$, and the number of spray treatments: twice.

Example 3

An electrophotographic photoconductor was produced in the same manner as in Example 1, except that the conditions for water spraying on a wet film were changed to rotation speed of drum: 160 rpm, spray speed: 1.4 mm/s, a spray pressure: 3.0 kgf/cm$^2$, and the number of spray treatments: three times.

Example 4

An electrophotographic photoconductor was produced in the same manner as in Example 1, except that the conditions for water spraying on a wet film were changed to rotation speed of drum: 160 rpm, spray speed: 3.7 mm/s, a spray pressure: 2.0 kgf/cm$^2$, and the number of spray treatments: once.

Example 5

An electrophotographic photoconductor was produced in the same manner as in Example 1, except that the conditions for water spraying on a wet film were changed to rotation speed of drum: 40 rpm, spray speed: 5.1 mm/s, a spray pressure: 2.0 kgf/cm$^2$, and the number of spray treatments: three times.

Example 6

On each of an aluminum drum having a wall thickness of 0.8 mm, a length of 340 mm and an external diameter of 40 mm and another aluminum drum having a wall thickness of 0.8 mm, a length of 340 mm and an external diameter of 30 mm, an undercoat layer coating liquid, a charge generating layer coating liquid, a charge transporting layer coating liquid each containing the following composition were applied and dried in this order, thereby forming an undercoat layer having a thickness of 3.5 μm, a charge generating layer having a thickness of 0.2 μm and a charge transporting layer having a thickness of 24 μm.

Next, the charge transporting layer was spray-coated with a crosslinked-resin-surface-layer coating liquid containing the following composition. The coating liquid was set to touch for 15 minutes. Subsequently, the drum was placed at a distance of 120 mm from a UV curing lamp, and the drum was subjected to UV curing while being rotated. The illumination intensity of the UV curing lamp measured at that position was 550 mW/cm$^2$ (a value measured by an integrated light intensity measurement device UIT-150, manufactured by Ushio Inc). In addition, the rotation speed of the drum was set to 25 rpm. In the UV curing treatment, the wet film was cured continuously for four minutes while circulating water of 30° C. inside the aluminum drum, followed by heat drying at 130° C. for 30 minutes. As a result, a crosslinked resin surface layer of 6 μm in thickness was formed, thereby producing an electrophotographic photoconductor.

[Undercoat Layer Coating Liquid]

| | |
|---|---|
| alkyd resin solution (BECKOLITE M6401-50, produced by Dainippon Ink Chemical Industries Co., Ltd.) | 12 parts by mass |
| melamine resin solution (SUPER BECKAMINE G-821-60, produced by Dainippon Ink Chemical Industries Co., Ltd.) | 8.0 parts by mass |
| titanium oxide (CR-EL, produced by ISHIHARA SANGYO KAISHA LTD.) | 40 parts by mass |
| methylethylketone | 200 parts by mass |

[Charge Generating Layer Coating Liquid]

bis-azo pigment represented by the following structural formula (produced by Ricoh Company Ltd.) 5.0 parts by mass

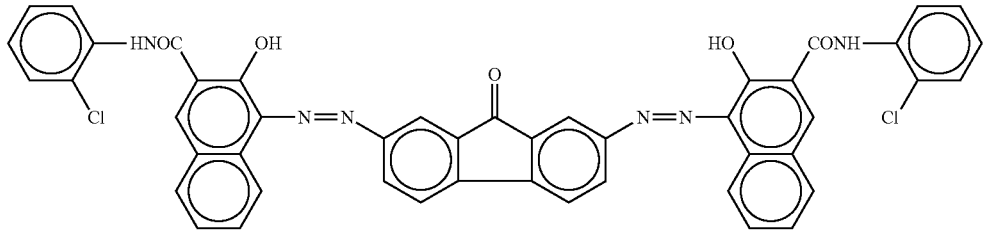

1.0 part by mass

| | |
|---|---|
| polyvinyl butyral (XYHL, produced by UCC) | |
| cyclohexanone | 200 parts by mass |
| methylethylketone | 80 parts by mass |

[Charge Transporting Layer Coating Liquid]

| | |
|---|---|
| Z-type polycarbonate (PANLITE TS-2050, produced by Teijin Chemicals Ltd.) | 10 parts by mass |
| low-molecular-weight charge transporting material represented by the following structural formula | 7.0 parts by mass |

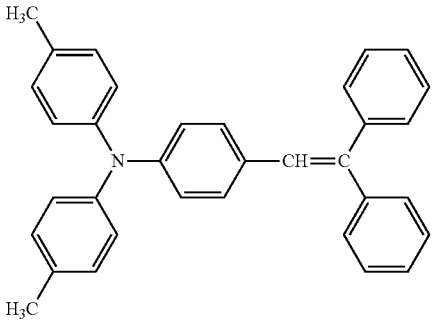

| | |
|---|---|
| tetrahydrofuran | 100 parts by mass |
| tetrahydrofuran solution containing 1% silicone oil (KF50-100CS, produced by Shin-Etsu Chemical Co., Ltd.) | 1 part by mass |

[Crosslinked-Resin-Surface-Layer Coating Liquid]

| | |
|---|---|
| crosslinked charge transporting material represented by the following structural formula | 6.0 parts by mass |

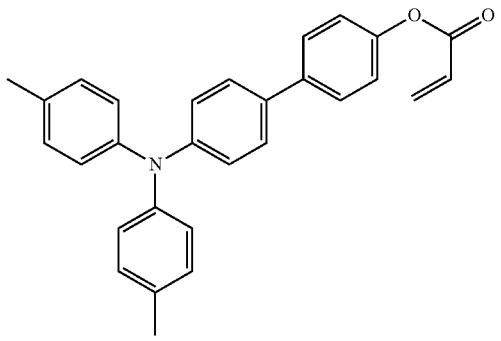

| | |
|---|---|
| trimethylolpropane triacrylate (KAYARAD TMPTA, produced by Nippon Kayaku Co., Ltd.) | 3.0 parts by mass |
| 50% diluent (THF) of caprolactone-modified dipentaerythritol hexaacrylate (KAYARAD DPCA-120, produced by Nippon Kayaku Co., Ltd.) | 6.0 parts by mass |
| 5% diluent (THF) of a mixture of an acrylic group-containing polyester-modified polydimethyl siloxane and propoxy-modified-2-neopentyl glycol diacrylate (BYK-UV3570, produced by BYK Chemie Gmbh.) | .0.24 parts by mass |
| 1-hydroxycyclohexyl phenylketone (IRGACURE 184, produced by Chiba Specialty Chemicals K.K.) | 0.60 parts by mass |
| tris(2,4-di-tert-butylphenyl)phosphite | 0.12 parts by mass |
| tetrahydrofuran | 68.9 parts by mass |
| ion exchanged water | 4.2 parts by mass |

Example 7

An electrophotographic photoconductor was produced in the same manner as in Example 6, except that the amount of exchanged water contained in the crosslinked-resin-surface-layer coating liquid was changed to 8.4 parts by mass.

Example 8

An electrophotographic photoconductor was produced in the same manner as in Example 6, except that the amount of exchanged water contained in the crosslinked-resin-surface-layer coating liquid was changed to 12.7 parts by mass.

Comparative Example 1

An electrophotographic photoconductor was produced in the same manner as in Example 6, except that the crosslinked-resin-surface-layer coating liquid was changed to the following compound.

[Crosslinked-Resin-Surface-Layer Coating Liquid]

| | |
|---|---|
| crosslinked charge transporting material represented by the following structural formula | 6.0 parts by mass |

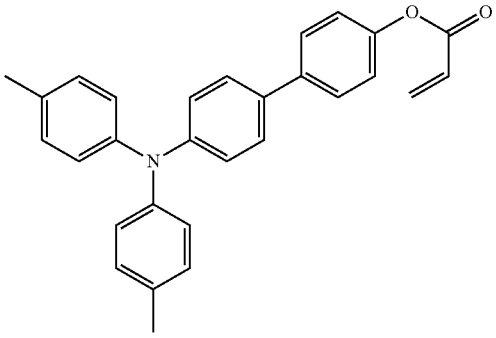

| | |
|---|---|
| trimethylolpropane triacrylate (KAYARAD TMPTA, produced by Nippon Kayaku Co., Ltd.) | 3.0 parts by mass |
| 50% diluent (THF) of caprolactone-modified dipentaerythritol hexaacrylate (KAYARAD DPCA-120, produced by Nippon Kayaku Co., Ltd.) | 6.0 parts by mass |
| 5% diluent (THF) of a mixture of an acrylic group-containing polyester-modified polydimethyl siloxane and propoxy-modified- | .0.24 parts by mass |

-continued

| | |
|---|---|
| 2-neopentyl glycol diacrylate (BYK-UV3570, produced by BYK Chemie Gmbh.) | |
| 1-hydroxycyclohexyl phenylketone (IRGACURE 184, produced by Chiba Specialty Chemicals K.K.) | 0.60 parts by mass |
| tris(2,4-di-tert-butylphenyl)phosphite | 0.12 parts by mass |
| tetrahydrofuran | 68.9 parts by mass |

Comparative Example 2

An electrophotographic photoconductor was produced in the same manner as in Example 6, except that the crosslinked-resin-surface-layer coating liquid was changed to the following compound.

[Crosslinked-Resin-Surface-Layer Coating Liquid]

| | |
|---|---|
| crosslinked charge transporting material represented by the following structural formula | 6.0 parts by mass |

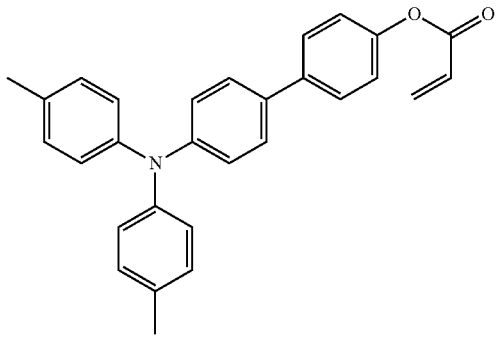

| | |
|---|---|
| trimethylolpropane triacrylate (KAYARAD TMPTA, produced by Nippon Kayaku Co., Ltd.) | 3.0 parts by mass |
| 50% diluent (THF) of caprolactone-modified dipentaerythritol hexaacrylate (KAYARAD DPCA-120, produced by Nippon Kayaku Co., Ltd.) | 6.0 parts by mass |
| 5% diluent (THF) of a mixture of an acrylic group-containing polyester-modified polydimethyl siloxane and propoxy-modified-2-neopentyl glycol diacrylate (BYK-UV3570, produced by BYK Chemie Gmbh.) | .0.24 parts by mass |
| 1-hydroxycyclohexyl phenylketone (IRGACURE 184, produced by Chiba Specialty Chemicals K.K.) | 0.60 parts by mass |
| tris(2,4-di-tert-butylphenyl)phosphite | 0.12 parts by mass |
| filler (EPOSTER S6; average particle diameter: 0.3 μm produced by Nippon Shokubai Co., Ltd.) | 0.67 parts by mass |
| tetrahydrofuran | 68.9 parts by mass |

Comparative Example 3

An electrophotographic photoconductor was produced in the same manner as in Comparative Example 1, except that the amount of the filler contained in the crosslinked-resin-surface-layer coating liquid was changed to 1.4 parts by mass.

Comparative Example 4

An electrophotographic photoconductor was produced in the same manner as in Comparative Example 1, except that the amount of the filler contained in the crosslinked-resin-surface-layer coating liquid was changed to 3.2 parts by mass.

Comparative Example 5

An electrophotographic photoconductor was produced in the same manner as in Example 6, except that the crosslinked-resin-surface-layer coating liquid was changed to the following compound.

[Filler-Reinforced-Charge-Transporting-Layer Coating Liquid]

| | |
|---|---|
| Z-type polycarbonate (PANLITE TS-2050, produced by Teijin Chemicals Ltd.) | 10 parts by mass |

-continued

| | |
|---|---|
| low-molecular-weight charge transporting material represented by the following structural formula | 7 parts by mass |

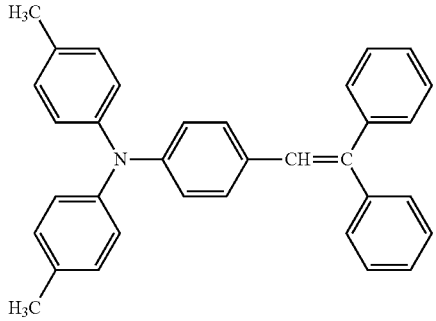

-continued

| | |
|---|---|
| α-alumina (SUMIKORANDOM AA-03; produced by Sumitomo Chemical Co., Ltd.) | 5.7 parts by mass |
| dispersant (BYK-P104, produced by BYK Chemie Gmbh.) | 0.014 parts by mass |
| tetrahydrofuran | 280 parts by mass |
| cyclohexanone | 80 parts by mass |

Each of the photoconductor drums of Example 1 to 8 and Comparative Example 1 to 5 having a diameter of 40 mm was made to be mounted, and then mounted on a yellow-color developing station of an image forming apparatus (IPSIO SP C811, manufactured by Ricoh Company Ltd.), followed by performing the solid lubricant acceptability test. The linear velocity of the electrophotographic photoconductor was 205 mm/s. Zinc stearate as solid lubricant attached to proper products and a spring accompanied therewith were used without modification.

As a photoconductor unit-developing unit complex unit (PD unit), proper products were used. As the AC component of a voltage applied by the charging roller, a peak-to-peak voltage of 1.5 kV, and a frequency of 0.9 kHz were selected. In addition, the DC component was set to be a bias such that the charging voltage of the photoconductor at the initial stage of the test was −700 V and this charging condition was maintained until the test was complete. In this image forming apparatus, no charge eliminating unit was provided.

Each of the photoconductor drums of Example 1 to 8 and Comparative Example 1 to 5 having a diameter of 40 mm was made to be mounted, and then mounted on a black-color developing station of an image forming apparatus (IPSIO SP C811, manufactured by Ricoh Company Ltd.) A halftone pattern A half tone pattern having 4 dots×4 dots in 8×8 matrix with a pixel density of 600 dpi (dot per inch)×600 dpi and a white-paper pattern were continuously alternately printed (5 sheets for each pattern) on copy paper (MY PAPER A4, produced by NBS Ricoh Co., Ltd.) for a total run length of 50,000 sheets. Proper toner and development agent for IPSIO SP C811 were used. The toner is a polymerized toner.

Also a proper photoconductor was used. As the AC component of a voltage applied by the charging roller, a peak-to-peak voltage of 1.5 kV, and a frequency of 0.9 kHz were selected. In addition, the DC component was set to be a bias such that the charging voltage of the photoconductor at the initial stage of the test was −700 V and this charging condition was maintained until the test was complete. The developing bias was −500V. In this image forming apparatus, no charge eliminating unit was provided. Furthermore, a proper cleaning unit was used and replaced with a new cleaning unit every time the image was printed on 50,000 sheets to continue the test. After the test was complete, the color test chart was printed on PPC paper (TYPE-6200 A3). The test was performed in an environment of 25° C. and 55% RH.

The results of WRa in respective frequency components of the electrophotographic photoconductors of Example 1 to 8 and Comparative Example 1 to 5 are shown in FIGS. 27 to 34 and FIGS. 35 to 39. In the results shown in FIGS. 27 to 34 corresponding to Examples 1 to 8, an inflection point is observed in frequency bands of low frequency components. The results of frequency band of an inflection point, shape factor, area ratio of zinc stearate adhered on photoconductor, and the evaluation results of image formed are shown in Table 2.

TABLE 2

| | frequency band of inflection point | Shape Factor | Area ratio (%) of zinc stearate adhered on photoconductor | Evaluation of Image |
|---|---|---|---|---|
| Ex. 1 | LLH | 2.62 | 11 | 5 |
| Ex. 2 | LLH | 2.49 | 9.6 | 5 |
| Ex. 3 | LLH | 3.48 | 10 | 4 |
| Ex. 4 | LLH | 3.47 | 8.4 | 4 |
| Ex. 5 | LLH | 3.28 | 12 | 5 |
| Ex. 6 | LLH | 1.82 | 8.9 | 5 |
| Ex. 7 | LLH | 1.82 | 7.4 | 5 |
| Ex. 8 | LLH | 1.69 | 7.6 | 5 |
| Comp. Ex. 1 | — | −3.82 | 1.9 | 2 |
| Comp. Ex. 2 | LHL | −3.68 | 1.6 | 3 |
| Comp. Ex. 3 | — | −4.98 | 0.60 | 1 |
| Comp. Ex. 4 | LHL | −3.77 | 3.0 | 1 |
| Comp. Ex. 5 | LML | −0.09 | 3.4 | 3 |

From the results shown in Table 2, it is found that the electrophotographic photoconductors of Example 1 to Example 8 had a positive shape factor value and the adhesion of solid lubricant was improved as compared to the electrophotographic photoconductor of Comparative Example 1 provided with no surface roughness treatment. An electrophotographic photoconductor subjected to surface roughness treatment does not always simply improve in adhesion of solid lubricant. In some cases, solid lubricant does not adhere on a surface of photoconductor as shown in Comparative Example 3. In the present invention, it was found that on the adhesion of solid lubricant, an appropriate rough-surface configuration presents, as the conditions therefor, a function of preventing a powder of solid lubricant scraped by a coating brush from slipping sideways on an electrophotographic photoconductor and a function of effecting an appropriate variation in linear pressure on the coating blade can be exhibited by providing a rough surface to the electrophotographic photoconductor. The former is achieved by forming shapes of concaves and convexes of high frequency components, and the latter is achieved by forming shapes of concaves and convexes of low frequency components.

Therefore, a photoconductor provided on its surface with appropriate shapes of concaves and convexes had a result excellent in adhesion of solid lubricant. A rough surface configuration advantageous in coatability of solid lubricant can be obtained by spraying an uncured film of a crosslinked resin surface layer with water and by adding a large amount of water into a crosslinked-resin-protective layer coating liquid.

REFERENCE SIGNS LIST

11 electrophotographic photoconductor
12 charging unit
13 exposing unit
14 developing unit
15 toner
16 transfer unit
17 cleaning unit
18 printing medium (printing paper sheet, OHP slide)
19 fixing unit
1A charge eliminating unit
1B pre-cleaning-exposing unit
1C driving unit
1D primary transfer unit 1E secondary transfer unit
1F intermediate transfer member (belt)
21 conductive support
24 undercoat layer
25 charge generating layer
26 charge transporting layer
28 crosslinked resin surface layer
31 photoconductor
37 solid lubricant
38 charging roller
39 coating blade
3A solid lubricant
3B coating brush
3C lubricant supplying unit
3D edge portion of coating blade
41 electrophotographic photoconductor evaluated
42 jig attached with a probe to measure surface roughness
43 mechanism by which the jig is moves to a measurement object
44 surface roughness measuring device
45 personal computer for use in analysis of signal
101 the highest frequency component in the first time multiresolution analysis result
102 frequency component whose level being one-level lower than that of the highest frequency component in the first time multiresolution analysis result
103 frequency component whose level being two-level lower than that of the highest frequency component in the first time multiresolution analysis result
104 frequency component whose level being three-level lower than that of the highest frequency component in the first time multiresolution analysis result
105 frequency component whose level being four-level lower than that of the highest frequency component in the first time multiresolution analysis result
106 the lowest frequency component in the first time multiresolution analysis result
107 the highest frequency component in the second time multiresolution analysis result
108 frequency component whose level being one-level lower than that of the highest frequency component in the second time multiresolution analysis result
109 frequency component whose level being two-level lower than that of the highest frequency component in the second time multiresolution analysis result
110 frequency component whose level being three-level lower than that of the highest frequency component in the second time multiresolution analysis result
111 frequency component whose level being four-level lower than that of the highest frequency component in the second time multiresolution analysis result
112 the lowest frequency component in the second time multiresolution analysis result
121 frequency band of the highest frequency component in the first time multiresolution analysis
122 frequency band of frequency component whose level being one-level lower than that of the highest frequency component in the first time multiresolution analysis
123 frequency band of frequency component whose level being two-level lower than that of the highest frequency component in the first time multiresolution analysis
124 frequency band of frequency component whose level being three-level lower than that of the highest frequency component in the first time multiresolution analysis
125 frequency band of frequency component whose level being four-level lower than that of the highest frequency component in the first time multiresolution analysis
126 frequency band of the lowest frequency component in the first time multiresolution analysis
127 frequency band of the highest frequency component in the second time multiresolution analysis
128 frequency band of frequency component whose level being one-level lower than that of the highest frequency component in the second time multiresolution analysis
129 frequency band of frequency component whose level being two-level lower than that of the highest frequency component in the second time multiresolution analysis
130 frequency band of frequency component whose level being three-level lower than that of the highest frequency component in the second time multiresolution analysis
131 frequency band of frequency component whose level being four-level lower than that of the highest frequency component in the second time multiresolution analysis
132 frequency band of the lowest frequency component in the second time multiresolution analysis

The invention claimed is:

1. An electrophotographic photoconductor comprising:

a support, a photosensitive layer, and a crosslinked resin surface layer, the photosensitive layer and crosslinked resin surface layer being provided over the support wherein the crosslinked resin surface layer is a layer which is cured by UV irradiation after (i) the photosensitive layer is sprayed with a crosslinked-resin-surface-layer coating liquid to form a wet film and (ii) the wet film is sprayed with water, wherein shapes of concaves and convexes in a surface of the electrophotographic photoconductor are measured by a surface roughness/profile measuring device to obtain one-dimensional data arrays, the one-dimensional data arrays are subjected to a multiresolution analysis (MRA-1) through wavelet transformation so as to be separated into six frequency components including a highest frequency component (HHH), a second highest frequency component (HHL), a third highest frequency component (HMH), a fourth highest frequency component (HML), a fifth highest frequency component (HLH) and a lowest frequency component (HLL), the one-dimensional data arrays of the lowest frequency component (HLL) thus obtained are thinned out so that the number of data arrays is reduced to 1/10 to 1/100 thereof to thereby produce one-dimensional data arrays, the one-dimensional data arrays thus produced are subjected to a multiresolution analysis (MRA-2) through wavelet transformation so as to be separated into six frequency components including a highest frequency component (LHH), a second highest frequency component (LHL), a third highest frequency component (LMH), a fourth highest frequency component (LML), a fifth highest frequency component (LLH) and a lowest frequency component (LLL) to thereby obtain 12 frequency components in total; and the crosslinked resin surface layer is processed to obtain a center-line average roughness (WRa) of each of 7 frequency components out of the 12 frequency components satisfying a relationship (i) below, $$1-597\times WRa(HML)+238\times WRa(HLH)-95\times WRa(LHL)+84\times WRa(LMH)-79\times WRa(LML)+55\times WRa(LLH)-17\times WRa(LLL)>0 \quad (i)$$

where a center-line average roughness (WRa) of each of the frequency components is a center-line average roughness based on one-dimensional data arrays, which is obtained by a procedure in which shapes of concaves and convexes in a surface of the electrophotographic photoconductor are measured by a surface roughness/profile measuring device to obtain one-dimensional data arrays, and the one-dimensional data arrays are subjected to multiresolution analyses (MRA-1) and (MRA-2) so as to be separated into different frequency components ranging from a highest frequency component to a lowest frequency component; and HML, HLH, LHL, LMH, LML, LLH, and LLL each represent an individual frequency band obtained when the one-dimensional data arrays are separated into frequency components having one concave-convex cycle length of from 4 μm to 25 μm, from 10 μm to 50 μm, from 53 μm to 183 μm, from 106 μm to 318 μm, from 214 μm to 551 μm, from 431 μm to 954 μm, and from 867 μm to 1,654 μm, in this order.

2. The electrophotographic photoconductor according to claim 1, wherein the crosslinked resin surface layer contains at least a crosslinked product of a curable charge transporting material represented by the following General Formula (1) in an amount equal to or more than 5% by mass and less than 60% by mass of the crosslinked resin surface layer, General Formula (1)

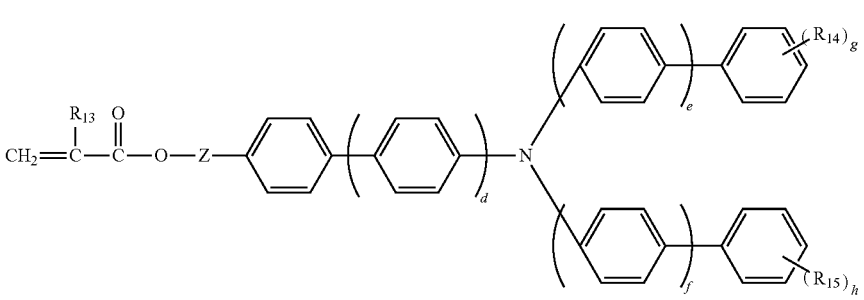

where d, e and f each represent an integer of zero or 1, $R_{13}$ represents a hydrogen atom or a methyl group; $R_{14}$ and $R_{15}$ each represent an alkyl group having 1 to 6 carbon atoms, which is a substituent other than hydrogen atom, and in the case where $R_{14}$ and $R_{15}$ are present in plural number, each may be different; g and h each represent an integer of zero to 3; and Z represents anyone of a single bond, a methylene group, an ethylene group and a divalent group represented by one of the following formulae:

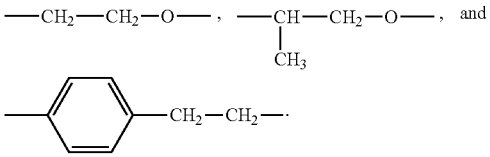

3. The electrophotographic photoconductor according to claim 1, wherein the crosslinked resin surface layer contains a crosslinked product of trimethylolpropane triacrylate in an amount equal to or more than 10% by mass and less than 50% by mass of the crosslinked resin surface layer.

4. The electrophotographic photo conductor according to claim 1, wherein the crosslinked resin surface layer is formed with a crosslinked-resin-surface-layer coating liquid containing water in an amount of 5% by mass to 15% by mass with respect to the mass of the crosslinked-resin-surface-layer coating liquid.

5. A method for producing an electrophotographic photoconductor having a photosensitive layer and a crosslinked resin surface layer over a support wherein the crosslinked resin surface layer is a layer which is cured by UV irradiation after (i) the photosensitive layer is sprayed with a crosslinked-resin-surface-layer coating liquid to form a wet film and (ii) the wet film is sprayed with water, wherein shapes of concaves and convexes in a surface of the electrophotographic photoconductor are measured by a surface roughness/profile measuring device to obtain one-dimensional data arrays, the one-dimensional data arrays are subjected to a multiresolution analysis (MRA-1) through wavelet transformation so as to be separated into six frequency components including a highest frequency component (HHH), a second highest frequency component (HHL), a third highest frequency component (HMH), a fourth highest frequency component (HML), a fifth highest frequency component (HLH) and a lowest frequency component (HLL), the one-dimensional data arrays of the lowest frequency component (HLL) thus obtained are thinned out so that the number of data arrays is reduced to 1/10 to 1/100 thereof to thereby produce one-dimensional data arrays, the one-dimensional data arrays thus produced are subjected to a multiresolution analysis (MRA-2) through wavelet transformation so as to be separated into six frequency components including a highest frequency component (LHH), a second highest frequency component (LHL), third highest frequency component (LMH), a fourth highest frequency component (LML), a fifth highest frequency component (LLH) and a lowest frequency component (LLL) to thereby obtain 12 frequency components in total; and the method includes processing the crosslinked resin surface layer to obtain a center-line average roughness (WRa) of each of 7 frequency components out of the 12 frequency components satisfying a relationship (i) below, $$1-597\times WRa(HML)+238\times WRa(HLH)-95\times WRa(LHL)+84\times WRa(LMH)-79\times WRa(LML)+55\times WRa(LLH)-17\times WRa(LLL)>0 \quad (i)$$

where a center-line average roughness (WRa) of each of the frequency components is a center-line average roughness based on one-dimensional data arrays, which is obtained by a procedure in which shapes of concaves and convexes in a surface of the electrophotographic photoconductor are measured by a surface roughness/profile measuring device to obtain one-dimensional data arrays, and the one-dimensional data arrays are subjected to the multiresolution analyses (MRA-1) and (MRA-2) so as to be separated into different frequency components ranging from a highest frequency component to a lowest frequency component; and HML, HLH, LHL, LMH, LML, LLH, and LLL each represent an individual frequency band obtained when the one-dimensional data arrays are separated into frequency components having one concave-convex cycle length of from 4 μm to 25 μm, from 10 μm to 50 μm, from 53 μm to 183 μm, from 106 μm to 318 μm, from 214 μm to 551 μm, from 431 μm to 954 μm, and from 867 μm to 1,654 μm, in this order.

6. An image forming apparatus comprising:

an electrophotographic photoconductor, a solid-lubricant applying unit which scrapes a solid lubricant with a brush roller and applies the scraped solid lubricant onto the electrophotographic photoconductor, and a coating blade for spreading the solid lubricant over a surface of the electrophotographic photoconductor, wherein the electrophotographic photoconductor comprises:

a support, a photosensitive layer, and a crosslinked resin surface layer, the photosensitive layer and crosslinked resin surface layer being provided over the support wherein the crosslinked resin surface layer is a layer which is cured by UV irradiation after (i) the photosensitive layer is sprayed with a crosslinked-resin-surface-layer coating liquid to form a wet film and (ii) the wet film is sprayed with water, wherein shapes of concaves and convexes in a surface of the electrophotographic photoconductor are measured by a surface roughness/profile measuring device to obtain one-dimensional data arrays, the one-dimensional data arrays are subjected to a multiresolution analysis (MRA-1) through wavelet transformation so as to be separated into six frequency components including a highest frequency component (HHH), a second highest frequency component (HHL), a third highest frequency component (HMH), a fourth highest frequency component (HML), a fifth highest frequency component (HLH) and a lowest frequency component (HLL), the one-dimensional data arrays of the lowest frequency component (HLL) thus obtained are thinned out so that the number of data arrays is reduced to 1/10 to 1/100 thereof to thereby produce one-dimensional data arrays, the one-dimensional data arrays thus produced are subjected to a multiresolution analysis (MRA-2) through wavelet transformation so as to be separated into six frequency components including a highest frequency component (LHH), a second highest frequency component (LHL), third highest frequency component (LMH), a fourth highest frequency component (LML), a fifth highest frequency component (LLH) and a lowest frequency component (LLL) to thereby obtain 12 frequency components in total;

and the crosslinked resin surface layer is processed to obtain a center-line average roughness (WRa) of each of 7 frequency components out of the 12 frequency components satisfying a relationship (i) below, $$1-597\times WRa(HML)+238\times WRa(HLH)-95\times WRa(LHL)+84\times WRa(LMH)-79\times WRa(LML)+55\times WRa(LLH)-17\times WRa(LLL)>0 \quad (i)$$

where a center-line average roughness (WRa) of each of the frequency components is a center-line average roughness based on one-dimensional data arrays, which is obtained by a procedure in which shapes of concaves and convexes in a surface of the electrophotographic photoconductor are measured by a surface roughness/profile measuring device to obtain one-dimensional data arrays, and the one-dimensional data arrays are subjected to multiresolution analyses (MRA-1) and (MRA-2) so as to be separated into different frequency components ranging from a highest frequency component to a lowest frequency component; and HML, HLH, LHL, LMH, LML, LLH, and LLL each represent an individual frequency band obtained when the one-dimensional data arrays are separated into frequency components having one concave-convex cycle length of from 4 μm to 25 μm, from 10 μm to 50 μm, from 53 μm to 183 μm, from 106 μm to 318 μm, from 214 μm to 551 μm, from 431 μm to 954 μm, and from 867 μm to 1,654 μm, in this order.

7. The image forming apparatus according to claim 6, wherein in the electrophotographic photoconductor, at least frequency components other than HLL have a WRa of 0.06 μm or greater, and a frequency band of each of the frequency components is higher than that of LLL and when the frequency band of the frequency components in the electrophotographic photoconductor is plotted against a logarithmic value of each of the WRa values on a two-dimensional graph to obtain a relationship therebetween, an inflection point or a local maximum point is present in the frequency band of anyone of LLH, LMH, and LML, and wherein the electrophotographic photoconductor satisfies a linear velocity requirement that 250 to 1,000 concaves and convexes in the surface of the photo conductor pass the coating blade per second.

8. The image forming apparatus according to claim 6, wherein a polymerized toner is used to develop an image.

9. The image forming apparatus according to claim 6, further comprising at least two developing units, wherein the image forming apparatus employs a tandem system, and a polymerized toner is used to develop an image.

* * * * *